US009732405B2

(12) United States Patent
Takahashi et al.

(10) Patent No.: US 9,732,405 B2
(45) Date of Patent: Aug. 15, 2017

(54) HOT ROLLED STEEL SHEET AND METHOD OF PRODUCING SAME

(75) Inventors: Yuzo Takahashi, Tokyo (JP); Junji Haji, Tokyo (JP); Osamu Kawano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 906 days.

(21) Appl. No.: 14/004,858

(22) PCT Filed: Mar. 16, 2012

(86) PCT No.: PCT/JP2012/056927

§ 371 (c)(1),
(2), (4) Date: Sep. 12, 2013

(87) PCT Pub. No.: WO2012/128228

PCT Pub. Date: Sep. 27, 2012

(65) Prior Publication Data

US 2014/0000769 A1 Jan. 2, 2014

(30) Foreign Application Priority Data

Mar. 18, 2011 (JP) ..... 2011-060909
Mar. 23, 2011 (JP) ..... 2011-064633

(51) Int. Cl.
*C22C 38/02* (2006.01)
*C22C 38/04* (2006.01)
(Continued)

(52) U.S. Cl.
CPC ..... *C22C 38/28* (2013.01); *C21D 8/0226* (2013.01); *C21D 8/0263* (2013.01);
(Continued)

(58) Field of Classification Search
CPC .. C21D 8/0263; C21D 8/0226; C21D 8/0426; C21D 8/0463; C21D 8/1222;
(Continued)

(56) References Cited

U.S. PATENT DOCUMENTS 7,347,902 B2 * 3/2008 Mega ..... C21D 8/0263 148/320
7,780,797 B2 * 8/2010 Okamoto ..... C22C 38/02 148/320
(Continued)

FOREIGN PATENT DOCUMENTS

CN 101696483 A 4/2010
JP 6-145792 A 5/1994
(Continued)

OTHER PUBLICATIONS

Korean Notice of Allowance and English translation thereof, dated Aug. 18, 2015, for counterpart Korean Application No. 10-2013-7023879.
(Continued)

*Primary Examiner* — Jessee Roe
*Assistant Examiner* — Anthony Liang
(74) *Attorney, Agent, or Firm* — Birch, Stewart, Kolasch & Birch, LLP

(57) ABSTRACT

A hot rolled steel sheet includes, as a chemical composition, at least one selected from Ti, REM, and Ca, and includes, as a metallographic structure, a ferrite as a primary phase, at least one of a martensite and a residual austenite as a secondary phase, and plural inclusions, wherein a total length in the rolling direction of both inclusion-cluster whose length in the rolling direction is 30 μm or more and independent-inclusion whose length in the rolling direction is 30 μm or more is 0 mm to 0.25 mm per 1 $mm^2$.

13 Claims, 10 Drawing Sheets

(51) Int. Cl.

| | |
|---|---|
| ***C22C 38/06*** | (2006.01) |
| ***C22C 38/28*** | (2006.01) |
| ***C21D 8/02*** | (2006.01) |
| ***C22C 38/00*** | (2006.01) |
| ***C22C 38/14*** | (2006.01) |
| ***C22C 38/08*** | (2006.01) |
| ***C22C 38/12*** | (2006.01) |
| ***C22C 38/16*** | (2006.01) |
| ***C22C 38/38*** | (2006.01) |

(52) U.S. Cl.
CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C21D 2211/005* (2013.01); *C21D 2211/008* (2013.01)

(58) Field of Classification Search
CPC ..... C21D 8/1261; C21D 2211/001; C21D 2211/005; C21D 2211/008; C22C 38/001; C22C 38/005; C22C 38/02; C22C 38/04; C22C 38/06; C22C 38/12; C22C 38/14; C22C 38/28; C22C 38/38
See application file for complete search history.

(56) References Cited

U.S. PATENT DOCUMENTS

2010/0000633 A1* 1/2010 Yokoi ..... B32B 15/013 148/504
2010/0112377 A1* 5/2010 Kaneko ..... C22C 38/001 428/659

FOREIGN PATENT DOCUMENTS

| | | | | |
|---|---|---|---|---|
| JP | 9-125194 | A | | 5/1997 |
| JP | 2008-138231 | A | | 6/2008 |
| JP | 2009-24227 | A | | 4/2010 |
| JP | 2010-90476 | A | | 4/2010 |
| JP | 2010090476 | A | * | 4/2010 |
| KR | 10-2009-0115885 | A | | 11/2009 |
| WO | WO 2011/111758 | A1 | | 9/2011 |

OTHER PUBLICATIONS

Chinese Office Action and Search Report, dated Oct. 30, 2014, for Chinese Application No. 201280013216.0, with English translation of Search Report.
Taiwanese Office Action for Application No. 101109250 dated Dec. 24, 2013, with English translation.
International Search Report issued in PCT/JP2012/056927 mailed Jun. 19, 2012.

* cited by examiner

HOT ROLLED STEEL SHEET AND METHOD OF PRODUCING SAME

TECHNICAL FIELD

The present invention relates to a hot rolled steel sheet which has composite structure and which shows high strength, excellent formability, and excellent fracture properties, and a method of producing the same.

Priority is claimed on Japanese Patent Application No. 2011-060909, filed in Japan on Mar. 18, 2011, and Japanese Patent Application No. 2011-064633, filed in Japan on Mar. 23, 2011, the contents of which are incorporated herein by reference.

BACKGROUND ART

In recent years, in order to reduce the weight of automobiles, attempts to increase the strength of steel sheets have been performed. In general, increasing the strength of the steel sheet leads to a deterioration of the formability such as a hole expansibility, and thinning the sheet thickness for weight reduction leads to a decrease in fatigue life. Accordingly, in order to develop a steel sheet which shows the high strength and which enables the weight reduction of automobiles, it is important to achieve improvements in the formability such as the hole expansibility and in the fatigue properties in addition to the increase in the strength of the steel sheet.

Conventionally, it is known that an excellent fatigue life can be obtained by producing steel which has composite structure consisting of ferrite and martensite. As a steel sheet which shows the high strength and in which the hole expansibility is intended to be improved by producing the steel which has the composite structure, Patent Document 1 discloses a high strength hot rolled steel sheet where a fraction of the microstructure of the steel which consists of the mixed structure of ferrite, martensite, and residual austenite is appropriately controlled. The characteristic values of the steel sheet which is obtained by the technique are tensile strength of 590 MPa or more and hole expanding ratio of approximately 50%.

Patent Document 2 discloses a high strength hot rolled steel sheet which consists of a mixed structure of ferrite and martensite, which is precipitation-strengthened by carbides of Ti or Nb. The characteristic values of the steel sheet which is obtained by the disclosed technique are tensile strength of 780 MPa or more and hole expanding ratio of approximately 50%.

However, for example, for steel sheets which are used as suspension members or the like of the automobile, a steel sheet which shows excellent coexistence of the tensile strength with the hole expansibility, such as tensile strength of 590 MPa or more and hole expanding ratio of 60% or more as the characteristic values thereof, is anticipated. In particular, a steel sheet which has hole expanding ratio of 90% or more when the tensile strength is 590 MPa to less than 780 MPa and which has hole expanding ratio of 60% or more when the tensile strength is 780 MPa to 980 MPa is anticipated.

In addition, since the variation of each measurement of the hole expanding ratio is comparatively large, it is necessary to reduce a standard deviation σ of the hole expanding ratio which is an index representing the variation, in addition to an average λave of the hole expanding ratio in order to improve the hole expansibility. As described above, in the steel sheets which are used as the suspension members of the automobiles, a steel sheet which has preferably standard deviation σ of the hole expanding ratio of 15% or less and which has more preferably standard deviation σ of the hole expanding ratio is 10% or less is anticipated.

In addition, for example, in a case where the automobile drives over a curb and a strong impact load is applied to the suspension parts, fracture may occur from a punching surface of the suspension parts as a starting point. In particular, since the notch sensitivity increases with an increase in the strength of the steel sheet, the fracture from the punching end face are strongly concerned. For this reason, for the steel sheets which are used as structural materials of the suspension parts or the like, it is necessary to improve the fracture properties. As indices representing the fracture properties, resistance of crack initiation Jc (unit: $J/m^2$) and resistance of crack propagation T. M. (tearing modulus) (unit: $J/m^3$) which are the characteristic values which are obtained by a three point bending test with notch, and fracture appearance transition temperature vTrs (unit: ° C.) and Charpy absorbed energy E (unit: J) which are obtained by a Charpy impact test may be exemplified. The resistance of crack initiation Jc represents the resistance to the initiation of cracks (the start of fracture) from the steel sheet which composes the structural material when the impact load is applied. On the other hand, the resistance of crack propagation T. M. represents the resistance to large-scale fracture (the propagation of fracture) of the steel sheet which composes the structural material. In order not to decrease the safety of the structural material when the impact load is applied, it is important to improve both of the resistances.

Conventionally, techniques, in which the characteristic values, in particular, the resistance of crack initiation Jc and the resistance of crack propagation T. M. which are characteristic values obtained by the three point bending test with notch intend to be improved, have not been disclosed.

In addition, repeated stress is applied to the suspension parts for the automobile. Therefore, since occurrence of the fatigue fracture is concerned, excellent fatigue properties are also required for the steel sheets which are used as structural materials such as suspension parts.

RELATED ART DOCUMENTS

Patent Documents

[Patent Document 1] Japanese Unexamined Patent Application, First Publication No. H6-145792

[Patent Document 2] Japanese Unexamined Patent Application, First Publication No. H9-125194

SUMMARY OF INVENTION

Technical Problem

The present invention was achieved in consideration of the problems described above. An object of the present invention is to provide a hot rolled steel sheet, which has an excellent balance between tensile properties and formability and furthermore which has excellent fracture properties and fatigue properties, and a method of producing the same.

Specifically, the present invention is to provide the hot rolled steel sheet which has composite structure and which shows high strength, wherein the hot rolled steel sheet has the properties such that: the tensile strength TS is 590 MPa or more and the n value (work hardening coefficient) is 0.13 or more as the tensile properties; the average λave of the hole expanding ratio is 60% or more and the standard deviation σ of the hole expanding ratio is 15% or less as the formability; the resistance of crack initiation Jc is 0.5 $MJ/m^2$ or more, the resistance of crack propagation T. M. is 600 $MJ/m^3$ or more, the fracture appearance transition temperature vTrs is −13° C. or lower, and the Charpy absorbed energy E is 16 J or more as the fracture properties; and the fatigue life in plane bending is 400000 times or more as the fatigue properties.

In particular, the present invention is to provide the hot rolled steel sheet in which, when the tensile strength TS is 590 MPa to less than 780 MPa, in the above-described properties, the average λave of the hole expanding ratio is 90% or more, the resistance of crack initiation Jc is 0.9 $MJ/m^2$ or more, and the Charpy absorbed energy E is 35 J or more.

Solution to Problem

An aspect of the present invention employs the following.

(1) A hot rolled steel sheet according to an aspect of the invention includes, as a chemical composition, by mass %, 0.03% to 0.1% of C, 0.5% to 3.0% of Mn, at least one of Si and Al so as to satisfy a condition of 0.5%≤Si+Al≤4.0%, limited to 0.1% or less of P, limited to 0.01% or less of S, limited to 0.02% or less of N, at least one selected from 0.001% to 0.3% of Ti, 0.0001% to 0.02% of Rare Earth Metal, and 0.0001% to 0.01% of Ca, and a balance consisting of Fe and unavoidable impurities, and as a metallographic structure, a ferrite as a primary phase, at least one of a martensite and a residual austenite as a secondary phase, and plural inclusions, wherein: amounts expressed in mass % of each element in the chemical composition satisfy a following Expression 1; an average grain size of the ferrite which is the primary phase is 2 μm to 10 μm; an area fraction of the ferrite which is the primary phase is 90% to 99%; an area fraction of the martensite and the residual austenite which are the secondary phase is 1% to 10% in total; when a cross section whose normal direction corresponds to a transverse direction of the steel sheet is observed at 30 of visual fields by 0.0025 $mm^2$, an average of a maximum of a ratio of a major axis to a minor axis of each of the inclusions in each of the visual fields is 1.0 to 8.0; when a group of inclusions in which a major axis of each of the inclusions is 3 μm or more and an interval in a rolling direction between the inclusions is 50 μm or less are defined as inclusion-cluster, and when an inclusion in which the interval is more than 50 μm are defined as an independent-inclusion, a total length in the rolling direction of both the inclusion-cluster whose length in the rolling direction is 30 μm or more and the independent-inclusion whose length in the rolling direction is 30 μm or more is 0 mm to 0.25 mm per 1 $mm^2$ of the cross section; a texture satisfies that an X-ray random intensity ratio of a {211} plane which is parallel to a rolling surface is 1.0 to 2.4; and a tensile strength is 590 MPa to 980 MPa.

$$12.0 \leq (Ti/48)/(S/32)+\{(Ca/40)/(S/32)+(\text{Rare Earth Metal}/140)/(S/32)\}\times 15 \leq 150 \quad \text{(Expression 1)}$$

(2) The hot rolled steel sheet according to (1) may further includes, as the chemical composition, by mass %, at least one of 0.001% to 0.1% of Nb, 0.0001% to 0.0040% of B, 0.001% to 1.0% of Cu, 0.001% to 1.0% of Cr, 0.001% to 1.0% of Mo, 0.001% to 1.0% of Ni, and 0.001% to 0.2% of V.

(3) In the hot rolled steel sheet according to (1) or (2), when the hot rolled steel sheet includes, as the chemical composition, by mass %, at least one of 0.0001% to 0.02% of Rare Earth Metal and 0.0001% to 0.01% of Ca, the Ti content may be 0.001% to less than 0.08%.

(4) In the hot rolled steel sheet according to any one of (1) to (3), amounts expressed in mass % of each element in the chemical composition may satisfy a following Expression 2; and the average of the maximum in the ratio of the major axis to the minor axis of each of the inclusions in each of the visual fields may be 1.0 to 3.0.

$$0.3 \leq (\text{Rare Earth Metal}/140)/(Ca/40) \quad \text{(Expression 2)}$$

(5) In the hot rolled steel sheet according to any one of (1) to (4), an area fraction of a bainite and a pearlite in the metallographic structure may be 0% to less than 5.0% in total.

(6) In the hot rolled steel sheet according to any one of (1) to (5), a total number of MnS precipitates and CaS precipitates having a major axis of 3 μm or more may be 0% to less than 70% as compared with a total number of the inclusions having the major axis of 3 μm or more.

(7) In the hot rolled steel sheet according to any one of (1) to (6), an average grain size of the secondary phase may be 0.5 μm to 8.0 μm.

(8) A method of producing the hot rolled steel sheet according to any one of (1) to (7) includes: a heating process of heating a steel piece which composed of the chemical composition according to any one of (1) to (4) to a range of 1200° C. to 1400° C.; a first rough rolling process of rough rolling the steel piece in a temperature range of higher than 1150° C. to 1400° C. so that a cumulative reduction is 10% to 70% after the heating process; a second rough rolling process of rough rolling in a temperature range of higher than 1070° C. to 1150° C. so that a cumulative reduction is 10% to 25% after the first rough rolling process; a finish rolling process of finish rolling so that a start temperature is 1000° C. to 1070° C. and a finish temperature is Ar3+60° C. to Ar3+200° C. to obtain a hot rolled steel sheet after the second rough rolling process; a first cooling process of cooling the hot rolled steel from the finish temperature so that a cooling rate is 20° C./second to 150° C./second after the finish rolling process; a second cooling process of cooling in a temperature range of 650° C. to 750° C. so that the cooling rate is 1° C./second to 15° C./second and a cooling time is 1 second to 10 seconds after the first cooling process; a third cooling process of cooling to a temperature range of 0° C. to 200° C. so that the cooling rate is 20° C./second to 150° C./second after the second cooling process; and a coiling process of coiling the hot rolled steel sheet after the third cooling process.

(9) In the method of producing the hot rolled steel sheet according to (8), in the first rough rolling process, the rough rolling may be conducted so that the cumulative reduction is 10% to 65%.

Advantageous Effects of Invention

According to the above aspects of the present invention, it is possible to obtain a steel sheet which has an excellent balance between tensile properties and formability and furthermore which has excellent fracture properties and fatigue properties.

DESCRIPTION OF EMBODIMENTS

Figure 1:
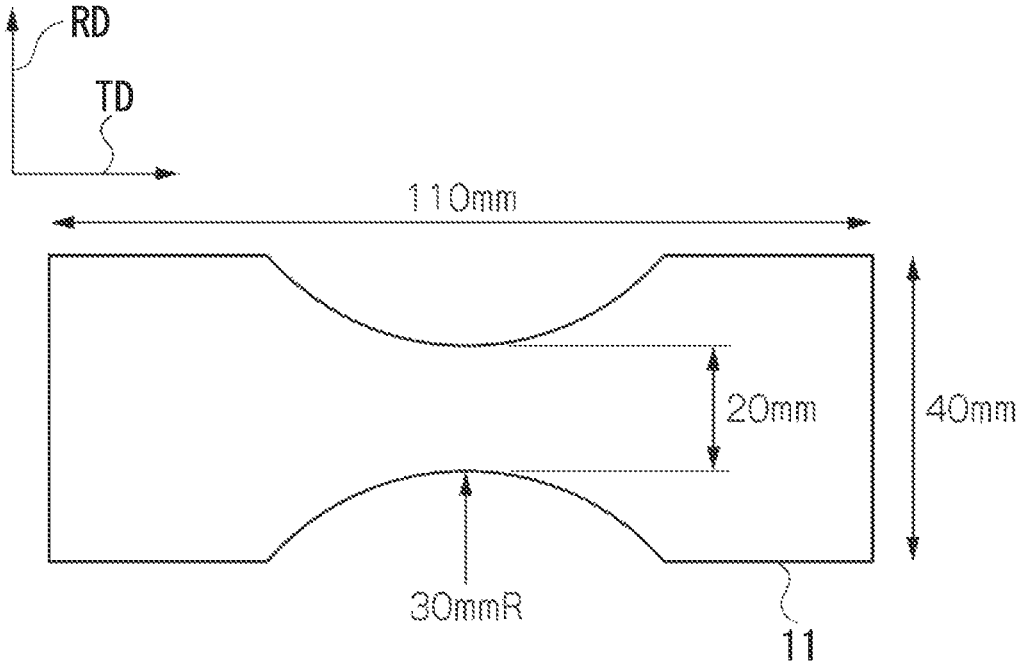
FIG. 1 is a plan view showing test piece size for evaluation of fatigue properties.

Hereinafter, a preferable embodiment of the present invention will be described in detail. However, the present invention is not limited only to the configuration which is disclosed in the embodiment, and various modifications are possible without departing from the aspect of the present invention.

First, description will be given of the basic research results which have led to the completion of the present invention. To start with, description will be given of a measurement method of characteristic values which are required in the hot rolled steel sheet according to the embodiment.

The tensile properties were determined from a tensile test with the following conditions. From a portion of ½ in the sheet width of a test steel sheet, test pieces were prepared so that a tensile direction was parallel to a transverse direction of the test steel sheet. The tensile test was conducted using the test pieces. Then, tensile strength (TS: Tensile Strength) and yield point (YP: Yield Point) were determined. Here, in a case where a clear yield point is not observed, 0.2% proof stress was regarded as the yield point. In addition, n value (work hardening coefficient) is determined as an approximate value of an n-th power law hardening rule based on true stress and true strain which were calculated from the tensile test. Here, a range of the strain when the n value is determined is to be 3% to 12%.

The hole expansibility was evaluated from a hole expansion test with the following conditions. From the portion of ½ in the sheet width of the test steel sheet, 20 test pieces where the length in the rolling direction was 150 mm and the length in the transverse direction was 150 mm were prepared for each test steel sheet. Using the test pieces, the hole expansion test was conducted with the following conditions. The evaluation of the hole expansibility was conducted with the average λave of the hole expanding ratio (unit: %) which was determined by arithmetically averaging 20 test results and with the standard deviation σ (unit: %) which was determined from the following Expression 1. Here, λi in the following Expression 1 represents the i-th hole expanding ratio in the total of 20 tests.

$$\sigma^2 = \frac{1}{20}\sum_{i=1}^{20}(\lambda i - \lambda ave)^2 \quad \text{(Expression 1)}$$

The conditions of the hole expansion test were as follows. In the test piece, a punching hole of 10 mm as an was provided by using a punching punch with a diameter of 10 mm under condition where a punching clearance which was obtained by dividing the intervals between the punching punch and the die hole by the sheet thickness of the test piece was to be 12.5%. Next, in the punching hole in the test piece, a conical punch with an angle of 60° was inserted from the same direction as the punching punch and the inner hole diameter Df was measured at a point of time where crack which was initiated in the punching end surface penetrated in the sheet thickness direction of the test piece. Then, the hole expanding ratio λi (unit: %) was determined from the following Expression 2. Here, the penetration of the crack in the sheet thickness was visually observed.

$$\lambda i = \{(Df - D0)/D0\} \times 100 \quad \text{(Expression 2)}$$

The fatigue properties were evaluated from a fatigue test with the following conditions. Test pieces with the size shown in FIG. 1 were prepared from the test steel sheets which were as-hot-rolled. In FIG. 1, the test piece for the fatigue test is shown as 11, the rolling direction is shown as RD (Rolling Direction), and the transverse direction is shown as TD (Transverse Direction). Repeated stress by plane bending was applied to a neck section of the center of the test pieces and the fatigue life in plane bending, which was the number of repetitions until the test pieces was fatigue-fractured, was measured. The condition of the repeated stress which was applied to the test pieces in the fatigue test was completely reversed. Specifically, in a case where the stress amplitude=$\sigma_0$, the conditions of the fatigue test were controlled so that the stress change over time was a sine wave where the maximum stress=$\sigma_0$, the minimum stress=$-\sigma_0$, and the average of the stress=0. The stress amplitude $\sigma_0$ was to be within a range of 45%±10 MPa as compared with the tensile strength TS of the test steel sheet. In addition, the fatigue test was conducted at least three times under conditions with the same stress amplitude $\sigma_0$, and the average of the fatigue life in plane bending by arithmetically averaging each test result was determined. The fatigue properties were evaluated by the average of the fatigue life in plane bending.

The fracture properties were evaluated by the resistance of crack initiation Jc (unit: J/m$^2$) and the resistance of crack propagation T. M. (unit: J/m$^3$) which were obtained by the three point bending test with notch to be described later, and the fracture appearance transition temperature vTrs (unit: ° C.) and the Charpy absorbed energy E (unit: J) which were obtained by the Charpy impact test.

Figure 2A:
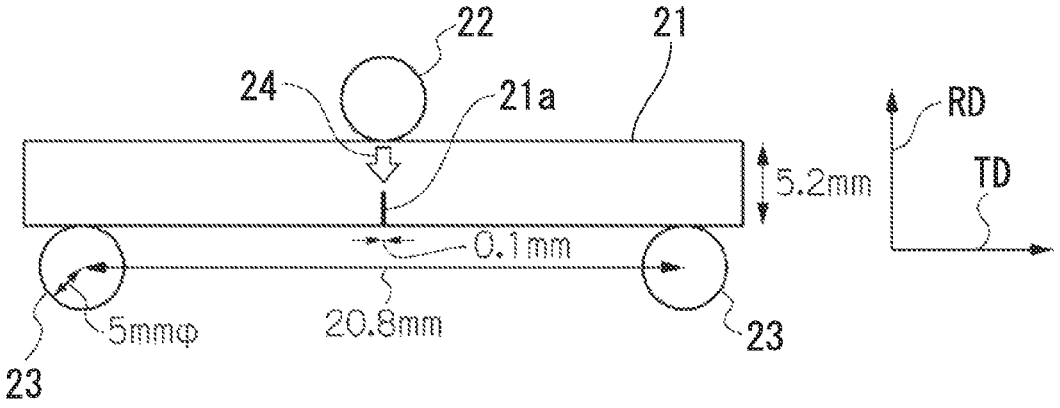
FIG. 2A is an explanatory view for the three point bending test with notch.
Figure 2B:
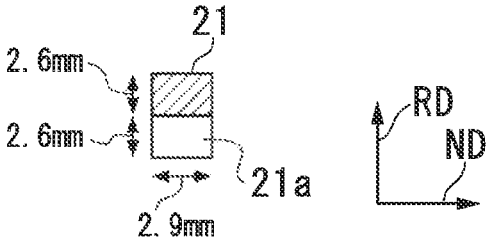
FIG. 2B shows a notched test piece before the three point bending test with notch and is a cross sectional view which includes the notch whose a normal direction corresponds to a transverse direction of a steel sheet.

The conditions of the three point bending test with notch were as follows. Five or more of the notched test pieces shown in FIG. 2A and FIG. 2B were prepared from one test steel sheet so that the longitudinal direction of the test piece was parallel to the transverse direction of the test steel sheet and the displacement direction of the three point bending test with notch corresponded to the rolling direction of the test steel sheet. FIG. 2A is an explanatory view for the three point bending test with notch. In FIG. 2A, a test piece for the three point bending test with notch is shown as 21, a notch is shown as 21, a load point is shown as 22, support points are shown as 23, and the displacement direction is shown as 24. FIG. 2B is a cross sectional view of the notched test piece 21 before the three point bending test with notch which includes the notch 21*a* whose the normal direction corresponds to the transverse direction TD of the test steel sheet. In FIG. 2B, the sheet thickness direction is shown as ND (Normal Direction). As shown in the figures, the longitudinal direction of the test piece 21 was 20.8 mm, the thickness in the displacement direction 24 of the test piece 21 was 5.2 mm, the depth of the displacement direction 24 of the notch 21*a* was 2.6 mm, the thickness C (value where the depth of the displacement direction 24 of the notch 21*a* was subtracted from the thickness of the displacement direction 24 of the test piece 21) of the displacement direction 24 of the ligament was 2.6 mm, and the sheet thickness B of the test steel sheet was 2.9 mm.

Figure 2C:
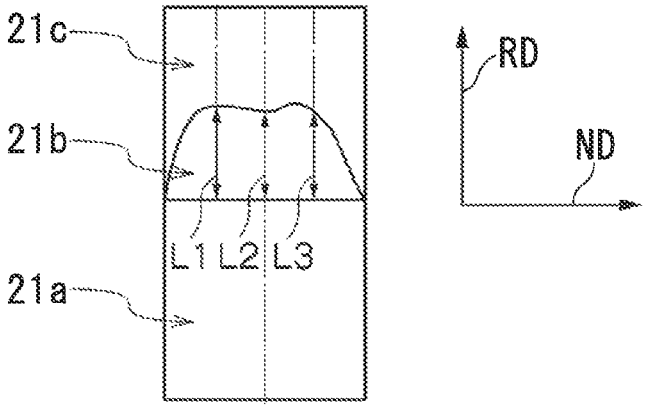
FIG. 2C shows a notched test piece which is forcibly fractured after the three point bending test with notch and shows a fracture surface which includes the notch.

As shown in FIG. 2A, using the test piece 21, both end sections in the longitudinal direction of the test piece 21 were set as the support points 23 and the central portion thereof was set as the load point 22, and the amount of displacement (stroke) in the displacement direction 24 of the load point were variously changed, thereby conducting the three point bending test with notch. The test piece 21 after the three point bending test with notch was subjected to a heat treatment where the test piece was held for 30 minutes at 250° C. in the atmosphere and then was air-cooled. By the heat treatment, the fracture surface which was derived from the three point bending test with notch was oxidized and colored. The test piece 21 after the heat treatment was cooled using liquid nitrogen to the temperature of the liquid nitrogen, and then the test piece 21 was forcibly fractured at the temperature so that the crack propagated along the displacement direction 24 from the notch 21*a* of the test piece 21. FIG. 2C exemplifies a fracture surface which includes the notch in the notched test piece 21 which was forcibly fractured after the three point bending test with notch. In the fracture surface, as a result of the oxidizing and coloring, it was possible to clearly distinguish the fracture surface derived from the three point bending test with notch from the fracture surface derived from the forced fracture. In FIG. 2C, the fracture surface derived from the three point bending test with notch is shown as 21*b*, the fracture surface derived from the forced fracture is shown as 21*c*, the depth of the fracture surface 21*b* at a position of ¼ in the sheet thickness of the test steel sheet is shown as L1, the depth of the fracture surface 21*b* at a position of ½ in the sheet thickness of the test steel sheet is shown as L2s, and the depth of the fracture surface 21*b* at a position of ¾ in the sheet thickness of the test steel sheet is shown as L3. The fracture surface 21*b* was observed, L1, L2, and L3 were measured, and then the amount of crack propagation Δa (unit: m) was determined from the following Expression 3.

$$\Delta a=(L1+L2+L3)/3 \quad \text{(Expression 3)}$$

Figure 3A:
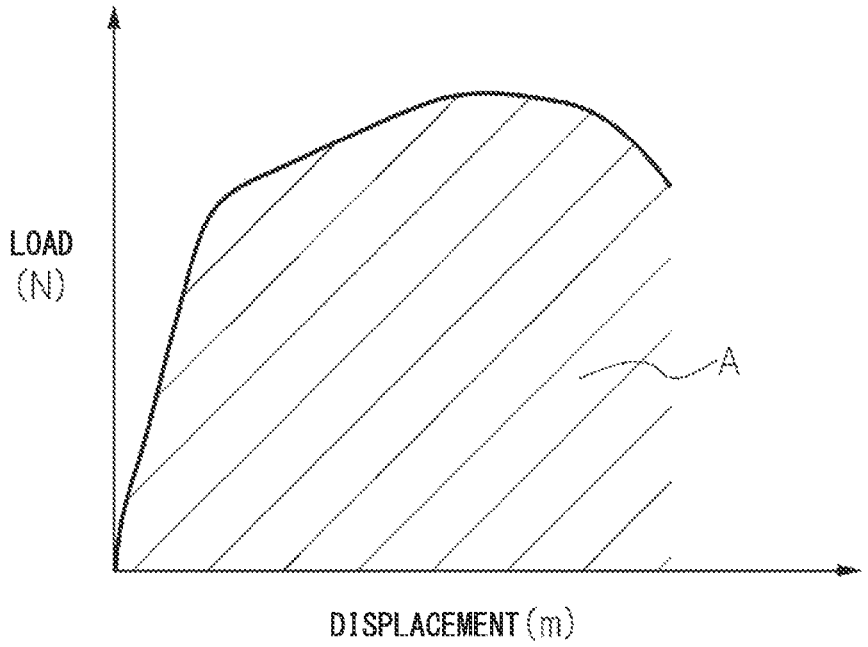
FIG. 3A is a load displacement curve which is obtained by the three point bending test with notch.

FIG. 3A exemplifies a load displacement curve obtained by the three point bending test with notch. As shown in FIG. 3A, by integrating the load displacement curve, processing energy A (unit: J) corresponding to the energy which was applied to the test piece 21 by the test was determined. Then, using the processing energy A, the sheet thickness B of the test steel sheet before the three point bending test with notch, and the thickness C of the displacement direction 24 of the ligament, processing energy J (unit: J/m$^2$) per 1 m$^2$ was determined from the following Expression 4.

$$J=(2\times A)/(B\times C) \quad \text{(Expression 4)}$$

Figure 3B:
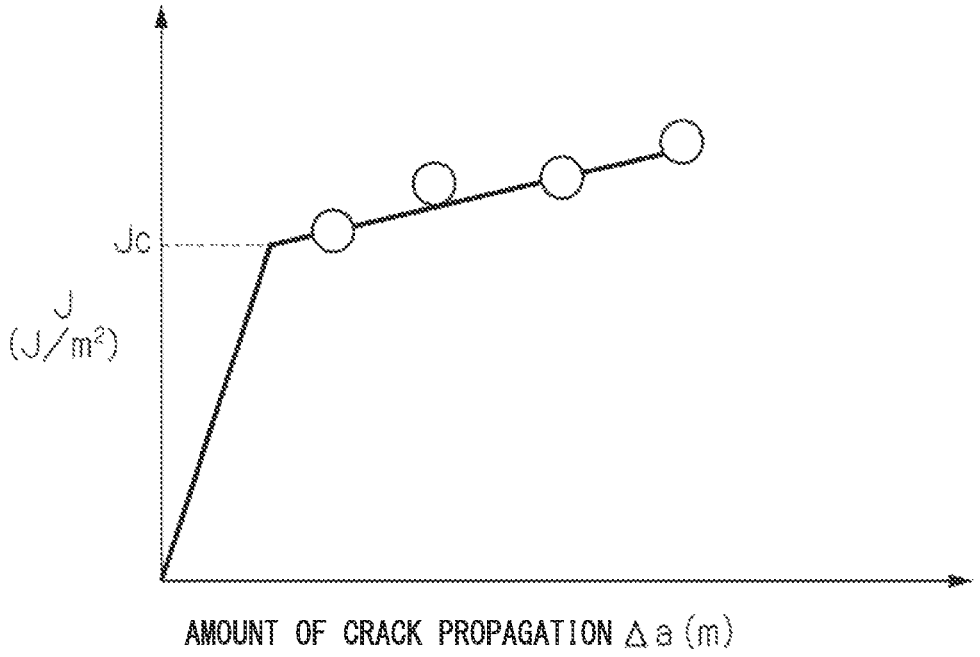
FIG. 3B is a graph showing a relationship between an amount of crack propagation Δa and processing energy J per 1 $m^2$.

FIG. 3B is a graph showing the relationship between the amount of crack propagation Δa and the processing energy J per 1 m$^2$ when the stroke conditions are variously changed in the three point bending test with notch. As shown in FIG. 3B, an intersection between a linear regression line with respect to Δa and J and a straight line which passed through an origin and whose inclination was 3×(YP+TS)/2 was determined. The value of the processing energy J per 1 m$^2$ in the intersection was regarded as the resistance of crack initiation Jc (unit: J/m$^2$) which was a value which represented the resistance to the initiation of crack of the test steel sheet. In addition, an inclination of the linear regression line was regarded as the resistance of crack propagation T. M. (unit: J/m$^3$) which represented the resistance to the propagation of crack of the test steel sheet. The resistance of crack initiation Jc is an index value which represents the degree of the processing energy which is necessary for initiating the crack. Specifically, the resistance of crack initiation Jc represents the resistance to the initiation of the crack (the start of the fracture) from the steel sheet which composes the structural material when the impact load is applied. The resistance of crack propagation T. M. is an index value which represents the degree of the processing energy which is necessary for propagating the crack. Specifically, the resistance of crack propagation T. M. represents the resistance to large-scale fracture (the propagation of the fracture) of the steel sheet which composes the structural material. The fracture properties of the steel sheet were evaluated by the resistance of crack initiation Jc and the resistance of crack propagation T. M.

The conditions of the Charpy impact test were as follows. V notched test pieces were prepared so that the longitudinal direction of the test piece was parallel to the transverse direction of the test steel sheet. Regarding the test piece size, the length of the test piece in the longitudinal direction was 55 mm, the thickness in the direction where the impact was applied to the test piece was 10 mm, the thickness in a direction which intersected with the longitudinal direction and the impact direction of the test piece was 2.5 mm, and a depth of the V notch was 2 mm and an angle thereof was 45°. By conducting the Charpy impact test using the test pieces, the fracture appearance transition temperature vTrs (unit: ° C.) and Charpy absorbed energy E (unit: J) were determined. Here, the fracture appearance transition temperature vTrs was to be a temperature where a fraction of the ductile fracture was 50%, and the Charpy absorbed energy E was to be a value which was obtained when the test temperature was room temperature (23° C.±5° C.). The fracture properties of the steel sheet were evaluated by the fracture appearance transition temperature vTrs and the Charpy absorbed energy E.

As the above-described characteristic values, the hot rolled steel sheet according to the embodiment satisfies that the tensile strength TS is 590 MPa or more, the average λave of the hole expanding ratio is 60% or more, the standard deviation σ of the hole expanding ratio is 15% or less, the fatigue life in plane bending is 400000 times or more, the resistance of crack initiation Jc is 0.5 $MJ/m^2$ or more, the resistance of crack propagation T. M. is 600 $MJ/m^3$ or more, the fracture appearance transition temperature vTrs is −13° C. or lower, and the Charpy absorbed energy E is 16 J or more.

Next, description will be given of the measurement method of the chemical composition, the observation method of the metallographic structure, and the like of the hot rolled steel sheet according to the embodiment.

The chemical composition of the steel sheet was quantitatively analyzed using EPMA (Electron Probe Micro-Analyzer: electron probe X-ray micro-analysis), AAS (Atomic Absorption Spectrometer: atomic absorption spectrometry), ICP-AES (Inductively Coupled Plasma-Atomic Emission Spectrometer: inductively coupled plasma emission spectroscopy spectrometry), or ICP-MS (Inductively Coupled Plasma-Mass Spectrometer: inductively coupled plasma mass analysis spectrometry).

The observation of the metallographic structure of the steel sheet was conducted using the following methods. Test pieces for metallographic structure observation were cut out from a portion of ¼ in the sheet width of the steel sheet, so that a cross section (hereinafter, L cross section) whose normal direction corresponded to the transverse direction was an observed section. Then, the test pieces were mirror-polished. Using the test pieces after mirror polishing, inclusions which were included in the metallographic structure were observed at a magnification of 400-fold by an optical microscope so that the observed area was at the vicinity of the central portion of the sheet thickness in the above-described L cross section. In addition, Nital etching or Le Pera etching were conducted on the test pieces after mirror polishing, and the observation was conducted of the metallic phases such as ferrite, martensite, residual austenite, bainite, pearlite, and the like.

The average grain size of ferrite was determined as follows. The crystal orientation distribution was measured by 1 μm steps using an EBSD (Electron Back-Scattered diffraction Pattern) method, so that the observed area was at the central portion of the sheet thickness in the L cross section and was an area of 500 μm in the normal direction and 500 μm in the rolling direction. Then, points where the misorientation was 15° or more were connected, which was regarded as high-angle grain boundaries. The arithmetic average of equivalent circle diameters of each crystal grain which was surrounded by the high-angle grain boundaries were determined and were regarded as the average grain size of the ferrite. At this time, among each of the measurement points which were measured by the EBSD method, crystal grains where the IQ (Image Quality) value was 100 or more were regarded as the ferrite, and the crystal grains where the IQ value was 100 or less were regarded as metallic phases with the exception of the ferrite.

Area fractions such as ferrite, martensite, residual austenite, bainite, pearlite, and the like were determined by image analysis of metallographic micrograph.

In addition, for the investigation of the inclusions, the total length M (unit: $mm/mm^2$) in the rolling direction of the inclusions which were defined as described below was measured.

The existence of the inclusions causes a deterioration of the hole expansibility, because the inclusions form voids in the steel during the deformation of steel sheet and promote the ductile fracture. Moreover, as the shape of the inclusions is elongated in the rolling direction of the steel sheet, the stress concentration in the vicinity of the inclusions during plastic deformation of steel sheet increases. Specifically, in addition to the existence of the inclusions, the hole expansibility is drastically influenced by the shape of the inclusions. Conventionally, it is known that the hole expansibility drastically deteriorates with an increase in the length in the rolling direction of individual inclusions.

The present inventors discover that, when plural inclusions such as elongated inclusions, spherical inclusions, or the like are formed into a group by being distributed with predetermined intervals in the rolling direction of the steel sheet which is the direction of crack propagation, the hole expansibility deteriorates in common with the inclusions which are elongated individually. This seems to be caused by inducing large stress concentrations in the vicinity of the groups, which is derived from the synergistic effect of the strains which are induced in the vicinity of each inclusion which composes the groups during the deformation of the steel sheet. Quantitatively, it was discovered that the hole expansibility deteriorates by the existence of the group of inclusions, in which a major axis of each of the inclusions is 3 μM or more and the inclusions are lined up so that an interval to other adjacent inclusions on a line in the rolling direction of the steel sheet is 50 μm or less, in common with the inclusion which exists independently and is elongated. Hereinafter, the group of the inclusions in which the respective major axes are 3 μm or more and the intervals in the rolling direction between the inclusions are 50 μm or less is referred to as an inclusion-cluster. In addition, in contrast with the inclusion-cluster, the inclusion which exists independently and in which the interval in the rolling direction between the inclusions is more than 50 μm is referred to as an independent-inclusion. The above-described major axis represents the longest diameter in the cross-sectional shape of the observed inclusion and usually corresponds to the diameter in the rolling direction.

As described above, in order to improve the hole expansibility of the steel sheet, it is important to control the shape and distribution of the inclusions as described below.

Figure 4A:
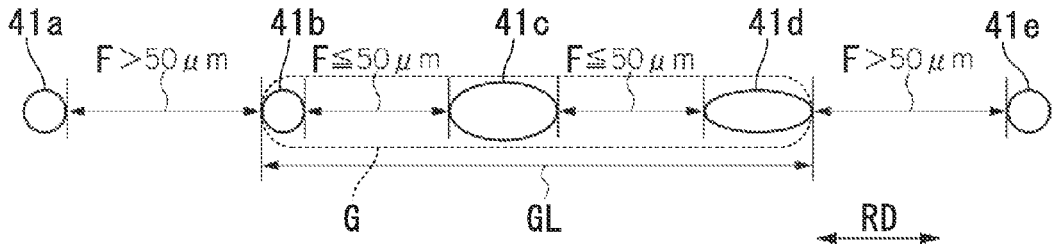
FIG. 4A is a schema of an inclusion-cluster which is a group of inclusions.

FIG. 4A is a schema of the inclusion-cluster which is the group of inclusions. In FIG. 4A, the inclusions in which the respective major axes are 3 μm or more are shown as 41*a* to 41*e*, the intervals between inclusions in the rolling direction are shown as F, the inclusion-cluster is shown as G, and the length of the inclusion-cluster in the rolling direction is shown as GL. As shown in FIG. 4A, the group of inclusions in which the interval F is 50 μm or less along the rolling direction RD of the steel sheet, specifically, one group which includes the inclusion 41*b*, the inclusion 41*c*, and the inclusion 41*d*, is regarded as the inclusion-cluster G. The length GL in the rolling direction of the inclusion-cluster G is measured. The inclusion-cluster G where the length GL is 30 μm or more has an influence on the hole expansibility of the steel sheet. The inclusion-cluster G where the length GL in the rolling direction is less than 30 μm has a small influence on the hole expansibility. In addition, inclusions in which the major axis is less than 3 μm are not included in the constituent of the inclusion-cluster G since the influence on the hole expansibility is small even if the interval F is 50 μm or less. In addition, in FIG. 4A, the inclusion 41*a* and the inclusion 41*e* are respectively regarded as the independent-inclusions.

Figure 4B:
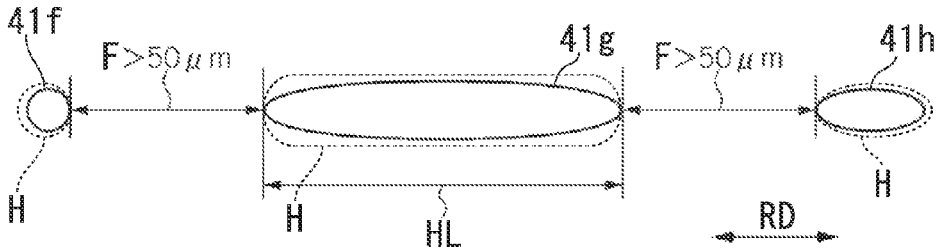
FIG. 4B is a schema of an independent-inclusion which exists independently.

FIG. 4B is a schema of the independent-inclusions. In FIG. 4B, inclusions in which the respective major axes are 3 μm or more are shown as 41*f* to 41*h*, the independent-inclusions are shown as H, and the length of the independent-inclusion in the rolling direction is shown as HL. As shown in FIG. 4B, the inclusions in which the interval F is more than 50 μm along the rolling direction RD of the steel sheet, specifically, the inclusion 41*f*, the inclusion 41*g*, and the inclusion 41*h*, are respectively regarded as the independent-inclusions H. The length HL in the rolling direction of the independent-inclusion H is measured. The independent-inclusion H where the length HL is 30 μm or more has an influence on the hole expansibility of the steel sheet. The independent-inclusion H where the length HL in the rolling direction is less than 30 μm has a small influence on the hole expansibility.

Figure 4C:
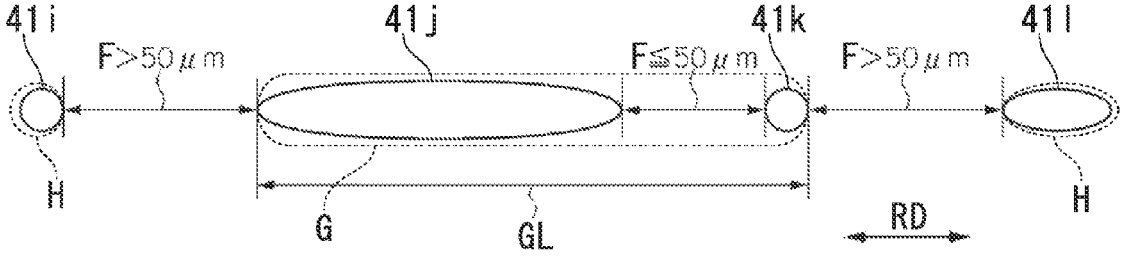
FIG. 4C is a schema of an inclusion-cluster which includes an inclusion whose length in a rolling direction is 30 μm or more.

FIG. 4C is a schema of the inclusion-cluster G which includes the inclusion where the length in the rolling direction is 30 μm or more. In FIG. 4C, inclusions in which the respective major axes are 3 μm or more are shown as 41*i* to 41*l*. In addition, in FIG. 4C, the inclusion 41*j* has a length (major axis) in the rolling direction of 30 μm or more. In FIG. 4C, one group which includes the inclusion 41*j* and the inclusion 41*k* and in which the interval F is 50 μm or less along the rolling direction RD of the steel sheet is regarded as the inclusion-cluster G, and the inclusions 41*i* and the inclusions 41*l* are respectively regarded as the independent-inclusions H. As described above, since the inclusion 41*k* where the interval F to the inclusion 41*j* is 50 μm or less exists even when the major axis of the inclusion 41*j* is 30 μm or more, the inclusion 41*j* is regarded as a part of the inclusion-cluster G. In addition, hereafter, the independent-inclusion H which is not included in the inclusion-cluster G and whose length HL in the rolling direction is 30 μm or more is referred to as elongated inclusion.

The length GL in the rolling direction of the inclusion-cluster G and the length HL in the rolling direction of the elongated inclusion (independent-inclusion H where the length HL in the rolling direction was 30 μm or more) were entirely measured in an observed visual field, and the total length I (unit: mm) of GL and HL was determined by conducting the measurements for plural visual fields. A total length M (unit: $mm/mm^2$) which was a converted value per 1 $mm^2$ of area was determined from the total length I based on the following Expression 5. The total length M has an influence on the hole expansibility of the steel sheet. Here, S is the total area (unit: $mm^2$) of the observed visual field.

$$M=I/S \quad \text{(Expression 5)}$$

The reason why the total length M which is the converted value per 1 $mm^2$ of area from the total length I should be determined, instead of the average of the total length I which is the length in the rolling direction of the above-described inclusions, is as follows.

When the number of the inclusion-clusters G and the elongated inclusions (the independent-inclusions H where the length HL in the rolling direction is 30 μm or more) in the metallographic structure of the steel sheet is small, the cracks propagate while voids which are formed at the periphery of the inclusions are interrupted during the deformation of the steel sheet. On the other hand, when the number of the above-described inclusions is large, voids at the periphery of the inclusions are formed into long continuous void by being connected without being interrupted, which may promote the ductile fracture. The influence of the number of the inclusions is not represented by the average of the total length I but may be represented by the total length M. Accordingly, from this point, the total length M per 1 $mm^2$ of area in the length GL in the rolling direction of the inclusion-cluster G and in the length HL in the rolling direction of the elongated inclusions was determined. As described above, the total length M has an influence on the hole expansibility of the steel sheet.

The total length M has an influence on the fracture properties of the steel sheet in addition to the hole expansibility of the steel sheet. During the deformation of the steel sheet, the stress is concentrated on the inclusion-clusters G and elongated inclusions (independent-inclusions H where the length HL in the rolling direction is 30 μm or more) and the initiation and propagation of cracks occur from the inclusions as a starting point. Therefore, in a case where the value of the total length M is large, the resistance of crack initiation Jc and the resistance of crack propagation T. M. decrease. In addition, the Charpy absorbed energy E, which is the energy required to fracture a test piece in a temperature range where ductile fracture occurs, is an index influenced by both of the resistance of crack initiation Jc and the resistance of crack propagation T. M. In a case where the value of the total length M is large, the Charpy absorbed energy E is also decreased similarly.

Furthermore, the total length M also has an influence on the fatigue properties of the steel sheet. It was found that the fatigue life tended to decrease with an increase in the value of the total length M. The reason for the above seems that the number of the inclusion-clusters G or the elongated inclusions, which act as the starting point of the fatigue fracture, increases with an increase in the value of the total length M, so that the fatigue life decreases as the result.

From the above point of view, the total length M in the rolling direction of the inclusions was measured, and therewith, the average λave of the hole expanding ratio, the resistance of crack initiation Jc, the resistance of crack propagation T. M., the Charpy absorbed energy E, the fatigue life, and the like were evaluated.

In addition to the total length M, as the investigation of the inclusions, measurement was conducted for the ratio of the major axis to the minor axis of the inclusion, which was represented by dividing the major axis of the inclusion by the minor axis of the inclusion. The respective ratios of the major axis to the minor axis were entirely measured for the inclusions in an observed visual field, and a maximum therein was determined. 30 times of the measurements were conducted with different visual fields. Then, an average of the respective maxima of the ratios of the major axis to the minor axis which were determined at each visual field was determined. Specifically, after the cross section (L cross section) where was at a portion of ¼ in the sheet width of the steel sheet and whose normal direction corresponded to the transverse direction was mirror-polished, the inclusions were observed using an electron microscope at 30 of arbitrary visual fields in the vicinity of the central portion of the sheet thickness in the L cross section so that one visual field was to be 0.0025 $mm^2$ (50 μm×50 μm), the maximum of the ratio of the major axis to the minor axis of the inclusions in each visual field was determined, and the average of the 30 visual fields was determined.

In a case where the shape of each of the inclusions is round and the average of the maximum of the ratio of the major axis to the minor axis is small even when the total length M in the rolling direction of the inclusions is the same values, the stress concentration in the vicinity of the inclusions during the deformation of the steel sheet decreases, and the average λave of the hole expanding ratio, the resistance of crack initiation Jc, and the Charpy absorbed energy E are preferably improved. Therefore, the ratio of the major axis to the minor axis of the inclusions is determined. In addition, since it was found from experiments that the average of the maximum of the ratio of the major axis to the minor axis of the inclusions and the standard deviation σ of the hole expanding ratio had a correlation, the average in regard to the ratio of the major axis to the minor axis was measured from the point of view of evaluating the standard deviation σ of the hole expanding ratio.

In addition to the chemical composition and metallographic structure of the steel sheet, the texture of the steel sheet was measured. The measurement of the texture was conducted using X-ray diffraction measurement. The X-ray diffraction measurement was conducted by a diffractometer method or the like using an appropriate X-ray tube. As a test piece for X-ray diffraction measurement, test pieces in which the length in the transverse direction was 20 mm and the length in the rolling direction were 20 mm was cut out from a portion of ½ in the sheet width of the steel sheet. After mechanically polishing the test pieces so that a position of ½ in the sheet thickness of the steel sheet was the measurement surface, strain was removed by electrolytic polishing or the like. The test piece for X-ray diffraction measurement and a reference standard which did not have the texture in a specific orientation were measured using the X-ray diffraction method or the like under the same conditions, a value where the X-ray intensity of the steel sheet was divided by the X-ray intensity of the reference standard was regarded as the X-ray random intensity ratio. Here, the X-ray random intensity ratio is synonymous with the pole density. In addition, instead of the X-ray diffraction measurement, the texture may be measured using the EBSD method or an ECP (Electron Channeling Pattern) method. In addition, as the texture of the steel sheet, the X-ray random intensity ratio of the {211} plane (which was synonymous with the pole density of the {211} plane or with the {211} plane intensity) was measured.

Next, description will be given of the limitation range and reasons for the limitation relating to the total length M and the average of the ratio of the major axis to the minor axis in order that the properties of the hot rolled steel sheet according to the embodiment satisfy that the average λave of the hole expanding ratio is 60% or more, the standard deviation σ of the hole expanding ratio is 15% or less, and the resistance of crack propagation T. M. is 600 MJ/m$^3$ or more.

Figure 5:
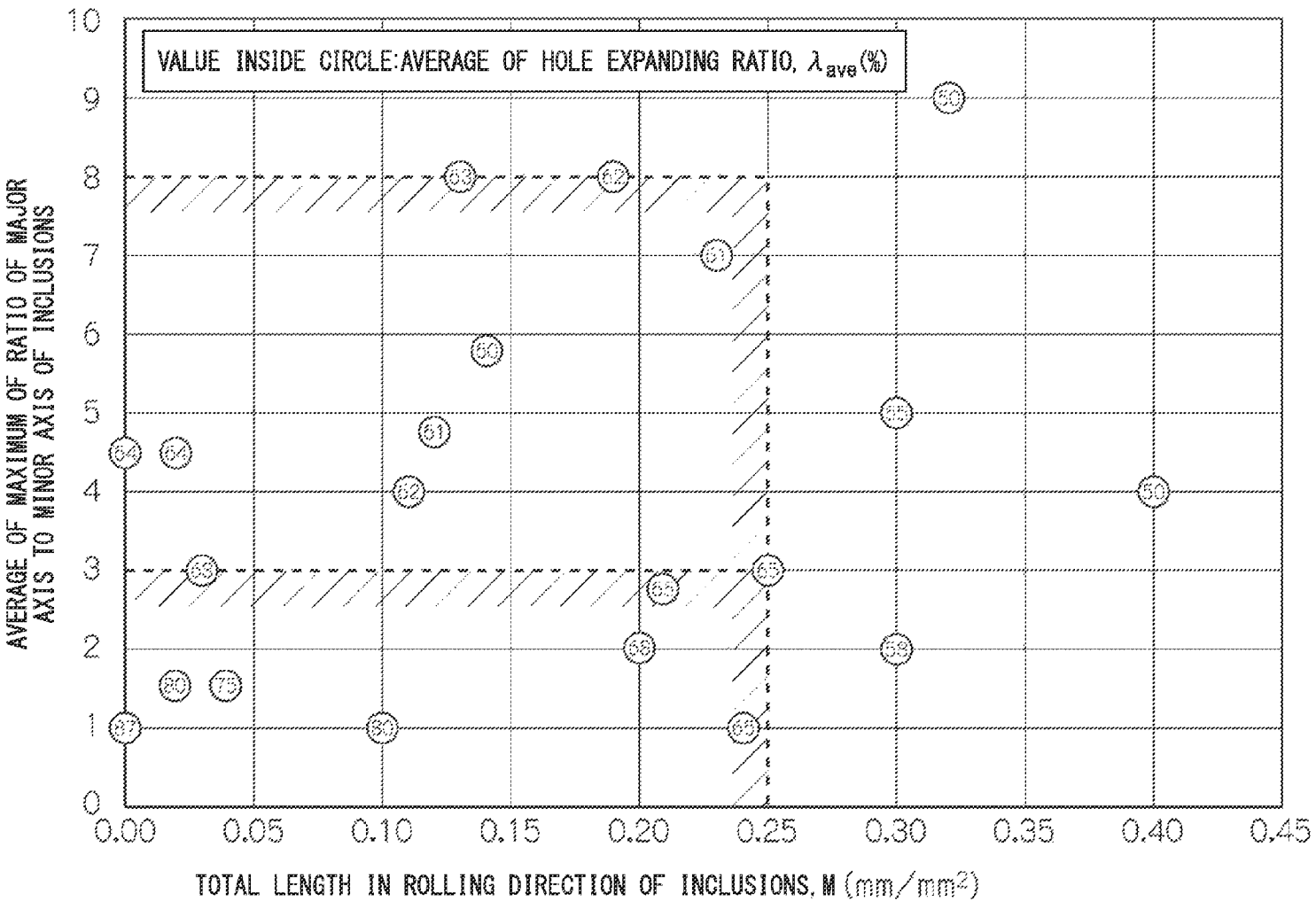
FIG. 5 is a diagram which shows a relationship between a total length M in the rolling direction of the inclusions, an average of a maximum of a ratio of a major axis to a minor axis of the inclusions, and an average λave of the hole expanding ratio.
Figure 6:
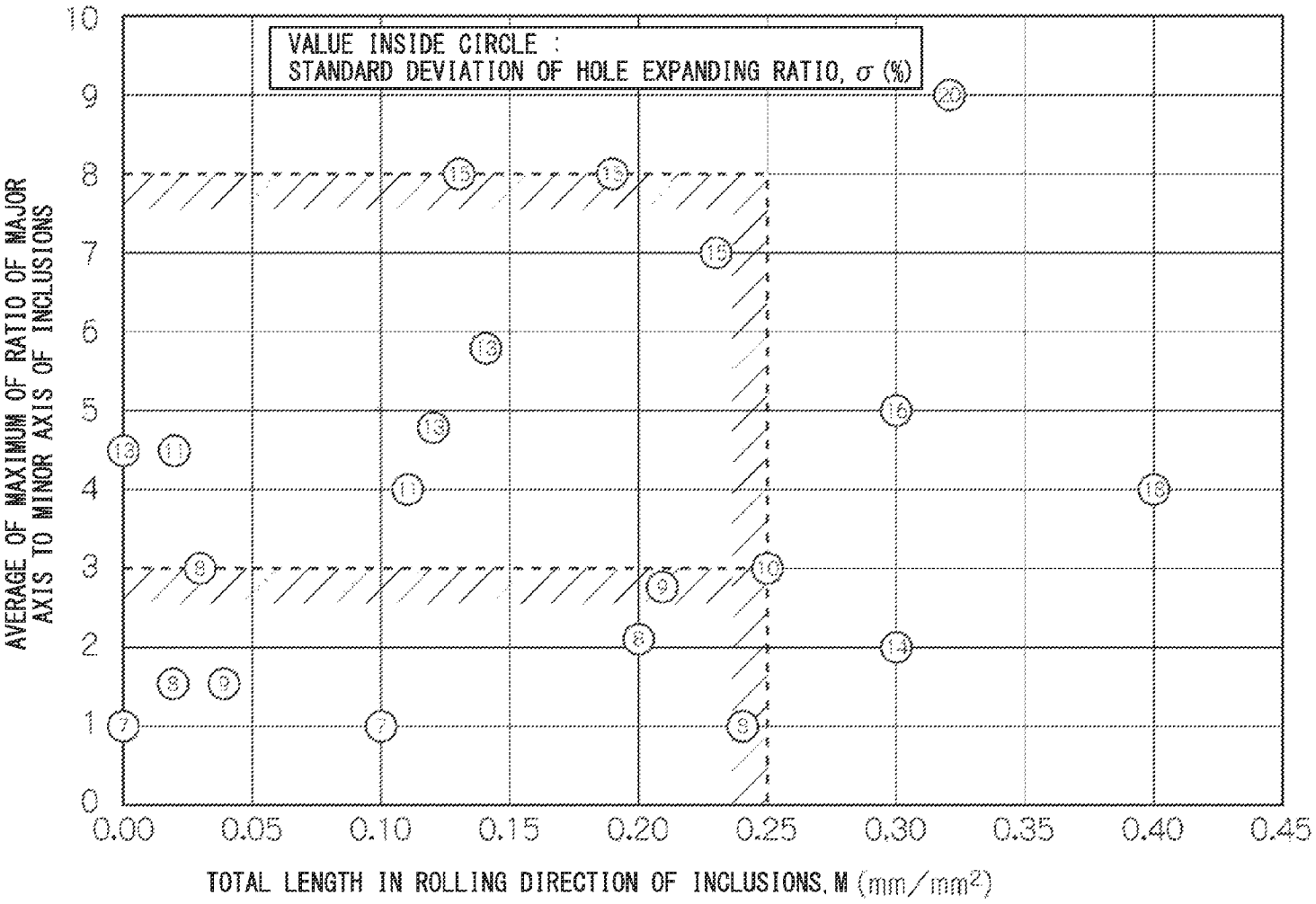
FIG. 6 is a diagram which shows a relationship between the total length M in the rolling direction of the inclusions, the average of the maximum of the ratio of the major axis to the minor axis of the inclusions, and a standard deviation σ of the hole expanding ratio.

FIG. 5 is a diagram which shows a relationship between the total length M in the rolling direction of the inclusions, the average of the maximum of the ratio of the major axis to the minor axis of the inclusions, and the average λave of the hole expanding ratio. FIG. 6 is a diagram which shows a relationship between the total length M in the rolling direction of the inclusions, the average of the maximum of the ratio of the major axis to the minor axis of the inclusions, and the standard deviation σ of the hole expanding ratio.

As shown in FIG. 5, the average λave of the hole expanding ratio of the steel sheet is improved with a decrease in the value of the total length M in the rolling direction of the inclusions and with a decrease in the average of the maximum of the ratio of the major axis to the minor axis. In addition, as shown in FIG. 6, the standard deviation a of the hole expanding ratio is improved with the decrease in the average of the maximum of the ratio of the major axis to the minor axis of the inclusions. Here, it is shown that each data which is plotted in FIG. 5 and FIG. 6 satisfies the configuration of the hot rolled steel sheet according to the embodiment with the exception of a configuration relating to the total length M in the rolling direction of the inclusions and the average of the maximum of the ratio of the major axis to the minor axis.

From FIG. 5 and FIG. 6, it is understood that the average λave of the hole expanding ratio can be controlled to 60% or more and the standard deviation σ can be controlled to 15% or less by controlling the total length M in the rolling direction of the inclusions to 0 mm/mm$^2$ to 0.25 mm/mm$^2$ and by controlling the average of the maximum of the ratio of the major axis to the minor axis to 1.0 to 8.0. The reason for the above seems that the stress concentration is relieved in the vicinity of the inclusions during the plastic deformation of the steel sheet by decreasing the value of the total length M and the average of the ratio of the major axis to the minor axis as described above. It is preferable that the total length M in the rolling direction of the inclusions is 0 mm/mm$^2$ to 0.20 mm/mm$^2$, and it is more preferable that the total length M in the rolling direction of the inclusions is 0 mm/mm$^2$ to 0.15 mm/mm$^2$. In addition, it is understood that the average λave of the hole expanding ratio can be controlled to 65% or more and the standard deviation σ can be controlled to 10% or less by preferably controlling the average of the maximum of the ratio of the major axis to the minor axis to 1.0 to 3.0. It is more preferable that the average of the maximum of the ratio of the major axis to the minor axis is 1.0 to 2.0.

Figure 7:
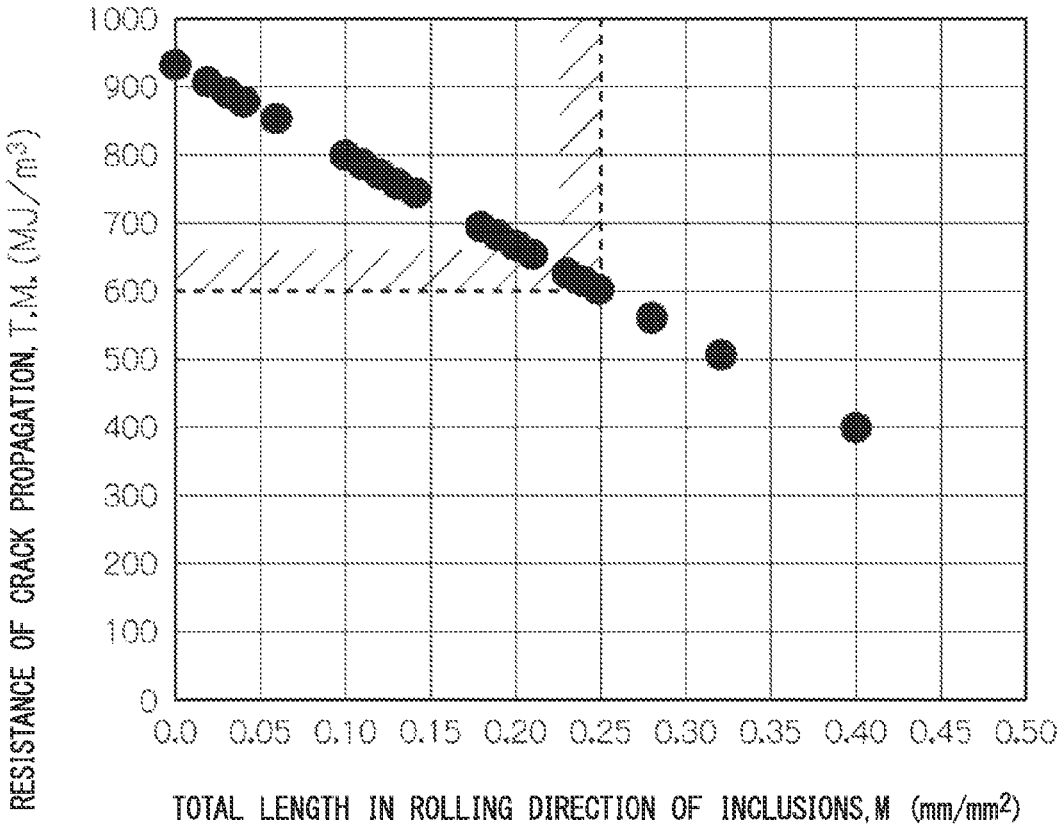
FIG. 7 is a diagram which shows a relationship between the total length M in the rolling direction of the inclusions and resistance of crack propagation T. M.

FIG. 7 is a diagram which shows a relationship between the total length M in the rolling direction of the inclusions and the resistance of crack propagation T. M. From the diagram, it is understood that, in a case where the total length M in the rolling direction of the inclusions is 0 mm/mm$^2$ to 0.25 mm/mm$^2$, in addition to the average λave and the standard deviation σ of the hole expanding ratio, the resistance of crack propagation T. M. of 600 MJ/m$^3$ or more is also satisfied. In general, in order to prevent the fracture of the steel sheet which composes the structural material, it is important to improve the resistance of crack propagation T. M. As mentioned above, the resistance of crack propagation T. M. tends to depend on the total length M in the rolling direction of the inclusions, and it is found that controlling the total length M to the range is important.

As described above, by controlling the total length M in the rolling direction of the inclusions and the average of the maximum of the ratio of the major axis to the minor axis of the inclusions, it is possible to satisfy the properties such as the average λave of the hole expanding ratio, the standard deviation σ of the hole expanding ratio, and the resistance of crack propagation T. M. In addition, as mentioned above, the total length M also improves the fatigue properties. Next, description will be given of a method which controls the total length M and the average of the ratio of the major axis to the minor axis to the ranges.

The present inventors found that the inclusion-cluster G and the elongated inclusion (independent-inclusion H where the length HL in the rolling direction was 30 μm or more), which caused the increase in the total length M in the rolling direction of the inclusions or the average of the maximum of the ratio of the major axis to the minor axis of the inclusions, were MnS precipitates which were elongated by the rolling or residues of desulfurizing agent which was added for desulfurization at steel making. In addition, it was found that, although the influence was not large as compared with the MnS precipitates or the residues of desulfurizing agent, CaS which precipitated without oxides and sulfides of REM (Rare Earth Metal) as a nucleus and precipitates of calcium aluminate or the like which was a mixture of CaO and alumina may also increase the total length M or the average of the ratio of the major axis to the minor axis. Since CaS and the precipitates of calcium aluminate or the like may become a shape which is elongated in the rolling direction by rolling, the hole expansibility of the steel sheet, the fracture properties, or the like may deteriorate. As a result of the investigation of the method which suppressed the inclusions in order to improve the properties such as the average λave of the hole expanding ratio, the standard deviation σ of the hole expanding ratio, and the resistance of crack propagation T. M., it was found that the following was important.

First, it is important to reduce the S content which bonds to Mn in order to suppress the MnS precipitates. From the point of view, in the hot rolled steel sheet according to the embodiment, in order to totally reduce the entire S content in the steel, the upper limit thereof is to be 0.01 mass %.

In addition, since TiS precipitates are formed at a higher temperature than the MnS formation temperature range when Ti is added, it is possible to reduce the amount of MnS precipitates. Similarly, since sulfides of REM or Ca are formed when REM or Ca are added, it is possible to reduce the amount of MnS precipitates. Therefore, the hot rolled steel sheet according to the embodiment contains at least one selected from the group consisting of, by mass %, Ti: 0.001% to 0.3%, REM: 0.0001% to 0.02%, and Ca: 0.0001% to 0.01%. Although it is possible to reduce the amount of MnS precipitates by selecting Ca, in order to suppress the precipitation of CaS, calcium aluminate, or the like, the upper limit of the Ca content is to be 0.01 mass %. The limitation range and reasons for the limitation of the chemical composition of the hot rolled steel sheet will be described later in detail.

Figure 8:
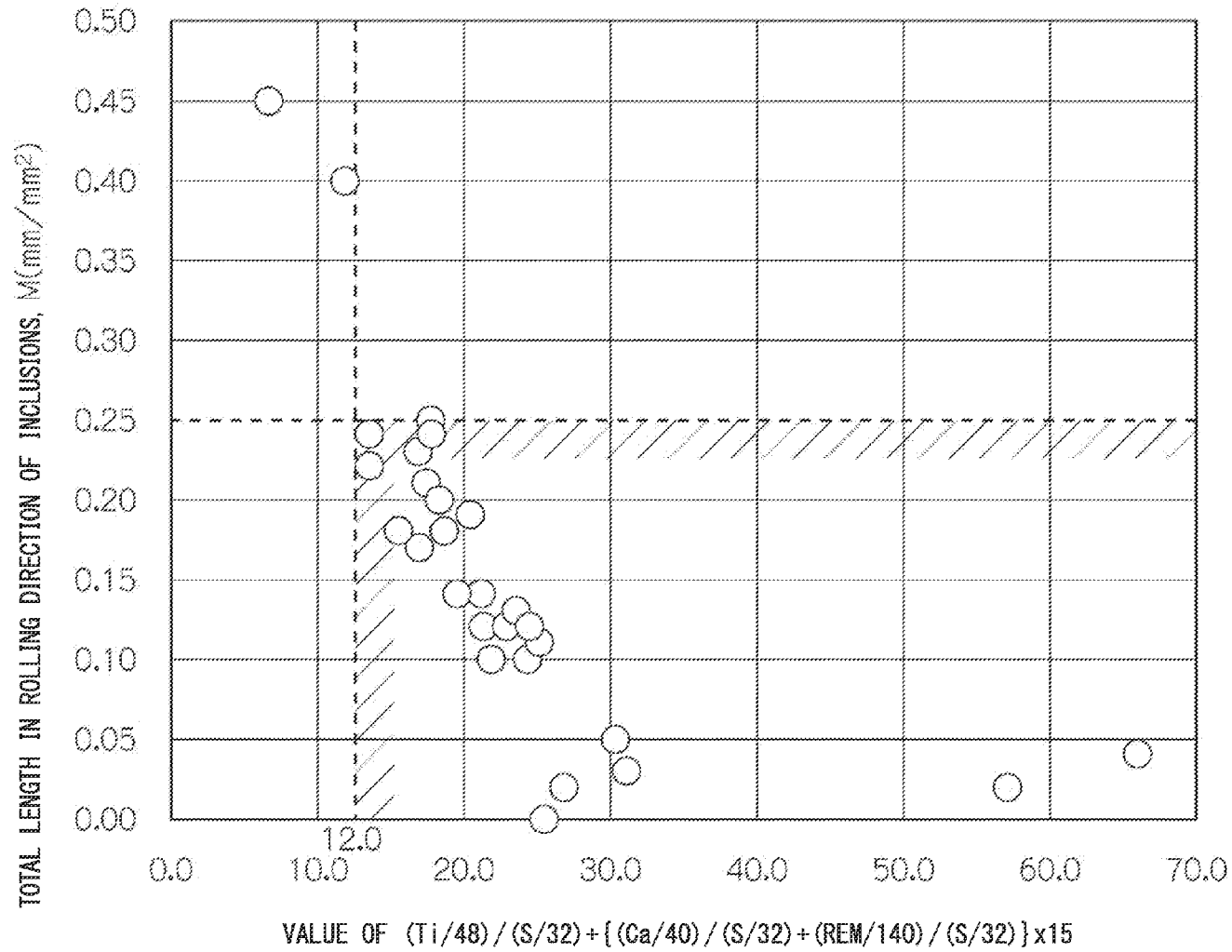
FIG. 8 is a diagram which shows a relationship between S content, Ti content, REM content, and Ca content and the total length M in the rolling direction of the inclusions.

Furthermore, in order to suppress the MnS precipitates, it is necessary to stoichiometrically include the larger amount of Ti, REM, or Ca than that of S. Therefore, the relationship between the S content, the Ti content, the REM content, and the Ca content and the total length M in the rolling direction of the inclusions was investigated. FIG. 8 is a diagram which shows a relationship between the S content, the Ti content, the REM content, and the Ca content and the total length M in the rolling direction of the inclusions. It was found that, when the value of (Ti/48)/(S/32)+{(Ca/40)/(S/32)+(REM/140)/(S/32)}×15 was 12.0 to 150, the total length M was 0 mm/mm$^2$ to 0.25 mm/mm$^2$. Specifically, in the hot rolled steel sheet according to the embodiment, it is necessary that the amounts expressed in mass % of each element in the chemical composition satisfy the following Expression 6. By satisfying the Expression 6, it is considered that the formation of elongated MnS precipitates is suppressed. In addition, although not shown in the diagram, it was found that, in a case where the following Expression 6 was satisfied, the average of the maximum of the ratio of the major axis to the minor axis of the inclusions was 1.0 to 8.0. Furthermore, it was found that, even in a case where all of Ti, REM, and Ca were simultaneously included in the steel, or in a case where at least one selected from Ti, REM, and Ca was included in the steel, the total length M was 0 mm/mm$^2$ to 0.25 mm/mm$^2$ and the average of the maximum of the ratio of the major axis to the minor axis of the inclusions was 1.0 to 8.0, when the following Expression 6 was satisfied.

$$12.0 \leq (Ti/48)/(S/32)+\{(Ca/40)/(S/32)+(REM/140)/(S/32)\}\times 15 \leq 150 \quad \text{(Expression 6)}$$

In order to control the total length M to 0 mm/mm$^2$ to 0.25 mm/mm$^2$ and to control the average of the ratio of the major axis to the minor axis to 1.0 to 8.0, in addition to satisfying the Expression 6, the cumulative reduction is to be 10% to 70% in a temperature range of higher than 1150° C. to 1400° C. in the first rough rolling process as described later. The method of producing the hot rolled steel sheet according to the embodiment will be described later in detail.

According to the above-described configuration, it is possible to control the total length M and the average of the ratio of the major axis to the minor axis. However, in order to further improve the properties of the steel sheet, it is preferable to reduce CaS which precipitates without oxides and sulfides of REM as the nucleus and to reduce the precipitates of calcium aluminate or the like. In order to reduce the precipitates, the amounts expressed in mass % of each element in the chemical composition may satisfy the following Expression 7. It was found that, when the following Expression 7 was satisfied, the average of the maximum of the ratio of the major axis to the minor axis of the inclusions was preferably 1.0 to 3.0. Moreover, in a case where Ti or REM is added to steel, since the Ca content may be as small as possible, it is not necessary to determine an upper limit of the following Expression 7.

$$0.3 \leq (REM/140)/(Ca/40) \quad \text{(Expression 7)}$$

In a case where REM is sufficiently added as compared with Ca so as to satisfy the Expression 7, CaS or the like crystallizes or precipitates while spherical REM oxides or REM sulfides act as the nuclei. On the other hand, since the REM oxides or the REM sulfides which act as the nuclei are reduced when the ratio of REM to Ca is reduced and the Expression 7 is not satisfied, CaS or the like in which the REM oxides or the REM sulfides do not act as the nuclei precipitates excessively. The inclusions may have a shape which is elongated in the rolling direction due to the rolling. As described above, when the Expression 7 is satisfied, the ratio of the major axis to the minor axis of the inclusions is preferably controlled.

In order to control the average of the maximum of the ratio of the major axis to the minor axis of the inclusions to 1.0 to 3.0, in addition to satisfying the Expression 7, it is preferable that the cumulative reduction is 10% to 65% in a temperature range of higher than 1150° C. to 1400° C. in the first rough rolling process as described later. The method of producing the hot rolled steel sheet according to the embodiment will be described later in detail.

Subsequently, description will be given of the base elements of the hot rolled steel sheet according to the embodiment and of the limitation range and reasons for the limitation. Hereinafter, the % in the description represents mass %.

C: 0.03% to 0.1%

C (carbon) is an element which contributes to an improvement in the tensile strength TS. When the C content is insufficient, the fracture appearance transition temperature vTrs may increase due to the coarsening of the metallographic structure. In addition, when the C content is insufficient, it may be difficult to obtain the intended area fraction of martensite and residual austenite. On the other hand, when the C content is excessive, the average λave of the hole expanding ratio, the resistance of crack initiation Jc, and the Charpy absorbed energy E may decrease. For this reason, the C content is to be 0.03% to 0.1%. Preferably, the C content may be 0.04% to 0.08%. More preferably, the C content may be 0.04% to 0.07%.

Mn: 0.5% to 3.0%

Mn (manganese) is an element contributing to an improvement in the tensile strength TS of the steel sheet as an element of solid solution strengthening. In order to obtain the intended tensile strength TS, the Mn content is to be 0.5% or more. However, when the Mn content is more than 3.0%, cracking during the hot rolling occurs readily. For this reason, the Mn content is to be 0.5% to 3.0%. In addition, when the Mn content is more than 3.0%, ferrite transformation is suppressed and the area fraction of the martensite and the residual austenite may increase. To preferably control the area fraction of the ferrite which is the primary phase and the martensite and the residual austenite which are the secondary phase, the Mn content may be 0.8% to 2.0%. More preferably, the Mn content may be 1.0% to 1.5%.

$$0.5\% \leq Si+Al \leq 4.0\%$$

In order to obtain the intended tensile strength TS and the intended area fraction of the ferrite, at least one selected from the group consisting of Si (silicon) and Al (aluminum) is contained. In order to obtain the effect, at least one of Si and Al is contained and the amount of Si+Al is to be 0.5% or more. However, when at least one of Si and Al is contained and the amount of Si+Al is more than 4.0%, the average λave of the hole expanding ratio may decrease. Preferably, the content may be 1.5% to 3.0%. Even more preferably, the content may be 1.8% to 2.6%.

Si: 0.5% to 2.0%

Si (silicon) is an element that contributes to the improvement of the tensile strength TS of the steel and to the promotion of the ferrite transformation. In order to obtain the intended tensile strength and the intended area fraction of the ferrite, it is preferable that the Si content is 0.5% or more. However, when the Si content is more than 2.0%, the strength may excessively increase and the average λave of the hole expanding ratio may decrease. For this reason, preferably, the Si content may be 0.5% to 2.0%.

Al: 0.005% to 2.0%

Al (aluminum) is an element which deoxidizes molten steel, and an element which contributes to an improvement in the tensile strength TS. In order to sufficiently obtain the effect, it is preferable that the Al content is 0.005% or more. However, when the Al content is more than 2.0%, the strength may excessively increase and the average λave of the hole expanding ratio may decrease. For this reason, preferably, the Al content may be 0.005% to 2.0%.

The hot rolled steel sheet according to the embodiment further contains at least one selected from the group consisting of Ti, REM, and Ca in the following content.

Ti: 0.001% to 0.3%

Ti (titanium) is an element contributing to an improvement of the tensile strength TS of the steel sheet by finely precipitating as TiC. In addition, Ti is an element which suppresses the precipitation of MnS which is elongated during rolling by precipitating as TiS. Therefore, the total length M in the rolling direction of the inclusions and the average of the maximum of the ratio of the major axis to the minor axis of the inclusions may decrease. In order to obtain the effect, the Ti content is to be 0.001% or more. However, when the Ti content is more than 0.3%, the strength may excessively increase, and the average λave of the hole expanding ratio, the resistance of crack initiation Jc, and the Charpy absorbed energy E may decrease. For this reason, the Ti content is to be 0.001% to 0.3%. Preferably, the Ti content may be 0.01% to 0.3%. More preferably, the Ti content may be 0.05% to 0.18%. Most preferably, the Ti content may be 0.08% to 0.15%.

REM: 0.0001% to 0.02%

REM (Rare Earth Metal) is element which suppresses the formation of MnS by bonding to S in the steel. In addition, REM is element which decreases the average of the maximum of the ratio of the major axis to the minor axis of the inclusions and the total length M in the rolling direction by spheroidizing the shape of the sulfides such as MnS. When the REM content is less than 0.0001%, the effect of suppressing the formation of MnS and the effect of spheroidizing the shape of the sulfides such as MnS may not be sufficiently obtained. In addition, when the REM content is more than 0.02%, the inclusions which include the REM oxides may excessively form, and the average λave of the hole expanding ratio, the resistance of crack initiation Jc, and the Charpy absorbed energy E may decrease. For this reason, the REM content is to be 0.0001% to 0.02%. Preferably, the REM content may be 0.0005% to 0.005%. More preferably, the REM content may be 0.001% to 0.004%.

Here, REM represents a generic name for a total of 17 elements, specifically 15 elements from lanthanum with atomic number 57 to lutetium with atomic number 71, scandium with atomic number 21, and yttrium with atomic number 39. In general, REM is supplied in the state of misch metal which is a mixture of the elements, and is added to the steel.

Ca: 0.0001% to 0.01%

Ca (calcium) is an element which suppresses the formation of MnS by bonding to S in the steel. In addition, Ca is an element which decreases the average of the maximum of the ratio of the major axis to the minor axis of the inclusions and the total length M in the rolling direction by spheroidizing the shape of the sulfides such as MnS. When the Ca content is less than 0.0001%, the effect of suppressing the formation of MnS and the effect of spheroidizing the shape of the sulfides such as MnS may not be sufficiently obtained. In addition, when the Ca content is more than 0.01%, CaS and the calcium aluminate which tend to be inclusions with an elongated shape may excessively form, and the total length M and the average of the ratio of the major axis to the minor axis may increase. For this reason, the Ca content is to be 0.0001% to 0.01%. Preferably, the Ca content may be 0.0001% to 0.005%. More preferably, the Ca content may be 0.001% to 0.003%. Furthermore preferably, the Ca content may be 0.0015% to 0.0025%.

In the hot rolled steel sheet according to the embodiment, at least one of Ti, REM, and Ca is included as described above, and simultaneously, the amounts expressed in mass % of each element in the chemical composition satisfy the following Expression 8. Here, detailed description will be given of the impurity S. By satisfying the following Expression 8, the amount of MnS precipitates in the steel decreases, and it is possible to obtain an effect of decreasing the average of the maximum of the ratio of the major axis to the minor axis of the inclusions and the total length M in the rolling direction of the inclusions. Thereby, the total length M in the rolling direction of the inclusions is controlled to 0 $mm/mm^2$ to 0.25 $mm/mm^2$ and the average of the maximum of the ratio of the major axis to the minor axis of the inclusions is controlled to 1.0 to 8.0. As a result, it is possible to obtain an effect of improving the average λave of the hole expanding ratio of the steel sheets, the standard deviation σ, the resistance of crack initiation Jc, the resistance of crack propagation T. M., the Charpy absorbed energy E, and the fatigue life. When the value of the following Expression 8 is less than 12.0, the above effects may not be obtained. Preferably, the above value may be 30.0 or more. In addition, since it is preferable that the amount of S which is the impurity decreases, it is not necessary to determine an upper limit of the following Expression 8. However, in a case where the following Expression 8 is 150 or less, the above effect may preferably obtained.

$$12.0 \leq (Ti/48)/(S/32)+\{(Ca/40)/(S/32)+(REM/140)/(S/32)\}\times 15 \leq 150 \quad \text{(Expression 8)}$$

When the large amount of Ti is included within the above range, the tensile strength TS of the steel sheet is improved. For example, when the Ti content is 0.08% to 0.3%, it is possible to control the tensile strength TS of the steel sheet to 780 MPa to 980 MPa, and simultaneously, to control the fatigue life in plane bending to 500000 times or more. The reason for the above is derived from the precipitation strengthening of TiC. On the other hand, when Ti is not added, or when the small amount of Ti is included within the above range, the formability and the fracture properties of the steel sheet are improved. For example, when Ti is not added, or when the Ti content is 0.001% to less than 0.08%, although the tensile strength TS of the steel sheet is 590 MPa to less than 780 MPa, it is possible to control the average λave of the hole expanding ratio to 90% or more, the resistance of crack initiation Jc to 0.9 $MJ/m^2$ or more, and the Charpy absorbed energy E to 35 J or more. The reason for the above is derived from the decrease in the amount of TiC precipitates. As described above, depending on the purpose of the steel sheet, it is preferable to control the Ti content. When Ti is not added, in order to control the total length M and the average of the ratio of the major axis to the minor axis, it is preferable that at least one of REM and Ca is contained. In addition, when the small amount of Ti is included within the above range, in order to control the total length M and t average of the ratio of the major axis to the minor axis, it is preferable that at least one of REM and Ca is contained. Specifically, when at least one of 0.0001% to 0.02% of REM and 0.0001% to 0.01% of Ca is contained, it is preferable that the Ti content is 0.001% to less than 0.08%. When at least one of 0.0001% to 0.02% of REM and 0.0001% to 0.005% of Ca is contained, it is more preferable that the Ti content is 0.01% to less than 0.08%.

In addition, from the point of view of suppressing the average of the maximum of the ratio of the major axis to the minor axis of the inclusions, it is preferable that the amount of Ca and REM satisfies the following Expression 9. When the following Expression 9 is satisfied, the average of the maximum of the ratio of the major axis to the minor axis of the inclusions is preferably controlled to 1.0 to 3.0. Specifically, it is preferable that the amounts expressed in mass % of each element in the chemical composition satisfy the following Expression 9 and the average of the maximum of the ratio of the major axis to the minor axis of the inclusions is 1.0 to 3.0. More preferably, the above value may be 1.0 to 2.0. As a result, it is possible to obtain further excellent effects for the average λave of the hole expanding ratio, the standard deviation σ of the hole expanding ratio, the resistance of crack initiation Jc, the Charpy absorbed energy E, and the like. The reason for the above is derived from the fact that, in a case where REM is sufficiently added as compared with Ca so as to satisfy the following Expression 9, CaS or the like crystallizes or precipitates while spherical REM oxides or REM sulfides act as the nuclei.

$$0.3 \leq (REM/140)/(Ca/40) \quad \text{(Expression 9)}$$

The hot rolled steel sheet according to the embodiment contains unavoidable impurities in addition to the base elements described above. Herein, the unavoidable impurities indicate elements such as P, S, N, O, Pb, Cd, Zn, As, Sb, and the like which contaminate unavoidably from auxiliary materials such as scrap and the like and from producing processes. In the elements, P, S, and N are limited to the following in order to obtain satisfactory the effects. In addition, it is preferable that the unavoidable impurities with the exception of P, S, and N are respectively limited to 0.02% or less. Even when 0.02% or less of each impurity is included, the above effects are not affected. Although the limitation range of the impurities includes 0%, it is industrially difficult to be stably 0%. Hereinafter, the % in the description represents mass %.

P: 0.1% or Less

P (phosphorus) is an impurity which is unavoidably contaminated. When the P content is more than 0.1%, the amount of P segregation at the grain boundaries increases, which leads to a deterioration in the average λave of the hole expanding ratio, the resistance of crack initiation Jc, and the Charpy absorbed energy E. For this reason, the P content is limited to 0.1% or less. Since it is preferable that the P content is as small as possible, the limitation range includes 0%. However, it is not technically easy to control the P content to 0%, and also the production cost of the steel increases in order to be stably less than 0.0001%. Therefore, preferably, the limitation range of the P content may be 0.0001% to 0.1%. More preferably, the limitation range may be 0.001% to 0.03%.

S: 0.01% or Less

S (sulfur) is an impurity which is unavoidably contaminated. When the S content is more than 0.01%, the large amount of MnS is formed in the steel during the heating of the steel piece and MnS is elongated by hot rolling. Therefore, the total length M in the rolling direction of the inclusions and the average of the maximum of the ratio of the major axis to the minor axis of the inclusions may increase, and it is not possible to obtain the intended properties such as the average λave of the hole expanding ratio, the standard deviation σ, the resistance of crack initiation Jc, the resistance of crack propagation T. M., the Charpy absorbed energy E, and the fatigue life. For this reason, the S content is limited to 0.01% or less. Since it is preferable that the S content is as small as possible, the limitation range includes 0%. However, it is not technically easy to control the S content to 0%, and also the production cost of the steel increases in order to be stably less than 0.0001%. Therefore, preferably, the limitation range of the S content may be 0.0001% to 0.01%. In addition, in a case where desulfurization using a desulfurizing agent is not conducted during the secondary refining, it may be difficult to control the S content to less than 0.003%. In this case, preferably, the S content may be 0.003% to 0.01%.

N: 0.02% Or Less

N (nitrogen) is an impurity which is unavoidably contaminated. When the N content is more than 0.02%, N forms precipitates with Ti and Nb, and the amount of TiC precipitates is reduced. As a result, the tensile strength TS of the steel sheet decreases. For this reason, the N content is limited to 0.02% or less. Since it is preferable that the N content is as small as possible, the limitation range includes 0%. However, it is not technically easy to control the N content to 0%, and also the production cost of the steel increases in order to be stably less than 0.0001%. Therefore, preferably, the limitation range of the N content may be 0.0001% to 0.02%. In addition, in order to more effectively suppress a decrease in the tensile strength TS, it is preferable that the N content is 0.005% or less.

The hot rolled steel sheet according to the embodiment may further contain at least one selected from the group consisting of Nb, B, Cu, Cr, Mo, Ni, and V as optional elements, in addition to the above mentioned base elements and impurities. Hereinafter, limitation range and reasons for the limitation of the optional elements will be described. In addition, the % in the description represents mass %.

Nb: 0.001% to 0.1%

Nb (niobium) is an element contributing to the improvement of the tensile strength TS of the steel by refining the grains. In order to obtain the effect, it is preferable that the Nb content is 0.001% or more. However, when the Nb content is more than 0.1%, the temperature range where dynamic recrystallization occurs during hot rolling may be narrowed. Therefore, a rolling texture which is in non-recrystallized state and which leads to increase the X-ray random intensity ratio of the {211} plane remains excessively after the hot rolling. Detailed description will be given of the texture. When the X-ray random intensity ratio of the {211} plane is excessively increased as the texture, the average λave of the hole expanding ratio, the resistance of crack initiation Jc, and the Charpy absorbed energy E may deteriorate. For this reason, preferably, the Nb content may be 0.001% to 0.1%. More preferably, the Nb content may be 0.002% to 0.07%. Most preferably, the Nb content may be 0.002% to less than 0.02%. In addition, as long as the Nb content is 0% to 0.1%, each of the characteristic values of the hot rolled steel sheet is not negatively influenced.

B: 0.0001% to 0.0040%

B (boron) is an element contributing to the improvement of the tensile strength TS of the steel by refining the grains. In order to obtain the effect, it is preferable that the B content is 0.0001% or more. However, when the B content is more than 0.0040%, the temperature range where dynamic recrystallization occurs during hot rolling may be narrowed. Therefore, a rolling texture which is in non-recrystallized state and which leads to increase the X-ray random intensity ratio of the {211} plane remains excessively after the hot rolling. When the X-ray random intensity ratio of the {211} plane is excessively increased as the texture, the average λave of the hole expanding ratio, the resistance of crack initiation Jc, and the Charpy absorbed energy E may deteriorate. For this reason, preferably, the B content may be 0.0001% to 0.0040%. More preferably, the B content may be 0.0001% to 0.0020%. Most preferably, the B content may be 0.0005% to 0.0015%. In addition, as long as the B content is 0% to 0.0040%, each of the characteristic values of the hot rolled steel sheet is not negatively influenced.

Cu: 0.001% to 1.0%

Cu is an element which has an effect of improving the tensile strength TS of the hot rolled steel sheet by precipitation strengthening or solid solution strengthening. However, when the Cu content is less than 0.001%, the effect is not obtained. On the other hand, when the Cu content is more than 1.0%, the strength may excessively increase, and the average λave of the hole expanding ratio may decrease. For this reason, preferably, the Cu content may be 0.001% to 1.0%. More preferably, the Cu content may be 0.2% to 0.5%. In addition, as long as the Cu content is 0% to 1.0%, each of the characteristic values of the hot rolled steel sheet is not negatively influenced.

Cr: 0.001% to 1.0%

Similarly, Cr is an element which has an effect of improving the tensile strength TS of the hot rolled steel sheet by precipitation strengthening or solid solution strengthening. However, when the Cr content is less than 0.001%, the effect is not obtained. On the other hand, when the Cr content is more than 1.0%, the strength may excessively increase, and the average λave of the hole expanding ratio may decrease. For this reason, preferably, the Cr content may be 0.001% to 1.0%. More preferably, the Cr content may be 0.2% to 0.5%. In addition, as long as the Cr content is 0% to 1.0%, each of the characteristic values of the hot rolled steel sheet is not negatively influenced.

Mo: 0.001% to 1.0%

Similarly, Mo is an element which has an effect of improving the tensile strength TS of the hot rolled steel sheet by precipitation strengthening or solid solution strengthening. However, when the Mo content is less than 0.001%, the effect is not obtained. On the other hand, when the Mo content is more than 1.0%, the strength may excessively increase, and the average λave of the hole expanding ratio may decrease. For this reason, preferably, the Mo content may be 0.001% to 1.0%. More preferably, the Mo content may be 0.001% to 0.03%. Furthermore preferably, the Mo content may be 0.02% to 0.2%. In addition, as long as the Mo content is 0% to 1.0%, each of the characteristic values of the hot rolled steel sheet is not negatively influenced.

Ni: 0.001% to 1.0%

Similarly, Ni is an element which has an effect of improving the tensile strength TS of the hot rolled steel sheet by precipitation strengthening or solid solution strengthening. However, when the Ni content is less than 0.001%, the effect is not obtained. On the other hand, when the Ni content is more than 1.0%, the strength may excessively increase, and the average λave of the hole expanding ratio may decrease. For this reason, preferably, the Ni content may be 0.001% to 1.0%. More preferably, the Ni content may be 0.05% to 0.2%. In addition, as long as the Ni content is 0% to 1.0%, each of the characteristic values of the hot rolled steel sheet is not negatively influenced.

V: 0.001% to 0.2%

Similarly, V is an element which has an effect of improving the tensile strength TS of the hot rolled steel sheet by precipitation strengthening or solid solution strengthening. However, when the V content is less than 0.001%, the effect is not obtained. On the other hand, when the V content is more than 0.2%, the strength may excessively increase, and the average λave of the hole expanding ratio may decrease. For this reason, preferably, the V content may be 0.001% to 0.2%. More preferably, the V content may be 0.005% to 0.2%. Furthermore preferably, the V content may be 0.01% to 0.2%. Most preferably, the V content may be 0.01% to 0.15%. In addition, as long as the V content is 0% to 0.2%, each of the characteristic values of the hot rolled steel sheet is not negatively influenced.

In addition, the hot rolled steel sheet according to the embodiment may contain 0% to 1% in total of Zr, Sn, Co, W, and Mg as necessary.

Next, description will be given of the metallographic structure and the texture of the hot rolled steel sheet according to the embodiment.

The metallographic structure of the hot rolled steel sheet according to the embodiment includes a ferrite as a primary phase, at least one of a martensite and a residual austenite as a secondary phase, and plural inclusions. By forming the mixed structure, it is possible to achieve both the high tensile strength TS and elongation (n value). The reason for the above seems that the ductility is ensured by the ferrite which is the primary phase and comparatively soft and that the tensile strength TS is ensured by the secondary phase which is hard. In addition, by forming the mixed structure, the preferable fatigue properties are obtained. The reason for the above seems that the propagation of the fatigue cracks is suppressed by the martensite and the residual austenite which are the secondary phase and are comparatively hard. In order to obtain the effect, in the metallographic structure of the hot rolled steel sheet according to the embodiment, the area fraction of the primary phase is to be 90% to 99%, and the area fraction of the martensite and the residual austenite which are the secondary phase is to be 1% to 10% in total. When the area fraction of the primary phase is less than 90%, since the metallographic structure is not controlled to the intended mixed structure, it is not possible to obtain the above effect. On the other hand, it is technically difficult to control the area fraction of the primary phase to more than 99%. In addition, when the area fraction of the secondary phase is more than 10% in total, the ductile fracture is promoted, and the average λave of the hole expansion value, the resistance of crack initiation Jc, and the Charpy absorbed energy E deteriorate. On the other hand, when the area fraction of the secondary phase is less than 1% in total, since the metallographic structure is not controlled to the intended mixed structure, it is not possible to obtain the above effect. Preferably, the area fraction of the primary phase may be 95% to 99%, and the area fraction of the martensite and the residual austenite which are the secondary phase may be 1% to 5% in total.

In addition, in the metallographic structure, in addition to the ferrite which is the primary phase, the martensite and the residual austenite which are the secondary phase, and the plural inclusions, a small amount of bainite, pearlite, cementite, or the like may be included. In the metallographic structure, preferably, the area fraction of the bainite and the pearlite may be 0% to less than 5.0% in total. As a result, it is preferable that the metallographic structure is controlled to the intended mixed structure and the above effect is obtained.

The average grain size of the ferrite which is the primary phase is to be 2 μm to 10 μm. When the average grain size of the ferrite which is the primary phase is 10 μm or less, it is possible to obtain the intended fracture appearance transition temperature vTrs. In addition, in order to control the average grain size of the ferrite which is the primary phase to less than 2 μm, it is necessary to select strict producing conditions, and the load on the producing facility is large. For this reason, the average grain size of the ferrite which is the primary phase is to be 2 μm to 10 μm. Preferably, the average grain size may be 2 μm to 7 μm. Furthermore preferably, the average grain size may be 2 μm to 6 μm.

It is preferable that the average grain size of the martensite and the residual austenite which are the secondary phase is 0.5 μm to 8.0 μm. When the average grain size of the secondary phase is more than 8.0 μm, the stress concentration which is induced in the vicinity of the secondary phase may increase, and the properties such as the average λave of the hole expanding ratio may decrease. In addition, in order to control the average grain size of the secondary phase to less than 0.5 μm, it is necessary to select strict producing conditions, and the load on the producing facility is large. For this reason, the average grain size of the secondary phase may be 0.5 μm to 8.0 μm.

In regard to the inclusions which are included in the metallographic structure, when the L cross section whose normal direction corresponds to the transverse direction of the steel sheet is observed at 30 of visual fields by 0.0025 $mm^2$, the average of the maximum of the ratio of the major axis to the minor axis of the inclusions in each of the visual fields is to be 1.0 to 8.0. When the above average of the ratio of the major axis to the minor axis is more than 8.0, the stress concentration in the vicinity of the inclusions during the deformation of the steel sheet increases, and it is not possible to obtain the intended properties of the average λave of the hole expanding ratio, the standard deviation σ, the resistance of crack initiation Jc, and the Charpy absorbed energy E. On the other hand, although the lower limit of the above average of the ratio of the major axis to the minor axis is not particularly limited, it is technically difficult to control the above value to less than 1.0. For this reason, the above average of the ratio of the major axis to the minor axis is to be 1.0 to 8.0. In addition, preferably, the above average of the ratio of the major axis to the minor axis may be 1.0 to 3.0. When the above average of the ratio of the major axis to the minor axis is 1.0 to 3.0, it is possible to obtain the preferable effect for the average λave of the hole expanding ratio, the standard deviation a of the hole expanding ratio, the resistance of crack initiation Jc, and the Charpy absorbed energy E.

In addition, in regard to the inclusions which are included in the metallographic structure, when a group of the inclusions in which a major axis of each of the inclusions is 3 μm or more and the interval F in the rolling direction between the inclusions is 50 μm or less are defined as the inclusion-cluster G, and when an inclusion in which the interval F is more than 50 μm are defined as the independent-inclusion H, the total length M in the rolling direction of both the inclusion-cluster G whose length in the rolling direction GL is 30 μm or more and the independent-inclusion H whose length in the rolling direction HL is 30 μm or more is to be 0 mm to 0.25 mm per 1 $mm^2$ of the L cross section whose normal direction corresponds to the transverse direction of the steel sheet. When the inclusions satisfy the above condition, it is possible to obtain the preferable effect for the average λave of the hole expanding ratio, the standard deviation σ of the hole expanding ratio, the resistance of crack initiation Jc, the resistance of crack propagation T. M., the Charpy absorbed energy E, and the fatigue properties. In addition, the total length M may be zero. Preferably, the total length M may be 0 mm to 0.15 mm per 1 $mm^2$ of the L cross section whose normal direction corresponds to the transverse direction of the steel sheet.

In addition, in regard to the inclusions which are included in the metallographic structure, it is preferable that a total number of MnS precipitates and CaS precipitates having the major axis of 3 μm or more is 0% to less than 70% as compared with the total number of the inclusions having the major axis of 3 μm or more. When the total number of MnS precipitates and CaS precipitates which are included in the inclusions is 0% to less than 70%, it is possible to preferably control the total length M and the average of the ratio of the major axis to the minor axis. In addition, since the inclusions having the major axis is less than 3 μm have a small influence on the properties such as the average λave of the hole expanding ratio and the like, it is not necessary to take account of the inclusions.

In addition, the inclusions as described above mainly indicate the sulfides such as MnS and CaS, the oxides such as $CaO—Al_2O_3$ compound (calcium aluminate), the residues of the desulfurizing agent such as $CaF_2$, and or the like in the steel.

In regard to the texture of the hot rolled steel sheet according to the embodiment, the X-ray random intensity ratio of the {211} plane ({211} plane intensity) is to be 1.0 to 2.4. When the {211} plane intensity is more than 2.4, the anisotropy of the steel sheet is excessive. Thus, at hole expanding, the reduction of sheet thickness increases at the end surface in the rolling direction which is subjected to tensile strain in the transverse direction, high stress is induced in the end surface, and the cracks tend to initiate and propagate. As a result, the average λave of the hole expanding ratio deteriorates. In addition, when the {211} plane intensity is more than 2.4, the resistance of crack initiation Jc and the Charpy absorbed energy E also deteriorate. On the other hand, it is technically difficult to control the {211} plane intensity to less than 1.0. For this reason, the {211} plane intensity is to be 1.0 to 2.4. Preferably, the {211} plane intensity may be 1.0 to 2.0. In addition, the X-ray random intensity ratio of the {211} plane, the {211} plane intensity, and the pole density of the {211} plane are synonymous. In addition, although the X-ray random intensity ratio of the {211} plane is basically measured by the X-ray diffraction method, since differences in the measurement results are not observed even when the measurement is conducted by the EBSD method or the ECP method, the measurement may be conducted by the EBSD method or the ECP method.

In addition, the measurement method of the chemical composition, the metallographic structure, and the texture, and the definitions such as the X-ray random intensity ratio, the total length M in the rolling direction of the inclusions, and the average of the maximum of the ratio of the major axis to the minor axis of the inclusions are as described above.

In the hot rolled steel sheet according to the embodiment, the chemical composition, the metallographic structure, and the texture are satisfied, so that the tensile strength TS is 590 MPa to 980 MPa. In addition, in the hot rolled steel sheet according to the embodiment, the chemical composition, the metallographic structure, and the texture are satisfied, so that the average λave of the hole expanding ratio is 60% or more, the standard deviation σ of the hole expanding ratio is 15% or less, the fatigue life in plane bending is 400000 times or more, the resistance of crack initiation Jc is 0.5 $MJ/m^2$ or more, the resistance of crack propagation T. M. is 600 $MJ/m^3$ or more, the fracture appearance transition temperature vTrs is 13° C. or lower, and the Charpy absorbed energy E is 16 J or more.

In the hot rolled steel sheet according to the embodiment, as described above, it is preferable to control the tensile strength TS by controlling the Ti content in accordance with the intended use of the steel sheet. For example, although the tensile strength TS of the steel sheet is 590 MPa to less than 780 MPa when the Ti content is 0.001 to less than 0.08%, it is possible to control the average λave of the hole expanding ratio to 90% or more, the resistance of crack initiation Jc to 0.9 $MJ/m^2$, and the Charpy absorbed energy E to 35 J or more in the above properties. For example, when the Ti content is 0.08% to 0.3%, it is possible to control the tensile strength TS of the steel sheet to 780 MPa to 980 MPa, and it is possible to control the fatigue life in plane bending to 500000 times or more in the above properties. As described above, in a case where the Ti content is changed in accordance with the intended use of the steel sheet, in order to control the total length M and the average of the ratio of the major axis to the minor axis to the intended limitation range, the amount of REM and Ca may be controlled as necessary as described above.

Next, description will be given of the method of producing the hot rolled steel sheet according to the embodiment.

A method of producing the hot rolled steel sheet according to the embodiment includes: a heating process of heating a steel piece which consists of the above-described chemical composition to a range of 1200° C. to 1400° C.; a first rough rolling process of rough rolling the steel piece in a temperature range of higher than 1150° C. to 1400° C. so that a cumulative reduction is 10% to 70% after the heating process; a second rough rolling process of rough rolling in a temperature range of higher than 1070° C. to 1150° C. so that a cumulative reduction is 10% to 25% after the first rough rolling process; a finish rolling process of finish rolling so that a start temperature is 1000° C. to 1070° C. and a finish temperature is Ar3+60° C. to Ar3+200° C. to obtain a hot rolled steel sheet after the second rough rolling process; a first cooling process of cooling the hot rolled steel from the finish temperature so that a cooling rate is 20° C./second to 150° C./second after the finish rolling process; a second cooling process of cooling in a temperature range of 650° C. to 750° C. so that the cooling rate is 1° C./second to 15° C./second and a cooling time is 1 second to 10 seconds after the first cooling process; a third cooling process of cooling to a temperature range of 0° C. to 200° C. so that the cooling rate is 20° C./second to 150° C./second after the second cooling process; and a coiling process of coiling the hot rolled steel sheet after the third cooling process. In addition, Ar3 represents a temperature where the ferrite transformation starts during cooling.

In the heating process, a steel piece which consists of the above-described chemical composition and which is obtained by continuous casting or the like is heated in a heating furnace. In order to obtain the intended tensile strength TS, the heating temperature in the process is to be 1200° C. to 1400° C. When the temperature is less than 1200° C., the precipitates which include Ti and Nb are not sufficiently dissolved and coarsen in the steel piece, so that the precipitation strengthening by the precipitates of Ti and Nb may not be obtained. Therefore, the intended tensile strength TS may not be obtained. In addition, when the temperature is less than 1200° C., MnS is not sufficiently dissolved in the steel piece, so that it may not be possible to make S precipitate as the sulfides with Ti, REM, and Ca. Therefore, the intended properties for the average λave of the hole expansion value, the resistance of crack initiation Jc, and the Charpy absorbed energy E may not be obtained. On the other hand, when the steel piece is heated to more than 1400° C., the above effects are saturated and the heating cost also increases.

In the first rough rolling process, rough rolling is conducted to the steel piece which was taken from the heating furnace. In the first rough rolling, rough rolling is conducted so that a cumulative reduction is 10% to 70% in a temperature range of higher than 1150° C. to 1400° C. When the cumulative reduction in the temperature range is more than 70%, both the total length M in the rolling direction of the inclusions and the average of the maximum of the ratio of the major axis to the minor axis of the inclusions may increase. Therefore, the properties such as the average λave of the hole expanding ratio, the standard deviation σ, the resistance of crack initiation Jc, the resistance of crack propagation T. M., the Charpy absorbed energy E, and the fatigue life may deteriorate. On the other hand, although the lower limit of the cumulative reduction in the first rough rolling process is not particularly limited, the above value is to be 10% or more in consideration of production efficiency and the like in the subsequent processes. In addition, preferably, the cumulative reduction in the first rough rolling process may be 10% to 65%. Thereby, under the condition where the composition of the steel piece satisfies 0.3≤(REM/140)/(Ca/40), it is possible to control the average of the ratio of the major axis to the minor axis to 1.0 to 3.0. In addition, by controlling the temperature range to higher than 1150° C. to 1400° C., it is possible to obtain the above effects.

In the second rough rolling process, rough rolling is conducted so that a cumulative reduction is 10% to 25% in a temperature range of higher than 1070° C. to 1150° C. When the cumulative reduction is less than 10%, the average grain size of the metallographic structure may coarsen, and the intended average grain size of the ferrite which is 2 μm to 10 μm may not be obtained. As a result, the intended fracture appearance transition temperature vTrs may not be obtained. On the other hand, when the cumulative reduction is more than 25%, the {211} plane intensity as the texture may increase. As a result, the intended properties such as the average λave of the hole expanding ratio, the resistance of crack initiation Jc, and the Charpy absorbed energy E may not be obtained. In addition, by controlling the temperature range to higher than 1070° C. to 1150° C., it is possible to obtain the above effect.

Here, description will be given of the basic research results relating to the first rough rolling process and the second rough rolling process. By using the test steels which consisted of the steel composition a as shown in the following Table 1, steel sheets were produced by variously changing the cumulative reduction in the first rough rolling and the second rough rolling, and the properties of the steel sheets were investigated. In addition, the producing conditions with the exception of the cumulative reduction in the first rough rolling and the second rough rolling of the hot rolled steel sheet according to the embodiment were satisfied.

[Table 1]

Figure 9A:
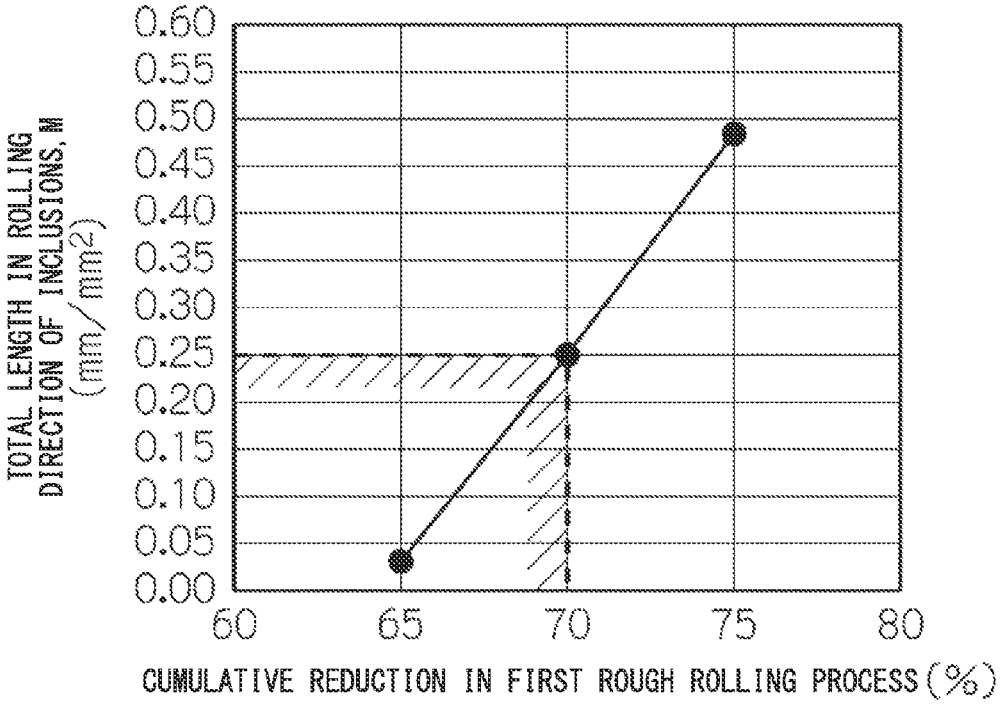
FIG. 9A is a diagram which shows a relationship between cumulative reduction in a first rough rolling process and the total length M in the rolling direction of the inclusions.
Figure 9B:
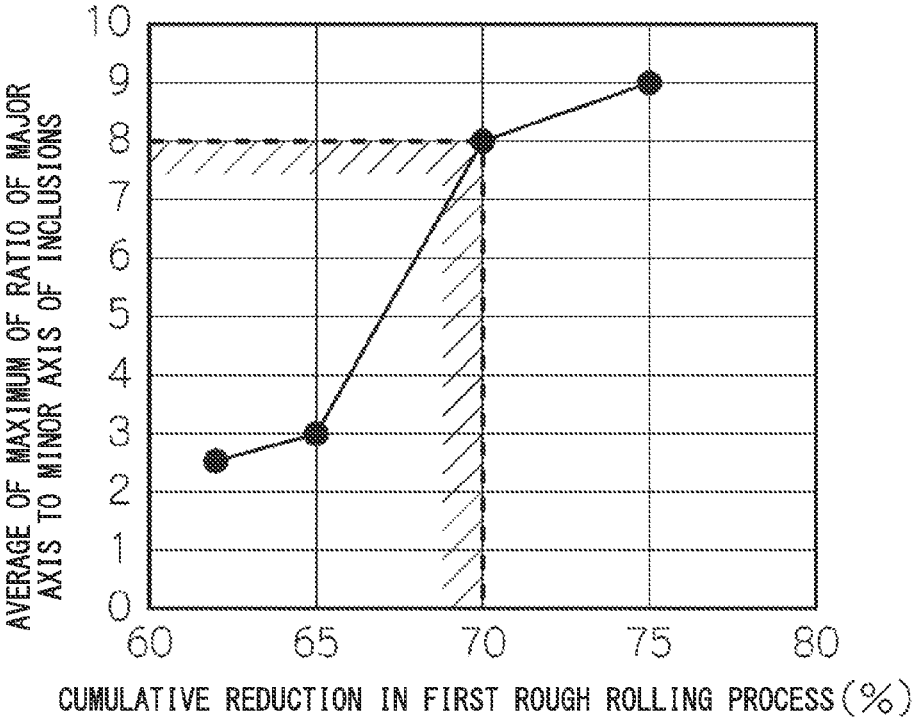
FIG. 9B is a diagram which shows a relationship between the cumulative reduction in the first rough rolling process and the average of the maximum of the ratio of the major axis to the minor axis of the inclusions.
Figure 9C:
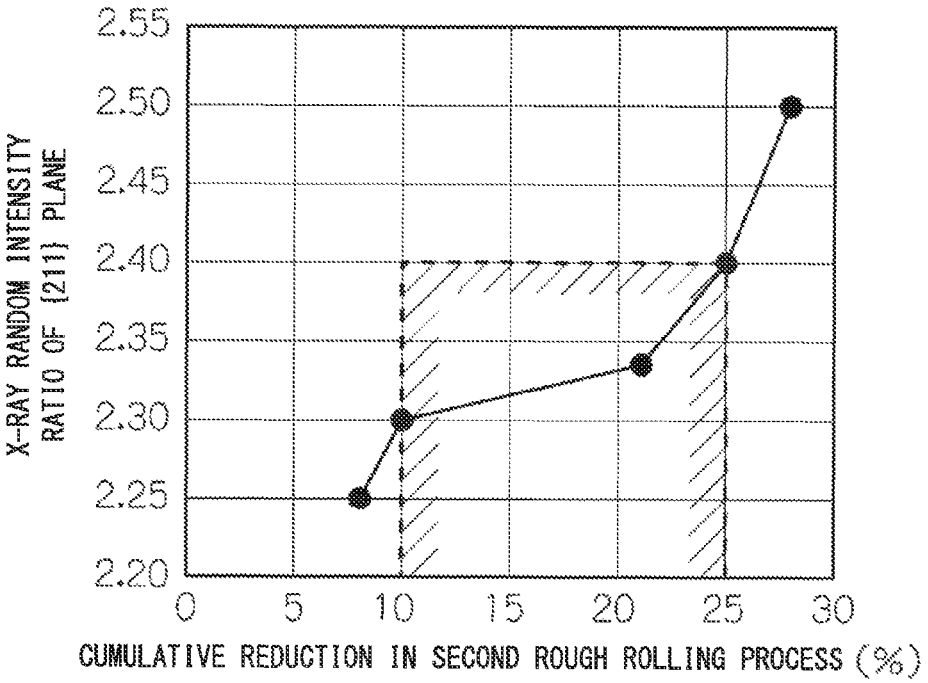
FIG. 9C is a diagram which shows a relationship between cumulative reduction in second rough rolling process and an X-ray random intensity ratio of {211} plane.
Figure 9D:
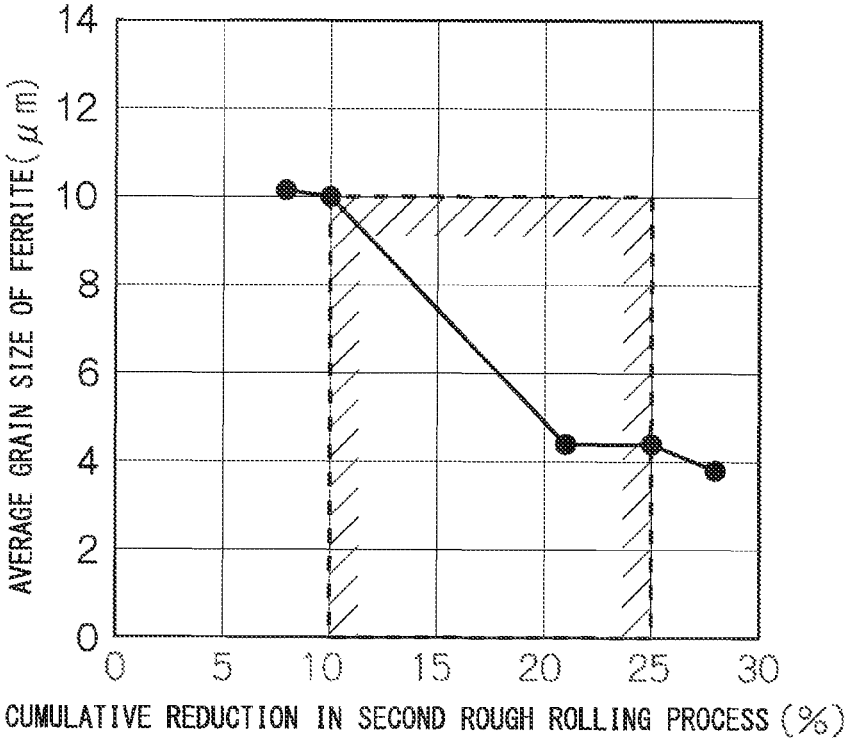
FIG. 9D is a diagram which shows a relationship between the cumulative reduction in the second rough rolling process and an average grain size of ferrite.

FIG. 9A is a diagram which shows a relationship between the cumulative reduction in the first rough rolling process and the total length M in the rolling direction of the inclusions. FIG. 9B is a diagram which shows a relationship between the cumulative reduction in the first rough rolling process and the average of the maximum of the ratio of the major axis to the minor axis of the inclusions. FIG. 9C is a diagram which shows a relationship between the cumulative reduction in the second rough rolling process and the {211} plane intensity. FIG. 9D is a diagram which shows a relationship between the cumulative reduction in the second rough rolling process and the average grain size of the ferrite. In addition, the cumulative reduction represents a ratio of reduction of the steel piece in the first rough rolling process and the second rough rolling process on the basis of the thickness of the steel piece after the heating process. Specifically, the cumulative reduction of the rough rolling in the first rough rolling process is defined as {(thickness of the steel piece before first reduction in a temperature range of higher than 1150° C. to 1400° C.−thickness of the steel piece after final reduction in a temperature range of higher than 1150° C. to 1400° C.)/thickness of the steel piece after the heating process×100%}. The cumulative reduction of the rough rolling in the second rough rolling process is defined as {(thickness of the steel piece before first reduction in a temperature range of higher than 1070° C. to 1150° C.−thickness of the steel piece after final reduction in a temperature range of higher than 1070° C. to 1150° C.)/thickness of the steel piece after the heating process×100%}.

From FIG. 9A, it is understood that, when the cumulative reduction is more than 70% in a temperature range of higher than 1150° C. to 1400° C., the total length M in the rolling direction of the inclusions is excessive, and the total length M of 0 mm/mm$^2$ to 0.25 mm/mm$^2$ which is the intended range is not obtained. In addition, from FIG. 9B, it is understood that, when the cumulative reduction is more than 70% in a temperature range of higher than 1150° C. to 1400° C., the average of the maximum of the ratio of the major axis to the minor axis of the inclusions is excessive, and the average of the ratio of the major axis to the minor axis of 1.0 to 8.0 which is the intended range is not obtained. The reason for the above seems that, as the cumulative reduction of the rough rolling which is conducted in a higher temperature range of higher than 1150° C. to 1400° C. increases, the inclusions tend to be elongated by rolling. In addition, from FIG. 9B, it is understood that, when the cumulative reduction is 65% or less, the average of the ratio of the major axis to the minor axis of 1.0 to 3.0 is obtained.

From FIG. 9C, it is understood that, when the cumulative reduction in a temperature range of higher than 1070° C. to 1150° C. is more than 25%, the {211} plane intensity is excessive, and the intended {211} plane intensity of 1.0 to 2.4 is not obtained. The reason for the above seems that, when the cumulative reduction of the rough rolling which is conducted in a temperature range which is a comparatively low temperature such as higher than 1070° C. to 1150° C. is excessively large, the recrystallization does not proceed uniformly after the rough rolling, and a non-recrystallized structure which leads to increase the {211} plane intensity remains even after the finish rolling, so that the {211} plane intensity increases.

From FIG. 9D, it is understood that, when the cumulative reduction in a temperature range of higher than 1070° C. to 1150° C. is less than 10%, the average grain size of the ferrite is excessive, and the intended average grain size of 2 μm to 10 μm is not obtained. The reason for the above seems that, as the cumulative reduction of the rough rolling which is conducted in a temperature range which is a low temperature such as higher than 1070° C. to 1150° C. decreases, the grain size of the austenite after recrystallization increases, and the average grain size of the ferrite of the steel sheet also increases.

After the second rough rolling process, as the finish rolling process, finish rolling is conducted to the steel piece in order to obtain the hot rolled steel sheet. In the finish rolling process, the start temperature is to be 1000° C. to 1070° C. When the start temperature of the finish rolling is 1000° C. to 1070° C., dynamic recrystallization is promoted in the finish rolling. As a result, the rolling texture which is the non-recrystallized state is relieved, and it is possible to obtain the intended {211} plane intensity of 1.0 to 2.4.

In addition, in the finish rolling process, the finish temperature is to be Ar3+60° C. to Ar3+200° C. In order to obtain the intended {211} plane intensity of 1.0 to 2.4 by preventing the rolling texture which is the no-recrystallized state and which leads to increase the {211} plane intensity from remaining, the finish temperature is controlled to Ar3+60° C. or more. Preferably, the temperature may be Ar3+100° C. or more. In addition, in order to obtain the intended average grain size of the ferrite by preventing the grain size from excessively coarsening, the finish temperature is controlled to Ar3+200° C. or less.

In addition, Ar3 is determined from the following Expression 10. In the following Expression 10, the calculation is conducted using the amounts expressed in mass % of each element in the chemical composition.

$$Ar3=868-396\times C+25\times Si-68\times Mn-36\times Ni-21\times Cu-25\times Cr+30\times Mo \quad \text{(Expression 10)}$$

Subsequently, the hot rolled steel sheet which is obtained by the finish rolling process is cooled in a run out table or the like. The cooling of the hot rolled steel sheet is conducted by the first cooling process to the third cooling process to be described below. In the first cooling process, the hot rolled steel sheet which is at the finish temperature of the finish rolling is cooled to a temperature of 650° C. to 750° C. so that a cooling rate is 20° C./second to 150° C./second. Subsequently, in the second cooling process, the cooling rate is changed to 1° C./second to 15° C./second, and cooling is conducted in a temperature range of 650° C. to 750° C. for a cooling time of 1 second to 10 seconds. Subsequently, in the third cooling process, the cooling rate is again returned to 20° C./second to 150° C./second, and cooling is conducted to a temperature range of 0° C. to 200° C. As described above, in the second cooling process, by conducting the cooling of the hot rolled steel sheet under the cooling rate which is slower than those of the first cooling process and the third cooling process, it is possible to promote the ferrite transformation. As a result, it is possible to obtain the hot rolled steel sheet which has the intended mixed structure.

When the cooling rate of the first cooling process is less than 20° C./second, the grain size of the ferrite may increase, and the fracture appearance transition temperature vTrs may deteriorate. In addition, due to the restriction of the producing facility, it is difficult to control the cooling rate in the first cooling process to more than 150° C./second. For this reason, the cooling rate in the first cooling process is to be 20° C./second to 150° C./second.

In order to promote the ferrite transformation and to control the area fraction of the martensite and the residual austenite which are the secondary phase to the intended range, the cooling rate in the second cooling process is to be 15° C./second or less. In addition, even when the cooling rate in the second cooling process is less than 1° C./second, the effect is saturated. For this reason, the cooling rate in the second cooling process is to be 1° C./second to 15° C./second.

In addition, in order to promote the ferrite transformation and to control the area fraction of the martensite and the residual austenite to the intended range, the temperature range where the second cooling process is conducted is to be 750° C. or less where the ferrite transformation is promoted. In addition, when the temperature range where the second cooling process is conducted is less than 650° C., the formation of the pearlite or the bainite is promoted, and therefore, the fraction of the martensite and the residual austenite may be excessively small. For this reason, the temperature range where the second cooling process is conducted is to be 650° to 750° C.

In addition, when the cooling time in the second cooling process is more than 10 seconds, the formation of the pearlite which causes the deterioration in the tensile strength TS and the fatigue life is promoted, and therefore, the fraction of the martensite and the residual austenite may be excessively small. In addition, in order to promote the ferrite transformation, the cooling time in the second cooling process is to be 1 second or more. For this reason, the cooling time in the second cooling process is to be 1 second to 10 seconds.

When the cooling rate in the third cooling process is less than 20° C./second, the formation of the pearlite and the bainite is promoted, and therefore, the fraction of the martensite and the residual austenite may be excessively small. In addition, due to the restriction of the producing facility, it is difficult to control the cooling rate in the third cooling process to more than 150° C./second. For this reason, the cooling rate in the third cooling process is to be 20° C./second to 150° C./second.

In addition, when the finish temperature of the cooling in the third cooling process is higher than 200° C., the formation of the bainite is promoted during the coiling process which is the subsequent process, and therefore, the fraction of the martensite and the residual austenite may be excessively small. In addition, due to the restriction of the producing facility, it is difficult to control the finish temperature of the cooling in the third cooling process to less than 0° C. For this reason, the finish temperature of the cooling in the third cooling process is to be 0° C. to 200° C.

In addition, for example, the cooling rate of 20° C./second or more is obtained by the cooling such as water-cooling or mist-cooling. In addition, for example, the cooling rate of 15° C./second or less is obtained by the cooling such as air-cooling.

Subsequently, as the coiling process, the hot rolled steel sheet is coiled.

The above are the producing conditions of the hot rolling method according to the embodiment. However, as necessary, in order to improve the ductility by the introduction of moving dislocations and to correct the shape of the steel sheet, the skin pass rolling may be conducted. In addition, as necessary, in order to remove scale which adheres to the surface of the hot rolled steel sheet, the pickling may be conducted. In addition, as necessary, by using the obtained hot rolled steel sheet, the skin pass rolling which is in-line or off-line or the cold rolling may be conducted.

In addition, as necessary, in order to improve the corrosion resistance of the steel sheet, the coating such as a hot dip coating may be conducted. In addition to the hot dip coating, the alloying may be conducted.

EXAMPLE

Hereinafter, the effects of an aspect of the present invention will be described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

Molten steels having the steel compositions A to MMMM as shown in Tables 2 to 4 were obtained. Each of the molten steels was made by conducting converter smelting and secondary refining. The secondary refining was conducted in a RH (Ruhrstahl-Hausen) vacuum degasser, and desulfurization was conducted by appropriately adding CaO—CaF2-MgO based desulfurizing agent. In some of the steel compositions, in order to suppress the remaining of the desulfurizing agent which tends to be the elongated inclusion, steels having S content which corresponds to that after the primary refining in the converter were produced without conducting desulfurization. Steel pieces were obtained by continuous casting using the molten steels, the hot rolling was conducted under the producing conditions as shown in Tables 5 to 7, and the obtained steel sheets were coiled. The sheet thickness of the obtained hot rolled steel sheets was to be 2.9 mm.

The characteristic values of the obtained hot rolled steel sheets, such as the metallographic structures, the texture, and the inclusions are shown in Tables 8 to 10. The mechanical properties of the obtained hot rolled steel sheets are shown in Tables 11 to 13. The measurement methods of the metallographic structure, the texture, and the inclusions, and the measurement methods of the mechanical properties are described above. As the tensile properties, when the tensile strength TS was 590 MPa or more and the n value was 0.13 or more, it was judged to be acceptable. As the formability, when the average λave of the hole expanding ratio was 60% or more and the standard deviation σ of the hole expanding ratio was 15% or less, it was judged to be acceptable. As the fracture properties, when the resistance of crack initiation Jc was 0.5 $MJ/m^2$ or more, the resistance of crack propagation T. M. was 600 $MJ/m^3$ or more, the fracture appearance transition temperature vTrs was 13° C. or lower, and the Charpy absorbed energy E was 16 J or more, it was judged to be acceptable. As the fatigue properties, when the bending plane fatigue life was 400000 times or more, it was judged to be acceptable. In addition, the underlined value in the tables indicates out of the range of the present invention. In addition, in the tables, by using the amounts expressed in mass % of each element in the chemical composition, a value of (Ti/48)/(S/32)+{(Ca/40)/(S/32)+(REM/140)/(S/32)}×15 is represented as "*1", and a value of (REM/140)/(Ca/40) is represented as "*2".

In Tables 2 to 13, the producing results and the evaluation results are shown. All of the Examples satisfied the ranges of the present invention and are excellent in, as the hot rolled steel sheet, the tensile properties, the formability, the fracture properties, and the fatigue properties. On the other hand, the Comparative Examples did not satisfy the ranges of the present invention as the hot rolled steel sheet.

In Comparative Example 11, since the C content was insufficient, the average grain size of the primary phase coarsened. Therefore, the fracture properties of the steel sheet deteriorated.

In Comparative Example 12, since the C content was insufficient, the average grain size of the primary phase coarsened and the area fraction of the secondary phase decreased. Therefore, the tensile properties and the fracture properties of the steel sheet deteriorated.

In Comparative Example 26, since the S content was excessive, the total length M in the rolling direction of the inclusions increased. Therefore, the formability, the fracture properties, and the fatigue properties of the steel sheet deteriorated.

In Comparative Example 27, since the value of "*1" was insufficient, the total length M in the rolling direction of the inclusions and the average of the maximum of the ratio of the major axis to the minor axis of the inclusions increased. Therefore, the formability and the fracture properties of the steel sheet deteriorated.

In Comparative Example 28, since the Mn content was excessive, the area fraction of the secondary phase increased. Therefore, the formability and the fracture properties of the steel sheet deteriorated.

In Comparative Example 30, since the reduction in the first rough rolling process was excessive, the total length M in the rolling direction of the inclusions and the average of the maximum of the ratio of the major axis to the minor axis of the inclusions increased. Therefore, the formability, the fracture properties, and the fatigue properties of the steel sheet deteriorated.

In Comparative Example 32, since the reduction in the second rough rolling process was excessive, the {211} plane intensity increased. Therefore, the formability and the fracture properties of the steel sheet deteriorated.

In Comparative Example 35, since the reduction in the second rough rolling process was insufficient, the average grain size of the primary phase coarsened. Therefore, the fracture properties of the steel sheet deteriorated.

In Comparative Example 36, since the start temperature in the finish rolling process was low, the {211} plane intensity increased. Therefore, the formability and the fracture properties of the steel sheet deteriorated.

In Comparative Example 37, since the finish temperature in the finish rolling process was low, the {211} plane intensity increased. Therefore, the formability and the fracture properties of the steel sheet deteriorated.

In Comparative Example 38, since the finish temperature in the finish rolling process was high, the average grain size of the primary phase coarsened. Therefore, the fracture properties of the steel sheet deteriorated.

In Comparative Example 39, since the cooling rate in the first cooling process was slow, the average grain size of the primary phase coarsened. Therefore, the fracture properties of the steel sheet deteriorated.

In Comparative Example 40, since the finish temperature of the cooling in the third cooling process was high, the area fraction of the secondary phase decreased. Therefore, the tensile properties and the fatigue properties of the steel sheet deteriorated.

In Comparative Example 41, since the cooling rate in the third cooling process was slow, the area fraction of the secondary phase decreased. Therefore, the tensile properties and the fatigue properties of the steel sheet deteriorated.

In Comparative Example 51, since the C content was insufficient, the average grain size of the primary phase coarsened and the area fraction of the secondary phase decreased. Therefore, the tensile properties, the fracture properties, and the fatigue properties of the steel sheet decreased.

In Comparative Example 67, since the value of "*1" was insufficient, the total length M in the rolling direction of the inclusions increased. Therefore, the formability, the fracture properties, and the fatigue properties of the steel sheet deteriorated.

In Comparative Example 68, since the value of "*1" was insufficient, the total length M in the rolling direction of the inclusions and the average of the maximum of the ratio of the major axis to the minor axis of the inclusions increased. Therefore, the formability, the fracture properties, and the fatigue properties of the steel sheet deteriorated.

In Comparative Example 69, since the Mn content was excessive, the area fraction of the secondary phase increased. Therefore, the formability and the fracture properties of the steel sheet deteriorated.

In Comparative Example 70, since the heating temperature in the heating process was low, the tensile strength was insufficient.

In Comparative Example 71, since the reduction in the first rough rolling process was excessive, the total length M in the rolling direction of the inclusions and the average of the maximum of the ratio of the major axis to the minor axis of the inclusions increased. Therefore, the formability, the fracture properties, and the fatigue properties of the steel sheet deteriorated.

In Comparative Example 73, since the reduction in the second rough rolling process was excessive, the {211} plane intensity increased. Therefore, the formability and the fracture properties of the steel sheet deteriorated.

In Comparative Example 76, since the reduction in the second rough rolling process was insufficient, the average grain size of the primary phase coarsened. Therefore, the fracture properties of the steel sheet deteriorated.

In Comparative Example 77, since the start temperature in the finish rolling process was low, the {211} plane intensity increased. Therefore, the formability and the fracture properties of the steel sheet deteriorated.

In Comparative Example 78, since the finish temperature in the finish rolling process was low, the {211} plane intensity increased. Therefore, the formability and the fracture properties of the steel sheet deteriorated.

In Comparative Example 79, since the finish temperature in the finish rolling process was high, the average grain size of the primary phase coarsened. Therefore, the fracture properties of the steel sheet deteriorated.

In Comparative Example 80, since the cooling rate in the third cooling process was slow, the average grain size of the primary phase coarsened and the area fraction of the secondary phase decreased. Therefore, the tensile properties, the fracture properties, and the fatigue properties of the steel sheet deteriorated.

In Comparative Example 81, since the finish temperature of the cooling in the third cooling process was high, the area fraction of the secondary phase decreased. Therefore, the tensile properties and the fatigue properties of the steel sheet deteriorated.

In Comparative Example 84, since all of Ti, REM, or Ca were not contained, the total length M in the rolling direction of the inclusions and the average of the maximum of the ratio of the major axis to the minor axis of the inclusions increased. Therefore, the formability, the fracture properties, and the fatigue properties of the steel sheet deteriorated.

In Comparative Example 85, since the cooling rate in the second cooling process was fast, the area fraction of the secondary phase increased. Therefore, the formability and the fracture properties of the steel sheet deteriorated.

In Comparative Example 86, since the value of "*1" was insufficient, the total length M in the rolling direction of the inclusions increased. Therefore, the formability, the fracture properties, and the fatigue properties of the steel sheet deteriorated.

In Comparative Example 91, since the cooling temperature in the second cooling process was high, the area fraction of the secondary phase increased. Therefore, the formability and the fracture properties of the steel sheet deteriorated.

In Comparative Example 92, since the cooling time in the second cooling process was long, the area fraction of the primary phase decreased and the area fraction of the pearlite increased. Therefore, the tensile properties and the fatigue properties of the steel sheet deteriorated.

In Comparative Example 93, since the cooling time in the second cooling process was short, the area fraction of the secondary phase increased. Therefore, the formability and the fracture properties of the steel sheet deteriorated.

In Comparative Example 94, since the C content was excessive, the formability and the fracture properties of the steel sheet deteriorated.

In Comparative Example 95, since the Mn content was insufficient, the tensile properties of the steel sheet deteriorated.

In Comparative Examples 96 and 97, since the amount of Si+Al was excessive, the formability of the steel sheet deteriorated.

In Comparative Examples 98 and 99, since the amount of Si+Al content was insufficient, the tensile properties and the fracture properties of the steel sheet deteriorated.

In Comparative Example 100, since the P content was excessive, the formability and the fracture properties of the steel sheet deteriorated.

In Comparative Example 101, since the N content was excessive, the tensile properties of the steel sheet deteriorated.

In Comparative Example 102, since the Ti content was excessive, the formability and the fracture properties of the steel sheet deteriorated.

In Comparative Example 103, since the REM content was excessive, the formability and the fracture properties of the steel sheet deteriorated.

In Comparative Example 104, since the Ca content was excessive, the total length M in the rolling direction of the inclusions and the average of the maximum of the ratio of the major axis to the minor axis of the inclusions increased. Therefore, the formability, the fracture properties, and the fatigue properties of the steel sheet deteriorated.

In Comparative Example 105, since the Ti content was insufficient, the formability, the fracture properties, and the fatigue properties of the steel sheet deteriorated.

In Comparative Example 106, since the REM content was insufficient, the formability, the fracture properties, and the fatigue properties of the steel sheet deteriorated.

In Comparative Example 107, since the Ca content was insufficient, the formability, the fracture properties, and the fatigue properties of the steel sheet deteriorated.

In Comparative Example 108, since the Nb content was excessive, the {211} plane intensity increased. Therefore, the formability and the fracture properties of the steel sheet deteriorated.

In Comparative Example 109, since the B content was excessive, the {211} plane intensity increased. Therefore, the formability and the fracture properties of the steel sheet deteriorated.

In Comparative Example 110, since the Cu content was excessive, the formability of the steel sheet deteriorated.

In Comparative Example 111, since the Cr content was excessive, the formability of the steel sheet deteriorated.

In Comparative Example 112, since the Mo content was excessive, the formability of the steel sheet deteriorated.

In Comparative Example 113, since the Ni content was excessive, the formability of the steel sheet deteriorated.

In Comparative Example 114, since the V content was excessive, the formability of the steel sheet deteriorated.

[Table 2]
[Table 3]
[Table 4]
[Table 5]
[Table 6]
[Table 7]
[Table 8]
[Table 9]
[Table 10]
[Table 11]
[Table 12]
[Table 13]

INDUSTRIAL APPLICABILITY

According to the aspect of the present invention, it is possible to obtain a steel sheet which has an excellent balance between tensile properties and formability and furthermore which has excellent fracture properties and fatigue properties. Accordingly, the present invention has significant industrial applicability.

REFERENCE SIGNS LIST

41*a* to 41*l* INCLUSIONS IN WHICH MAJOR AXIS OF EACH OF INCLUSIONS IS 3 μm OR MORE

F INTERVAL BETWEEN INCLUSIONS IN ROLLING DIRECTION

G INCLUSION-CLUSTER

GL LENGTH OF INCLUSION-CLUSTER IN ROLLING DIRECTION

H INDEPENDENT-INCLUSION

HL LENGTH OF INDEPENDENT-INCLUSION IN ROLLING DIRECTION

TABLE 1

| STEEL | CHEMICAL COMPOSITION (unit: mass %) | | | | | | | | | | Ar3 |
|---|---|---|---|---|---|---|---|---|---|---|---|
| COMPOSITION | C | Si | Mn | P | S | Al | N | Ti | REM | Ca | (° C.) |
| a | 0.040 | 1.25 | 1.25 | 0.007 | 0.001 | 0.025 | 0.0035 | 0.07 | 0.0025 | 0.002 | 798 |

TABLE 2

| | | STEEL | CHEMICAL COMPOSITION (unit: mass %) | | | | | | | |
|---|---|---|---|---|---|---|---|---|---|---|
| | | COMPOSITION | C | Si | Mn | P | S | Al | N | Ti |
| EXAMPLE | 1 | A | 0.060 | 1.25 | 1.90 | 0.007 | 0.0030 | 0.023 | 0.0021 | 0.13 |
| EXAMPLE | 2 | B | 0.055 | 1.35 | 1.85 | 0.008 | 0.0010 | 0.020 | 0.0025 | 0.13 |
| EXAMPLE | 3 | C | 0.062 | 1.05 | 2.50 | 0.011 | 0.0040 | 0.029 | 0.0029 | 0.28 |
| EXAMPLE | 4 | D | 0.057 | 1.95 | 1.35 | 0.009 | 0.0010 | 0.026 | 0.0021 | 0.12 |
| EXAMPLE | 5 | E | 0.065 | 1.35 | 1.70 | 0.010 | 0.0040 | 0.028 | 0.0020 | 0.25 |
| EXAMPLE | 6 | F | 0.080 | 1.15 | 1.90 | 0.011 | 0.0010 | 0.025 | 0.0029 | 0.18 |
| EXAMPLE | 7 | G | 0.061 | 0.50 | 1.85 | 0.012 | 0.0030 | 0.025 | 0.0027 | 0.13 |
| EXAMPLE | 8 | H | 0.060 | 0.55 | 1.87 | 0.008 | 0.0035 | 0.028 | 0.0029 | 0.13 |
| EXAMPLE | 9 | I | 0.058 | 1.36 | 2.00 | 0.011 | 0.0045 | 0.027 | 0.0028 | 0.14 |
| EXAMPLE | 10 | J | 0.059 | 1.17 | 1.86 | 0.012 | 0.0035 | 0.021 | 0.0026 | 0.08 |
| EXAMPLE | 11 | K | 0.028 | 1.00 | 1.90 | 0.012 | 0.0040 | 0.023 | 0.0024 | 0.12 |
| EXAMPLE | 12 | L | 0.015 | 1.30 | 1.90 | 0.011 | 0.0040 | 0.021 | 0.0020 | 0.12 |
| EXAMPLE | 13 | M | 0.065 | 1.09 | 1.91 | 0.006 | 0.0040 | 0.028 | 0.0029 | 0.13 |
| EXAMPLE | 14 | N | 0.068 | 1.13 | 1.80 | 0.005 | 0.0040 | 0.022 | 0.0025 | 0.14 |
| EXAMPLE | 15 | O | 0.060 | 1.27 | 1.70 | 0.011 | 0.0040 | 0.025 | 0.0022 | 0.13 |
| EXAMPLE | 16 | P | 0.061 | 1.35 | 1.90 | 0.012 | 0.0040 | 0.027 | 0.0025 | 0.13 |
| EXAMPLE | 17 | Q | 0.062 | 1.25 | 1.80 | 0.009 | 0.0040 | 0.021 | 0.0024 | 0.12 |
| EXAMPLE | 18 | R | 0.055 | 1.23 | 1.90 | 0.011 | 0.0040 | 0.029 | 0.0023 | 0.11 |
| EXAMPLE | 19 | S | 0.059 | 1.20 | 1.89 | 0.012 | 0.0040 | 0.027 | 0.0027 | 0.13 |
| EXAMPLE | 20 | T | 0.060 | 1.30 | 1.83 | 0.014 | 0.0040 | 0.020 | 0.0026 | 0.14 |
| EXAMPLE | 21 | U | 0.057 | 1.05 | 1.86 | 0.008 | 0.0038 | 0.022 | 0.0020 | 0.12 |
| EXAMPLE | 22 | V | 0.059 | 1.04 | 1.87 | 0.009 | 0.0040 | 0.024 | 0.0029 | 0.13 |
| EXAMPLE | 23 | W | 0.062 | 1.10 | 1.83 | 0.011 | 0.0040 | 0.023 | 0.0024 | 0.11 |
| EXAMPLE | 24 | X | 0.061 | 1.17 | 1.85 | 0.012 | 0.0035 | 0.024 | 0.0023 | 0.13 |
| EXAMPLE | 25 | Y | 0.060 | 1.15 | 1.86 | 0.014 | 0.0043 | 0.026 | 0.0021 | 0.12 |
| COMPARATIVE EXAMPLE | 26 | Z | 0.061 | 1.18 | 1.87 | 0.009 | 0.0110 | 0.024 | 0.0022 | 0.13 |
| COMPARATIVE EXAMPLE | 27 | AA | 0.055 | 1.35 | 1.75 | 0.008 | 0.0100 | 0.025 | 0.0021 | 0.13 |
| COMPARATIVE EXAMPLE | 28 | BB | 0.048 | 0.51 | 3.05 | 0.011 | 0.0040 | 0.030 | 0.0024 | 0.13 |

| | | CHEMICAL COMPOSITION (unit: mass %) | | | | | |
|---|---|---|---|---|---|---|---|
| | | REM | Ca | ※1 | ※2 | Si + Al | OTHER ELEMENTS |
| EXAMPLE | 1 | 0.0040 | 0.0038 | 48.66 | 0.30 | 1.27 | V = 0.015% |
| EXAMPLE | 2 | 0.0025 | 0.0020 | 119.24 | 0.36 | 1.37 | — |
| EXAMPLE | 3 | 0.0000 | 0.0000 | 46.67 | ∞ | 1.08 | V = 0.03% |
| EXAMPLE | 4 | 0.0000 | 0.0000 | 80.00 | ∞ | 1.98 | — |
| EXAMPLE | 5 | 0.0000 | 0.0003 | 42.57 | 0.00 | 1.38 | — |
| EXAMPLE | 6 | 0.0000 | 0.0004 | 124.80 | 0.00 | 1.17 | — |
| EXAMPLE | 7 | 0.0050 | 0.0000 | 34.60 | ∞ | 0.53 | V = 0.08% |
| EXAMPLE | 8 | 0.0050 | 0.0003 | 30.69 | 4.76 | 0.58 | V = 0.08% |
| EXAMPLE | 9 | 0.0040 | 0.0034 | 32.86 | 0.34 | 1.39 | Nb = 0.019% |
| EXAMPLE | 10 | 0.0055 | 0.0050 | 37.39 | 0.31 | 1.19 | — |
| EXAMPLE | 11 | 0.0040 | 0.0037 | 34.53 | 0.31 | 1.02 | — |
| EXAMPLE | 12 | 0.0400 | 0.0036 | 65.09 | 3.17 | 1.32 | — |
| EXAMPLE | 13 | 0.0040 | 0.0037 | 36.20 | 0.31 | 1.12 | B = 0.0010% |
| EXAMPLE | 14 | 0.0180 | 0.0000 | 38.76 | ∞ | 1.15 | Cr = 0.1%, Mo = 0.03% |
| EXAMPLE | 15 | 0.0000 | 0.0050 | 36.67 | 0.00 | 1.30 | — |
| EXAMPLE | 16 | 0.0000 | 0.0040 | 33.67 | 0.00 | 1.38 | — |
| EXAMPLE | 17 | 0.0010 | 0.0031 | 30.16 | 0.09 | 1.27 | — |
| EXAMPLE | 18 | 0.0020 | 0.0042 | 32.65 | 0.14 | 1.26 | — |
| EXAMPLE | 19 | 0.0032 | 0.0044 | 37.61 | 0.21 | 1.23 | — |
| EXAMPLE | 20 | 0.0034 | 0.0040 | 38.25 | 0.24 | 1.32 | — |
| EXAMPLE | 21 | 0.0027 | 0.0025 | 31.38 | 0.31 | 1.07 | Cu = 0.2%, Ni = 0.1% |
| EXAMPLE | 22 | 0.0031 | 0.0024 | 31.52 | 0.37 | 1.06 | V = 0.02% |
| EXAMPLE | 23 | 0.0055 | 0.0040 | 35.05 | 0.39 | 1.12 | — |
| EXAMPLE | 24 | 0.0038 | 0.0035 | 40.48 | 0.31 | 1.19 | — |

TABLE 2-continued

| | | | | | | | |
|---|---|---|---|---|---|---|---|
| EXAMPLE | 25 | 0.0044 | 0.0029 | 30.21 | 0.43 | 1.18 | — |
| COMPARATIVE EXAMPLE | 26 | 0.0034 | 0.0041 | 13.41 | 0.24 | 1.20 | — |
| COMPARATIVE EXAMPLE | 27 | 0.0015 | 0.0023 | 11.94 | 0.19 | 1.38 | — |
| COMPARATIVE EXAMPLE | 28 | 0.0032 | 0.0022 | 31.01 | 0.42 | 0.54 | — |

The underlined value in the table indicates out of the range of the present invention.
The ※1 in the table indicates (Ti/48)/(S/32) + {(Ca/40)/(S/32) + (REM/140)/(S/32)} × 15.
The ※2 in the table indicates (REM/140)/(Ca/40).

TABLE 3

| | | STEEL | CHEMICAL COMPOSITION (unit: mass %) | | | | | | | | | | | | | |
|---|---|---|---|---|---|---|---|---|---|---|---|---|---|---|---|---|
| | | COMPOSITION | C | Si | Mn | P | S | Al | N | Ti | REM | Ca | ※1 | ※2 | Si + Al | OTHER ELEMENTS |
| EXAMPLE | 42 | CC | 0.040 | 1.25 | 1.25 | 0.007 | 0.0030 | 0.023 | 0.0021 | 0.05 | 0.0040 | 0.0038 | 30.88 | 0.30 | 1.27 | — |
| EXAMPLE | 43 | DD | 0.055 | 1.35 | 1.20 | 0.008 | 0.0010 | 0.020 | 0.0025 | 0.05 | 0.0025 | 0.0020 | 65.90 | 0.36 | 1.37 | — |
| EXAMPLE | 44 | EE | 0.062 | 1.05 | 1.48 | 0.011 | 0.0040 | 0.029 | 0.0029 | 0.08 | 0.0000 | 0.0000 | 13.37 | ∞ | 1.08 | V = 0.02% |
| EXAMPLE | 45 | FF | 0.057 | 1.95 | 0.70 | 0.009 | 0.0010 | 0.026 | 0.0021 | 0.04 | 0.0000 | 0.0000 | 26.67 | ∞ | 1.98 | — |
| EXAMPLE | 46 | GG | 0.065 | 1.35 | 1.05 | 0.010 | 0.0040 | 0.028 | 0.0020 | 0.08 | 0.0000 | 0.0003 | 13.40 | 0.00 | 1.38 | — |
| EXAMPLE | 47 | HH | 0.090 | 1.15 | 1.25 | 0.011 | 0.0010 | 0.025 | 0.0029 | 0.08 | 0.0000 | 0.0004 | 56.80 | 0.00 | 1.17 | — |
| EXAMPLE | 48 | II | 0.061 | 0.50 | 1.85 | 0.012 | 0.0030 | 0.025 | 0.0027 | 0.05 | 0.0050 | 0.0000 | 16.83 | ∞ | 0.53 | V = 0.01% |
| EXAMPLE | 49 | JJ | 0.060 | 0.55 | 1.87 | 0.008 | 0.0035 | 0.028 | 0.0029 | 0.05 | 0.0050 | 0.0002 | 15.11 | 7.14 | 0.58 | V = 0.02% |
| EXAMPLE | 50 | KK | 0.040 | 1.50 | 1.51 | 0.007 | 0.0015 | 0.025 | 0.0025 | 0.00 | 0.0034 | 0.0028 | 30.17 | 0.35 | 1.53 | — |
| COMPARATIVE EXAMPLE | 51 | LL | 0.020 | 1.30 | 1.35 | 0.006 | 0.0040 | 0.021 | 0.0021 | 0.05 | 0.0045 | 0.0040 | 24.19 | 0.32 | 1.32 | — |
| EXAMPLE | 52 | MM | 0.058 | 1.36 | 1.35 | 0.011 | 0.0045 | 0.027 | 0.0028 | 0.06 | 0.0040 | 0.0034 | 21.00 | 0.34 | 1.39 | Nb = 0.012% |
| EXAMPLE | 53 | NN | 0.031 | 1.00 | 1.25 | 0.012 | 0.0040 | 0.023 | 0.0024 | 0.04 | 0.0040 | 0.0037 | 21.20 | 0.31 | 1.02 | — |
| EXAMPLE | 54 | OO | 0.065 | 1.09 | 1.26 | 0.006 | 0.0040 | 0.028 | 0.0029 | 0.05 | 0.0040 | 0.0037 | 22.86 | 0.31 | 1.12 | B = 0.0009% |
| EXAMPLE | 55 | PP | 0.068 | 1.13 | 1.15 | 0.005 | 0.0040 | 0.022 | 0.0025 | 0.06 | 0.0100 | 0.0000 | 18.57 | ∞ | 1.15 | Cr = 0.2%, Mo = 0.05% |
| EXAMPLE | 56 | QQ | 0.060 | 1.27 | 0.83 | 0.011 | 0.0040 | 0.025 | 0.0022 | 0.05 | 0.0000 | 0.0050 | 23.33 | 0.00 | 1.30 | — |
| EXAMPLE | 57 | RR | 0.061 | 1.35 | 1.25 | 0.012 | 0.0040 | 0.027 | 0.0025 | 0.05 | 0.0000 | 0.0040 | 20.33 | 0.00 | 1.38 | — |
| EXAMPLE | 58 | SS | 0.062 | 1.25 | 1.15 | 0.009 | 0.0040 | 0.021 | 0.0024 | 0.04 | 0.0010 | 0.0031 | 16.82 | 0.09 | 1.27 | — |
| EXAMPLE | 59 | TT | 0.055 | 1.23 | 1.25 | 0.011 | 0.0040 | 0.029 | 0.0023 | 0.03 | 0.0020 | 0.0042 | 19.31 | 0.14 | 1.26 | — |
| EXAMPLE | 60 | UU | 0.059 | 1.20 | 1.24 | 0.012 | 0.0040 | 0.027 | 0.0027 | 0.05 | 0.0032 | 0.0044 | 24.28 | 0.21 | 1.23 | — |
| EXAMPLE | 61 | VV | 0.060 | 1.30 | 1.18 | 0.014 | 0.0040 | 0.020 | 0.0026 | 0.06 | 0.0034 | 0.0040 | 24.91 | 0.24 | 1.32 | — |
| EXAMPLE | 62 | WW | 0.057 | 1.05 | 1.21 | 0.008 | 0.0038 | 0.022 | 0.0020 | 0.04 | 0.0027 | 0.0025 | 17.35 | 0.31 | 1.07 | Cu = 0.2%, Ni = 0.2% |
| EXAMPLE | 63 | XX | 0.059 | 1.04 | 1.22 | 0.009 | 0.0040 | 0.024 | 0.0029 | 0.05 | 0.0031 | 0.0024 | 18.19 | 0.37 | 1.06 | V = 0.01% |
| EXAMPLE | 64 | YY | 0.062 | 1.10 | 1.18 | 0.011 | 0.0040 | 0.023 | 0.0024 | 0.03 | 0.0055 | 0.0040 | 21.17 | 0.39 | 1.12 | — |
| EXAMPLE | 65 | ZZ | 0.061 | 1.17 | 1.20 | 0.012 | 0.0035 | 0.024 | 0.0023 | 0.05 | 0.0036 | 0.0035 | 25.25 | 0.31 | 1.19 | — |
| EXAMPLE | 66 | AAA | 0.060 | 1.15 | 1.21 | 0.014 | 0.0043 | 0.026 | 0.0021 | 0.04 | 0.0035 | 0.0031 | 17.64 | 0.32 | 1.18 | — |
| COMPARATIVE EXAMPLE | 67 | BBB | 0.061 | 1.18 | 1.22 | 0.009 | 0.0080 | 0.024 | 0.0022 | 0.05 | 0.0034 | 0.0041 | 11.77 | 0.24 | 1.20 | — |
| COMPARATIVE EXAMPLE | 68 | CCC | 0.055 | 1.35 | 1.10 | 0.008 | 0.0100 | 0.025 | 0.0021 | 0.05 | 0.0015 | 0.0023 | 6.61 | 0.19 | 1.38 | — |
| COMPARATIVE EXAMPLE | 69 | DDD | 0.048 | 0.51 | 3.05 | 0.011 | 0.0040 | 0.030 | 0.0024 | 0.05 | 0.0032 | 0.0022 | 17.68 | 0.42 | 0.54 | — |

The underlined value in the table indicates out of the range of the present invention.
The ※1 in the table indicates (Ti/48)/(S/32) + {(Ca/40)/(S/32) + (REM/140)/(S/32)} × 15.
The ※2 in the table indicates (REM/140)/(Ca/40).

TABLE 4

| | | STEEL | CHEMICAL COMPOSITION (unit: mass %) | | | | | | | |
|---|---|---|---|---|---|---|---|---|---|---|
| | | COMPOSITION | C | Si | Mn | P | S | Al | N | Ti |
| EXAMPLE | 82 | EEE | 0.060 | 1.10 | 1.80 | 0.010 | 0.0010 | 0.020 | 0.0020 | 0.00 |
| EXAMPLE | 83 | FFF | 0.060 | 1.31 | 1.75 | 0.008 | 0.0030 | 0.025 | 0.0025 | 0.00 |
| COMPARATIVE EXAMPLE | 84 | GGG | 0.065 | 1.60 | 0.50 | 0.010 | 0.0030 | 0.028 | 0.0025 | 0.00 |
| COMPARATIVE EXAMPLE | 85 | HHH | 0.078 | 1.50 | 1.20 | 0.010 | 0.0025 | 0.025 | 0.0021 | 0.13 |
| COMPARATIVE EXAMPLE | 86 | JJJ | 0.064 | 1.50 | 1.80 | 0.010 | 0.0015 | 0.025 | 0.0031 | 0.02 |
| EXAMPLE | 87 | A | 0.060 | 1.25 | 1.90 | 0.007 | 0.0030 | 0.023 | 0.0021 | 0.13 |
| EXAMPLE | 89 | A | 0.060 | 1.25 | 1.90 | 0.007 | 0.0030 | 0.023 | 0.0021 | 0.13 |
| EXAMPLE | 90 | KKK | 0.060 | 1.25 | 1.95 | 0.010 | 0.0049 | 0.025 | 0.0040 | 0.13 |
| COMPARATIVE EXAMPLE | 91 | A | 0.060 | 1.25 | 1.90 | 0.007 | 0.0030 | 0.023 | 0.0021 | 0.13 |
| COMPARATIVE EXAMPLE | 92 | A | 0.060 | 1.25 | 1.90 | 0.007 | 0.0030 | 0.023 | 0.0021 | 0.13 |
| COMPARATIVE EXAMPLE | 93 | A | 0.060 | 1.25 | 1.90 | 0.007 | 0.0030 | 0.023 | 0.0021 | 0.13 |
| COMPARATIVE EXAMPLE | 94 | LLL | 0.110 | 1.25 | 1.90 | 0.007 | 0.0030 | 0.023 | 0.0021 | 0.13 |

TABLE 4-continued

| | | | | | | | | | | |
|---|---|---|---|---|---|---|---|---|---|---|
| COMPARATIVE EXAMPLE | 95 | MMM | 0.040 | 1.25 | 0.48 | 0.007 | 0.0030 | 0.023 | 0.0021 | 0.05 |
| COMPARATIVE EXAMPLE | 96 | NNN | 0.060 | 2.55 | 1.90 | 0.007 | 0.0030 | 1.580 | 0.0021 | 0.13 |
| COMPARATIVE EXAMPLE | 97 | OOO | 0.060 | 1.60 | 1.90 | 0.007 | 0.0030 | 2.430 | 0.0021 | 0.13 |
| COMPARATIVE EXAMPLE | 98 | PPP | 0.031 | 0.47 | 1.25 | 0.012 | 0.0040 | 0.007 | 0.0024 | 0.04 |
| COMPARATIVE EXAMPLE | 99 | QQQ | 0.031 | 0.45 | 1.25 | 0.012 | 0.0040 | 0.004 | 0.0024 | 0.04 |
| COMPARATIVE EXAMPLE | 100 | RRR | 0.059 | 1.17 | 1.86 | 0.110 | 0.0035 | 0.021 | 0.0026 | 0.08 |
| COMPARATIVE EXAMPLE | 101 | SSS | 0.055 | 1.35 | 1.20 | 0.008 | 0.0010 | 0.020 | 0.0250 | 0.05 |
| COMPARATIVE EXAMPLE | 102 | TTT | 0.062 | 1.05 | 2.00 | 0.011 | 0.0040 | 0.029 | 0.0029 | 0.31 |
| COMPARATIVE EXAMPLE | 103 | UUU | 0.060 | 1.10 | 1.80 | 0.010 | 0.0010 | 0.020 | 0.0020 | 0.00 |
| COMPARATIVE EXAMPLE | 104 | VVV | 0.060 | 1.31 | 1.75 | 0.008 | 0.0030 | 0.025 | 0.0025 | 0.00 |
| COMPARATIVE EXAMPLE | 105 | WWW | 0.062 | 1.05 | 1.35 | 0.011 | 0.0040 | 0.029 | 0.0029 | 0.0008 |
| COMPARATIVE EXAMPLE | 106 | XXX | 0.060 | 1.10 | 1.80 | 0.010 | 0.0010 | 0.020 | 0.0020 | 0.00 |
| COMPARATIVE EXAMPLE | 107 | YYY | 0.060 | 1.31 | 1.75 | 0.008 | 0.0030 | 0.025 | 0.0025 | 0.00 |
| COMPARATIVE EXAMPLE | 108 | ZZZ | 0.060 | 1.25 | 1.90 | 0.007 | 0.0030 | 0.023 | 0.0021 | 0.13 |
| COMPARATIVE EXAMPLE | 109 | AAAA | 0.060 | 1.25 | 1.90 | 0.007 | 0.0030 | 0.023 | 0.0021 | 0.13 |
| COMPARATIVE EXAMPLE | 110 | BBBB | 0.060 | 1.25 | 1.90 | 0.007 | 0.0030 | 0.023 | 0.0021 | 0.13 |
| COMPARATIVE EXAMPLE | 111 | CCCC | 0.060 | 1.25 | 1.90 | 0.007 | 0.0030 | 0.023 | 0.0021 | 0.13 |
| COMPARATIVE EXAMPLE | 112 | DDDD | 0.060 | 1.25 | 1.90 | 0.007 | 0.0030 | 0.023 | 0.0021 | 0.13 |
| COMPARATIVE EXAMPLE | 113 | EEEE | 0.060 | 1.25 | 1.90 | 0.007 | 0.0030 | 0.023 | 0.0021 | 0.13 |
| COMPARATIVE EXAMPLE | 114 | FFFF | 0.060 | 1.25 | 1.90 | 0.007 | 0.0030 | 0.023 | 0.0021 | 0.13 |
| EXAMPLE | 115 | GGGG | 0.058 | 1.36 | 2.00 | 0.011 | 0.0045 | 0.027 | 0.0028 | 0.14 |
| EXAMPLE | 116 | HHHH | 0.065 | 1.09 | 1.91 | 0.006 | 0.0040 | 0.028 | 0.0029 | 0.13 |
| EXAMPLE | 117 | IIII | 0.057 | 1.05 | 1.86 | 0.008 | 0.0038 | 0.022 | 0.0020 | 0.12 |
| EXAMPLE | 118 | JJJJ | 0.068 | 1.13 | 1.80 | 0.005 | 0.0040 | 0.022 | 0.0025 | 0.14 |
| EXAMPLE | 119 | KKKK | 0.068 | 1.13 | 1.80 | 0.005 | 0.0040 | 0.022 | 0.0025 | 0.14 |
| EXAMPLE | 120 | LLLL | 0.057 | 1.05 | 1.86 | 0.008 | 0.0038 | 0.022 | 0.0020 | 0.12 |
| EXAMPLE | 121 | MMMM | 0.059 | 1.04 | 1.87 | 0.009 | 0.0040 | 0.024 | 0.0029 | 0.13 |

| | | STEEL | CHEMICAL COMPOSITION (unit: mass %) | | | | | |
|---|---|---|---|---|---|---|---|---|
| | | COMPOSITION | REM | Ca | X1 | X2 | Si + Al | OTHER ELEMENTS |
| EXAMPLE | 82 | EEE | 0.0090 | 0.0000 | 30.86 | ∞ | 1.12 | V = 0.12% |
| EXAMPLE | 83 | FFF | 0.0000 | 0.0060 | 24.00 | 0.00 | 1.34 | V = 0.13% |
| COMPARATIVE EXAMPLE | 84 | GGG | 0.0000 | 0.0000 | 0.00 | ∞ | 1.63 | V = 0.12% |
| COMPARATIVE EXAMPLE | 85 | HHH | 0.0039 | 0.0038 | 58.26 | 0.29 | 1.53 | — |
| COMPARATIVE EXAMPLE | 86 | JJJ | 0.0001 | 0.0001 | 9.92 | 0.29 | 1.53 | V = 0.1% |
| EXAMPLE | 87 | A | 0.0040 | 0.0038 | 48.66 | 0.30 | 1.27 | V = 0.015% |
| EXAMPLE | 89 | A | 0.0040 | 0.0038 | 48.66 | 0.30 | 1.27 | V = 0.015% |
| EXAMPLE | 90 | KKK | 0.0040 | 0.0035 | 29.19 | 0.33 | 1.28 | — |
| COMPARATIVE EXAMPLE | 91 | A | 0.0040 | 0.0038 | 48.66 | 0.30 | 1.27 | V = 0.015% |
| COMPARATIVE EXAMPLE | 92 | A | 0.0040 | 0.0038 | 48.66 | 0.30 | 1.27 | V = 0.015% |
| COMPARATIVE EXAMPLE | 93 | A | 0.0040 | 0.0038 | 48.66 | 0.30 | 1.27 | V = 0.015% |
| COMPARATIVE EXAMPLE | 94 | LLL | 0.0040 | 0.0038 | 48.66 | 0.30 | 1.27 | — |
| COMPARATIVE EXAMPLE | 95 | MMM | 0.0040 | 0.0038 | 30.88 | 0.30 | 1.27 | — |
| COMPARATIVE EXAMPLE | 96 | NNN | 0.0040 | 0.0038 | 48.66 | 0.30 | 4.13 | — |
| COMPARATIVE EXAMPLE | 97 | OOO | 0.0040 | 0.0038 | 48.66 | 0.30 | 4.03 | — |
| COMPARATIVE EXAMPLE | 98 | PPP | 0.0040 | 0.0037 | 21.20 | 0.31 | 0.48 | — |
| COMPARATIVE EXAMPLE | 99 | QQQ | 0.0040 | 0.0037 | 21.20 | 0.31 | 0.45 | — |
| COMPARATIVE EXAMPLE | 100 | RRR | 0.0055 | 0.0050 | 37.39 | 0.31 | 1.19 | — |
| COMPARATIVE EXAMPLE | 101 | SSS | 0.0025 | 0.0020 | 65.90 | 0.36 | 1.37 | — |
| COMPARATIVE EXAMPLE | 102 | TTT | 0.0000 | 0.0000 | 51.67 | ∞ | 1.08 | — |
| COMPARATIVE EXAMPLE | 103 | UUU | 0.0250 | 0.0000 | 85.71 | ∞ | 1.12 | — |
| COMPARATIVE EXAMPLE | 104 | VVV | 0.0000 | 0.0130 | 52.00 | 0.00 | 1.34 | — |
| COMPARATIVE EXAMPLE | 105 | WWW | 0.0000 | 0.0000 | 0.13 | ∞ | 1.08 | — |
| COMPARATIVE EXAMPLE | 106 | XXX | 0.00008 | 0.0000 | 0.27 | ∞ | 1.12 | — |
| COMPARATIVE EXAMPLE | 107 | YYY | 0.0000 | 0.00009 | 0.36 | 0.00 | 1.34 | — |
| COMPARATIVE EXAMPLE | 108 | ZZZ | 0.0040 | 0.0038 | 48.66 | 0.30 | 1.27 | Nb = 0.11% |
| COMPARATIVE EXAMPLE | 109 | AAAA | 0.0040 | 0.0038 | 48.66 | 0.30 | 1.27 | B = 0.0042% |
| COMPARATIVE EXAMPLE | 110 | BBBB | 0.0040 | 0.0038 | 48.66 | 0.30 | 1.27 | Cu = 1.1% |
| COMPARATIVE EXAMPLE | 111 | CCCC | 0.0040 | 0.0038 | 48.66 | 0.30 | 1.27 | Cr = 1.1% |
| COMPARATIVE EXAMPLE | 112 | DDDD | 0.0040 | 0.0038 | 48.66 | 0.30 | 1.27 | Mo = 1.1% |
| COMPARATIVE EXAMPLE | 113 | EEEE | 0.0040 | 0.0038 | 48.66 | 0.30 | 1.27 | Ni = 1.1% |
| COMPARATIVE EXAMPLE | 114 | FFFF | 0.0040 | 0.0038 | 48.66 | 0.30 | 1.27 | V = 0.22% |
| EXAMPLE | 115 | GGGG | 0.0040 | 0.0034 | 32.86 | 0.34 | 1.39 | Nb = 0.0008% |
| EXAMPLE | 116 | HHHH | 0.0040 | 0.0037 | 36.20 | 0.31 | 1.12 | B = 0.00009% |
| EXAMPLE | 117 | IIII | 0.0027 | 0.0025 | 31.38 | 0.31 | 1.07 | Cu = 0.0007%, Ni = 0.1% |
| EXAMPLE | 118 | JJJJ | 0.01800 | 0.0000 | 38.76 | ∞ | 1.15 | Cr = 0.0008%, Mo = 0.03% |
| EXAMPLE | 119 | KKKK | 0.0180 | 0.0000 | 38.76 | ∞ | 1.15 | Cr = 0.1%, Mo = 0.0008% |
| EXAMPLE | 120 | LLLL | 0.0027 | 0.0025 | 31.38 | 0.31 | 1.07 | Cu = 0.2%, N i= 0.0009% |
| EXAMPLE | 121 | MMMM | 0.0031 | 0.0024 | 31.52 | 0.37 | 1.06 | V = 0.0008% |

The underlined value in the table indicates out of the range of the present invention.

The X1 in the table indicates (Ti/48)/(S/32) + {(Ca/40)/(S/32) + (REM/140)/(S/32)} × 15.

The X2 in the table indicates (REM/140)/(Ca/40).

TABLE 5

| | | | | PRODUCTION CONDITIONS | | | | | | | |
|---|---|---|---|---|---|---|---|---|---|---|---|
| | | | Ar3 | USAGE OF | HEATING | FIRST ROUGH ROLLING PROCESS | | | SECOND ROUGH ROLLING PROCESS | | |
| | | STEEL COMPOSITION | TRANSFORMATION TEMPERATURE (° C.) | REFINING DESULFURIZING AGENT IN SECONDARY REFINING | PROCESS HEATING TEMPERATURE (° C.) | START TEMPERATURE (° C.) | FINISH TEMPERATURE (° C.) | REDUCTION (%) | START TEMPERATURE (° C.) | FINISH TEMPERATURE (° C.) | REDUCTION (%) |
| EXAMPLE | 1 | A | 746 | nonuse | 1200 | 1200 | 1151 | 65 | 1150 | 1072 | 21 |
| EXAMPLE | 2 | B | 754 | use | 1250 | 1250 | 1151 | 65 | 1150 | 1074 | 21 |
| EXAMPLE | 3 | C | 700 | nonuse | 1250 | 1250 | 1151 | 65 | 1150 | 1071 | 21 |
| EXAMPLE | 4 | D | 802 | use | 1250 | 1250 | 1151 | 65 | 1150 | 1077 | 21 |
| EXAMPLE | 5 | E | 760 | nonuse | 1250 | 1250 | 1151 | 65 | 1150 | 1075 | 21 |
| EXAMPLE | 6 | F | 736 | use | 1250 | 1250 | 1151 | 65 | 1150 | 1071 | 21 |
| EXAMPLE | 7 | G | 731 | nonuse | 1250 | 1250 | 1151 | 65 | 1150 | 1072 | 21 |
| EXAMPLE | 8 | H | 731 | nonuse | 1250 | 1250 | 1151 | 65 | 1150 | 1074 | 21 |
| EXAMPLE | 9 | I | 743 | nonuse | 1250 | 1250 | 1151 | 65 | 1150 | 1078 | 21 |
| EXAMPLE | 10 | J | 747 | nonuse | 1250 | 1250 | 1151 | 65 | 1150 | 1072 | 21 |
| COMPARATIVE EXAMPLE | 11 | K | 753 | nonuse | 1250 | 1250 | 1151 | 65 | 1150 | 1074 | 21 |
| COMPARATIVE EXAMPLE | 12 | L | 765 | nonuse | 1250 | 1250 | 1151 | 65 | 1150 | 1074 | 21 |
| EXAMPLE | 13 | M | 740 | nonuse | 1250 | 1250 | 1151 | 65 | 1150 | 1080 | 21 |
| EXAMPLE | 14 | N | 745 | nonuse | 1250 | 1250 | 1151 | 65 | 1150 | 1073 | 21 |
| EXAMPLE | 15 | O | 760 | nonuse | 1250 | 1250 | 1151 | 65 | 1150 | 1072 | 21 |
| EXAMPLE | 16 | P | 748 | nonuse | 1250 | 1250 | 1151 | 65 | 1150 | 1071 | 21 |
| EXAMPLE | 17 | Q | 752 | nonuse | 1250 | 1250 | 1151 | 65 | 1150 | 1078 | 21 |
| EXAMPLE | 18 | R | 748 | nonuse | 1250 | 1250 | 1151 | 65 | 1150 | 1073 | 21 |
| EXAMPLE | 19 | S | 746 | nonuse | 1250 | 1250 | 1151 | 65 | 1150 | 1079 | 21 |
| EXAMPLE | 20 | T | 752 | nonuse | 1250 | 1250 | 1151 | 65 | 1150 | 1078 | 21 |

| | | | PRODUCTION CONDITIONS | | | | | | | | |
|---|---|---|---|---|---|---|---|---|---|---|---|
| | | | FINISH ROLLING PROCESS | | FIRST COOLING PROCESS | SECOND COOLING PROCESS | | | | THIRD COOLING PROCESS | |
| | | STEEL COMPOSITION | START TEMPERATURE (° C.) | FINISH TEMPERATURE (° C.) | COOLING RATE (° C./sec.) | COOLING RATE (° C./sec.) | START COOLING TEMPERATURE (° C.) | FINISH COOLING TEMPERATURE (° C.) | COOLING TIME (sec.) | COOLING RATE (° C./sec.) | FINISH COOLING TEMPERATURE (° C.) |
| EXAMPLE | 1 | A | 1012 | 887 | 29 | 10 | 750 | 670 | 8 | 29 | 25 |
| EXAMPLE | 2 | B | 1014 | 889 | 30 | 10 | 730 | 650 | 8 | 30 | 25 |
| EXAMPLE | 3 | C | 1011 | 895 | 33 | 10 | 720 | 650 | 7 | 33 | 25 |
| EXAMPLE | 4 | D | 1017 | 907 | 27 | 10 | 730 | 650 | 8 | 27 | 25 |
| EXAMPLE | 5 | E | 1015 | 888 | 32 | 10 | 700 | 650 | 5 | 32 | 25 |
| EXAMPLE | 6 | F | 1011 | 893 | 35 | 10 | 750 | 700 | 5 | 35 | 25 |
| EXAMPLE | 7 | G | 1012 | 891 | 31 | 10 | 750 | 690 | 6 | 31 | 25 |
| EXAMPLE | 8 | H | 1014 | 891 | 31 | 10 | 750 | 650 | 10 | 31 | 25 |
| EXAMPLE | 9 | I | 1018 | 892 | 27 | 10 | 750 | 670 | 8 | 27 | 25 |
| EXAMPLE | 10 | J | 1012 | 887 | 30 | 10 | 750 | 670 | 8 | 30 | 25 |
| COMPARATIVE EXAMPLE | 11 | K | 1014 | 892 | 26 | 10 | 750 | 670 | 8 | 26 | 25 |
| COMPARATIVE EXAMPLE | 12 | L | 1014 | 892 | 25 | 10 | 750 | 670 | 8 | 25 | 25 |
| EXAMPLE | 13 | M | 1020 | 892 | 30 | 10 | 750 | 670 | 8 | 30 | 25 |
| EXAMPLE | 14 | N | 1013 | 892 | 31 | 5 | 700 | 670 | 6 | 31 | 25 |
| EXAMPLE | 15 | O | 1012 | 892 | 28 | 10 | 750 | 670 | 8 | 28 | 25 |
| EXAMPLE | 16 | P | 1011 | 891 | 31 | 10 | 750 | 670 | 8 | 31 | 25 |
| EXAMPLE | 17 | Q | 1018 | 891 | 34 | 10 | 750 | 670 | 8 | 34 | 25 |
| EXAMPLE | 18 | R | 1013 | 890 | 30 | 10 | 750 | 670 | 8 | 30 | 25 |
| EXAMPLE | 19 | S | 1019 | 891 | 33 | 10 | 750 | 670 | 8 | 33 | 25 |
| EXAMPLE | 20 | T | 1018 | 893 | 29 | 10 | 750 | 670 | 8 | 29 | 25 |

TABLE 5-continued

| | | | | PRODUCTION CONDITIONS | | | | | | | |
|---|---|---|---|---|---|---|---|---|---|---|---|
| | | | Ar3 | USAGE OF | HEATING | FIRST ROUGH ROLLING PROCESS | | | SECOND ROUGH ROLLING PROCESS | | |
| | | STEEL COMPOSITION | TRANSFORMATION TEMPERATURE (° C.) | REFINING DESULFURIZING AGENT IN SECONDARY REFINING | PROCESS HEATING TEMPERATURE (° C.) | START TEMPERATURE (° C.) | FINISH TEMPERATURE (° C.) | REDUCTION (%) | START TEMPERATURE (° C.) | FINISH TEMPERATURE (° C.) | REDUCTION (%) |
| EXAMPLE | 21 | U | 737 | nonuse | 1250 | 1250 | 1151 | 65 | 1150 | 1070 | 21 |
| EXAMPLE | 22 | V | 743 | nonuse | 1250 | 1250 | 1151 | 65 | 1150 | 1077 | 21 |
| EXAMPLE | 23 | W | 747 | nonuse | 1250 | 1250 | 1151 | 65 | 1150 | 1072 | 21 |
| EXAMPLE | 24 | X | 747 | nonuse | 1250 | 1260 | 1151 | 65 | 1150 | 1079 | 21 |
| EXAMPLE | 25 | Y | 747 | nonuse | 1250 | 1250 | 1151 | 65 | 1150 | 1072 | 21 |
| COMPARATIVE EXAMPLE | 26 | Z | 746 | nonuse | 1250 | 1250 | 1151 | 65 | 1150 | 1073 | 21 |
| COMPARATIVE EXAMPLE | 27 | AA | 761 | nonuse | 1250 | 1250 | 1151 | 65 | 1150 | 1070 | 21 |
| COMPARATIVE EXAMPLE | 28 | BB | 654 | nonuse | 1250 | 1250 | 1151 | 65 | 1150 | 1070 | 21 |
| EXAMPLE | 29 | A | 746 | nonuse | 1170 | 1170 | 1151 | 65 | 1120 | 1078 | 21 |
| COMPARATIVE EXAMPLE | 30 | A | 746 | nonuse | 1250 | 1250 | 1151 | 75 | 1150 | 1079 | 11 |
| EXAMPLE | 31 | A | 746 | nonuse | 1250 | 1250 | 1151 | 70 | 1150 | 1072 | 16 |
| COMPARATIVE EXAMPLE | 32 | A | 746 | nonuse | 1250 | 1250 | 1151 | 58 | 1150 | 1080 | 28 |
| EXAMPLE | 33 | A | 746 | nonuse | 1250 | 1250 | 1151 | 61 | 1150 | 1072 | 25 |
| EXAMPLE | 34 | A | 746 | nonuse | 1248 | 1248 | 1151 | 67 | 1150 | 1076 | 10 |
| COMPARATIVE EXAMPLE | 35 | A | 746 | nonuse | 1249 | 1249 | 1151 | 70 | 1150 | 1072 | 5 |
| COMPARATIVE EXAMPLE | 36 | A | 746 | nonuse | 1250 | 1250 | 1151 | 65 | 1150 | 1070 | 21 |
| COMPARATIVE EXAMPLE | 37 | A | 746 | nonuse | 1250 | 1250 | 1151 | 65 | 1150 | 1074 | 21 |
| COMPARATIVE EXAMPLE | 38 | A | 746 | nonuse | 1250 | 1250 | 1151 | 65 | 1150 | 1070 | 21 |
| COMPARATIVE EXAMPLE | 39 | A | 746 | nonuse | 1250 | 1250 | 1151 | 65 | 1150 | 1075 | 21 |
| COMPARATIVE EXAMPLE | 40 | A | 746 | nonuse | 1250 | 1250 | 1151 | 65 | 1150 | 1075 | 21 |
| COMPARATIVE EXAMPLE | 41 | A | 746 | nonuse | 1250 | 1250 | 1151 | 65 | 1150 | 1075 | 21 |

| | | | PRODUCTION CONDITIONS | | | | | | | | |
|---|---|---|---|---|---|---|---|---|---|---|---|
| | | | FINISH ROLLING PROCESS | | FIRST | SECOND COOLING PROCESS | | | | THIRD COOLING PROCESS | |
| | | STEEL COMPOSITION | START TEMPERATURE (° C.) | FINISH TEMPERATURE (° C.) | COOLING PROCESS COOLING RATE (° C./sec.) | COOLING RATE (° C./sec.) | COOLING START TEMPERATURE (° C.) | COOLING FINISH TEMPERATURE (° C.) | COOLING TIME (sec.) | COOLING RATE (° C./sec.) | COOLING FINISH TEMPERATURE (° C.) |
| EXAMPLE | 21 | U | 1010 | 894 | 30 | 10 | 750 | 670 | 8 | 30 | 25 |
| EXAMPLE | 22 | V | 1017 | 892 | 32 | 10 | 750 | 670 | 8 | 32 | 25 |
| EXAMPLE | 23 | W | 1012 | 887 | 27 | 10 | 750 | 670 | 8 | 27 | 25 |
| EXAMPLE | 24 | X | 1019 | 889 | 28 | 10 | 750 | 670 | 8 | 28 | 25 |
| EXAMPLE | 25 | Y | 1012 | 893 | 33 | 10 | 750 | 670 | 8 | 33 | 25 |
| COMPARATIVE EXAMPLE | 26 | Z | 1013 | 886 | 32 | 10 | 750 | 670 | 8 | 32 | 25 |
| COMPARATIVE EXAMPLE | 27 | AA | 1010 | 887 | 25 | 10 | 750 | 670 | 8 | 25 | 25 |
| COMPARATIVE EXAMPLE | 28 | BB | 1010 | 845 | 28 | 10 | 750 | 670 | 8 | 28 | 25 |
| EXAMPLE | 29 | A | 1018 | 889 | 26 | 10 | 750 | 670 | 8 | 26 | 25 |
| COMPARATIVE EXAMPLE | 30 | A | 1019 | 891 | 27 | 10 | 750 | 670 | 8 | 27 | 25 |
| EXAMPLE | 31 | A | 1012 | 885 | 35 | 10 | 750 | 670 | 8 | 35 | 25 |
| COMPARATIVE EXAMPLE | 32 | A | 1020 | 888 | 34 | 10 | 750 | 670 | 8 | 34 | 25 |
| EXAMPLE | 33 | A | 1012 | 892 | 26 | 10 | 750 | 670 | 8 | 26 | 25 |
| EXAMPLE | 34 | A | 1016 | 886 | 27 | 10 | 750 | 670 | 8 | 27 | 25 |
| COMPARATIVE EXAMPLE | 35 | A | 1012 | 889 | 27 | 10 | 750 | 670 | 8 | 27 | 25 |

TABLE 5-continued

| | | | | | | | | | | | |
|---|---|---|---|---|---|---|---|---|---|---|---|
| COMPARATIVE EXAMPLE | 36 | A | 960 | 880 | 30 | 10 | 750 | 670 | 8 | 30 | 25 |
| COMPARATIVE EXAMPLE | 37 | A | 1014 | 800 | 34 | 10 | 750 | 670 | 8 | 34 | 25 |
| COMPARATIVE EXAMPLE | 38 | A | 1010 | 970 | 26 | 10 | 750 | 670 | 8 | 26 | 25 |
| COMPARATIVE EXAMPLE | 39 | A | 1015 | 880 | 30 | 10 | 750 | 670 | 8 | 30 | 25 |
| COMPARATIVE EXAMPLE | 40 | A | 1015 | 880 | 30 | 10 | 750 | 670 | 8 | 30 | 400 |
| COMPARATIVE EXAMPLE | 41 | A | 1015 | 880 | 30 | 10 | 750 | 670 | 8 | 15 | 25 |

TABLE 6

| | | STEEL COMPOSITION | Ar3 TRANSFORMATION TEMPERATURE (° C.) | PRODUCTION CONDITIONS: USAGE OF REFINING DESULFURIZING AGENT IN SECONDARY REFINING | HEATING PROCESS: HEATING TEMPERATURE (° C.) | FIRST ROUGH ROLLING PROCESS: START TEMPERATURE (° C.) | FIRST ROUGH ROLLING PROCESS: FINISH TEMPERATURE (° C.) | FIRST ROUGH ROLLING PROCESS: REDUCTION (%) | SECOND ROUGH ROLLING PROCESS: START TEMPERATURE (° C.) | SECOND ROUGH ROLLING PROCESS: FINISH TEMPERATURE (° C.) | SECOND ROUGH ROLLING PROCESS: REDUCTION (%) |
|---|---|---|---|---|---|---|---|---|---|---|---|
| EXAMPLE | 42 | CC | 798 | nonuse | 1250 | 1250 | 1151 | 65 | 1150 | 1072 | 21 |
| EXAMPLE | 43 | DD | 798 | use | 1250 | 1250 | 1151 | 65 | 1150 | 1074 | 21 |
| EXAMPLE | 44 | EE | 769 | nonuse | 1250 | 1250 | 1151 | 65 | 1150 | 1071 | 21 |
| EXAMPLE | 45 | FF | 847 | use | 1250 | 1250 | 1151 | 65 | 1150 | 1077 | 21 |
| EXAMPLE | 46 | GG | 805 | nonuse | 1250 | 1250 | 1151 | 65 | 1150 | 1075 | 21 |
| EXAMPLE | 47 | HH | 776 | use | 1250 | 1250 | 1151 | 65 | 1150 | 1071 | 21 |
| EXAMPLE | 48 | II | 731 | nonuse | 1250 | 1250 | 1151 | 65 | 1150 | 1072 | 21 |
| EXAMPLE | 49 | JJ | 731 | nonuse | 1250 | 1250 | 1151 | 65 | 1150 | 1074 | 21 |
| EXAMPLE | 50 | KK | 787 | use | 1250 | 1250 | 1151 | 65 | 1150 | 1072 | 21 |
| COMPARATIVE EXAMPLE | 51 | LL | 801 | nonuse | 1250 | 1250 | 1151 | 65 | 1150 | 1072 | 21 |
| EXAMPLE | 52 | MM | 787 | nonuse | 1250 | 1250 | 1151 | 65 | 1150 | 1078 | 21 |
| EXAMPLE | 53 | NN | 796 | nonuse | 1250 | 1250 | 1151 | 65 | 1150 | 1074 | 21 |
| EXAMPLE | 54 | OO | 784 | nonuse | 1250 | 1250 | 1151 | 65 | 1150 | 1080 | 21 |
| EXAMPLE | 55 | PP | 788 | nonuse | 1250 | 1250 | 1151 | 65 | 1150 | 1073 | 21 |
| EXAMPLE | 56 | QQ | 820 | nonuse | 1250 | 1250 | 1151 | 65 | 1150 | 1072 | 21 |
| EXAMPLE | 57 | RR | 793 | nonuse | 1250 | 1250 | 1151 | 65 | 1150 | 1071 | 21 |
| EXAMPLE | 58 | SS | 796 | nonuse | 1250 | 1250 | 1151 | 65 | 1150 | 1078 | 21 |
| EXAMPLE | 59 | TT | 792 | nonuse | 1250 | 1250 | 1151 | 65 | 1150 | 1073 | 21 |
| EXAMPLE | 60 | UU | 790 | nonuse | 1250 | 1250 | 1151 | 65 | 1150 | 1079 | 21 |
| EXAMPLE | 61 | VV | 797 | nonuse | 1250 | 1250 | 1151 | 65 | 1150 | 1078 | 21 |

| | | STEEL COMPOSITION | PRODUCTION CONDITIONS: FINISH ROLLING PROCESS: START TEMPERATURE (° C.) | FINISH ROLLING PROCESS: FINISH TEMPERATURE (° C.) | FIRST COOLING PROCESS: COOLING RATE (° C./sec.) | SECOND COOLING PROCESS: COOLING RATE (° C./sec.) | SECOND COOLING PROCESS: COOLING START TEMPERATURE (° C.) | SECOND COOLING PROCESS: COOLING FINISH TEMPERATURE (° C.) | SECOND COOLING PROCESS: COOLING TIME (sec.) | THIRD COOLING PROCESS: COOLING RATE (° C./sec.) | THIRD COOLING PROCESS: COOLING FINISH TEMPERATURE (° C.) |
|---|---|---|---|---|---|---|---|---|---|---|---|
| EXAMPLE | 42 | CC | 1012 | 887 | 29 | 10 | 750 | 670 | 8 | 29 | 25 |
| EXAMPLE | 43 | DD | 1014 | 889 | 30 | 10 | 750 | 670 | 8 | 30 | 25 |
| EXAMPLE | 44 | EE | 1011 | 895 | 33 | 10 | 750 | 670 | 8 | 33 | 25 |
| EXAMPLE | 45 | FF | 1017 | 907 | 27 | 10 | 750 | 670 | 8 | 27 | 25 |
| EXAMPLE | 46 | GG | 1015 | 888 | 32 | 10 | 750 | 670 | 8 | 32 | 25 |
| EXAMPLE | 47 | HH | 1011 | 893 | 35 | 10 | 750 | 670 | 8 | 35 | 25 |
| EXAMPLE | 48 | II | 1012 | 891 | 31 | 10 | 750 | 670 | 8 | 31 | 25 |
| EXAMPLE | 49 | JJ | 1014 | 891 | 31 | 10 | 750 | 670 | 8 | 31 | 25 |

TABLE 6-continued

| | | | | | | | | | | | |
|---|---|---|---|---|---|---|---|---|---|---|---|
| EXAMPLE | 50 | KK | 1012 | 890 | 30 | 10 | 750 | 670 | 8 | 30 | 25 |
| COMPARATIVE EXAMPLE | 51 | LL | 1012 | 890 | 30 | 10 | 750 | 670 | 8 | 30 | 25 |
| EXAMPLE | 52 | MM | 1018 | 892 | 27 | 10 | 750 | 670 | 8 | 27 | 25 |
| EXAMPLE | 53 | NN | 1014 | 892 | 26 | 10 | 750 | 670 | 8 | 26 | 25 |
| EXAMPLE | 54 | OO | 1020 | 892 | 30 | 10 | 750 | 670 | 8 | 30 | 25 |
| EXAMPLE | 55 | PP | 1013 | 892 | 31 | 10 | 750 | 670 | 8 | 31 | 25 |
| EXAMPLE | 56 | QQ | 1012 | 892 | 28 | 10 | 750 | 670 | 8 | 28 | 25 |
| EXAMPLE | 57 | RR | 1011 | 891 | 31 | 10 | 750 | 670 | 8 | 31 | 25 |
| EXAMPLE | 58 | SS | 1018 | 891 | 34 | 10 | 750 | 670 | 8 | 34 | 25 |
| EXAMPLE | 59 | TT | 1013 | 890 | 30 | 10 | 750 | 670 | 8 | 30 | 25 |
| EXAMPLE | 60 | UU | 1019 | 891 | 33 | 10 | 750 | 670 | 8 | 33 | 25 |
| EXAMPLE | 61 | VV | 1018 | 893 | 29 | 10 | 750 | 670 | 8 | 29 | 25 |

| | | | | PRODUCTION CONDITIONS | | | | | | | |
|---|---|---|---|---|---|---|---|---|---|---|---|
| | | | | | | FIRST ROUGH ROLLING PROCESS | | | SECOND ROUGH ROLLING PROCESS | | |
| | | STEEL COMPOSITION | Ar3 TRANSFORMATION TEMPERATURE (° C.) | USAGE OF REFINING DESULFURIZING AGENT IN SECONDARY REFINING | HEATING PROCESS HEATING TEMPERATURE (° C.) | START TEMPERATURE (° C.) | FINISH TEMPERATURE (° C.) | REDUCTION (%) | START TEMPERATURE (° C.) | FINISH TEMPERATURE (° C.) | REDUCTION (%) |
| EXAMPLE | 62 | WW | 778 | nonuse | 1250 | 1250 | 1151 | 65 | 1150 | 1070 | 21 |
| EXAMPLE | 63 | XX | 788 | nonuse | 1250 | 1250 | 1151 | 65 | 1150 | 1077 | 21 |
| EXAMPLE | 64 | YY | 791 | nonuse | 1250 | 1250 | 1151 | 65 | 1150 | 1072 | 21 |
| EXAMPLE | 65 | ZZ | 791 | nonuse | 1250 | 1250 | 1151 | 65 | 1150 | 1079 | 21 |
| EXAMPLE | 66 | AAA | 791 | nonuse | 1250 | 1250 | 1151 | 65 | 1150 | 1072 | 21 |
| COMPARATIVE EXAMPLE | 67 | BBB | 790 | nonuse | 1250 | 1250 | 1151 | 65 | 1150 | 1073 | 21 |
| COMPARATIVE EXAMPLE | 68 | CCC | 805 | nonuse | 1250 | 1250 | 1151 | 65 | 1150 | 1070 | 21 |
| COMPARATIVE EXAMPLE | 69 | DDD | 654 | nonuse | 1250 | 1250 | 1151 | 65 | 1150 | 1070 | 21 |
| COMPARATIVE EXAMPLE | 70 | CC | 798 | nonuse | 1170 | 1170 | 1151 | 65 | 1120 | 1078 | 21 |
| COMPARATIVE EXAMPLE | 71 | CC | 798 | nonuse | 1250 | 1250 | 1151 | 75 | 1150 | 1079 | 11 |
| EXAMPLE | 72 | CC | 798 | nonuse | 1250 | 1250 | 1151 | 70 | 1150 | 1072 | 16 |
| COMPARATIVE EXAMPLE | 73 | CC | 798 | nonuse | 1250 | 1250 | 1151 | 58 | 1150 | 1080 | 28 |
| EXAMPLE | 74 | CC | 798 | nonuse | 1250 | 1250 | 1151 | 61 | 1150 | 1072 | 25 |
| EXAMPLE | 75 | CC | 798 | nonuse | 1248 | 1248 | 1151 | 67 | 1150 | 1076 | 10 |
| COMPARATIVE EXAMPLE | 76 | CC | 798 | nonuse | 1249 | 1249 | 1151 | 70 | 1150 | 1072 | 8 |
| COMPARATIVE EXAMPLE | 77 | CC | 798 | nonuse | 1250 | 1250 | 1151 | 65 | 1150 | 1070 | 21 |
| COMPARATIVE EXAMPLE | 78 | CC | 798 | nonuse | 1250 | 1250 | 1151 | 65 | 1150 | 1074 | 21 |
| COMPARATIVE EXAMPLE | 79 | CC | 798 | nonuse | 1250 | 1250 | 1151 | 65 | 1150 | 1070 | 21 |
| COMPARATIVE EXAMPLE | 80 | CC | 798 | nonuse | 1250 | 1250 | 1151 | 65 | 1150 | 1075 | 21 |

TABLE 6-continued

| | | | | | | | | | | | |
|---|---|---|---|---|---|---|---|---|---|---|---|
| COMPARATIVE EXAMPLE | 81 | CC | 798 | nonuse | 1250 | 1250 | 1151 | 65 | 1150 | 1075 | 21 |

| | | | PRODUCTION CONDITIONS | | | | | | | | |
|---|---|---|---|---|---|---|---|---|---|---|---|
| | | | FINISH ROLLING PROCESS | | FIRST COOLING PROCESS | SECOND COOLING PROCESS | | | | THIRD COOLING PROCESS | |
| | | | | | | | COOLING | COOLING | | | COOLING |
| | | STEEL COMPOSITION | START TEMPERATURE (° C.) | FINISH TEMPERATURE (° C.) | COOLING RATE (° C./sec.) | COOLING RATE (° C./sec.) | START TEMPERATURE (° C.) | FINISH TEMPERATURE (° C.) | COOLING TIME (sec.) | COOLING RATE (° C./sec.) | FINISH TEMPERATURE (° C.) |
| EXAMPLE | 62 | WW | 1010 | 894 | 30 | 10 | 750 | 670 | 8 | 30 | 25 |
| EXAMPLE | 63 | XX | 1017 | 892 | 32 | 10 | 750 | 670 | 8 | 32 | 25 |
| EXAMPLE | 64 | YY | 1012 | 887 | 27 | 10 | 750 | 670 | 8 | 27 | 25 |
| EXAMPLE | 65 | ZZ | 1019 | 889 | 28 | 10 | 750 | 670 | 8 | 28 | 25 |
| EXAMPLE | 66 | AAA | 1012 | 893 | 33 | 10 | 750 | 670 | 8 | 33 | 25 |
| COMPARATIVE EXAMPLE | 67 | BBB | 1013 | 886 | 32 | 10 | 750 | 670 | 8 | 32 | 25 |
| COMPARATIVE EXAMPLE | 68 | CCC | 1010 | 887 | 25 | 10 | 750 | 670 | 8 | 25 | 25 |
| COMPARATIVE EXAMPLE | 69 | DDD | 1010 | 850 | 28 | 10 | 750 | 670 | 8 | 28 | 25 |
| COMPARATIVE EXAMPLE | 70 | CC | 1018 | 889 | 26 | 10 | 750 | 670 | 8 | 26 | 25 |
| COMPARATIVE EXAMPLE | 71 | CC | 1019 | 891 | 27 | 10 | 750 | 670 | 8 | 27 | 25 |
| EXAMPLE | 72 | CC | 1012 | 885 | 35 | 10 | 750 | 670 | 8 | 35 | 25 |
| COMPARATIVE EXAMPLE | 73 | CC | 1020 | 888 | 34 | 10 | 750 | 670 | 8 | 34 | 25 |
| EXAMPLE | 74 | CC | 1012 | 892 | 26 | 10 | 750 | 670 | 8 | 26 | 25 |
| EXAMPLE | 75 | CC | 1016 | 886 | 27 | 10 | 750 | 670 | 8 | 27 | 25 |
| COMPARATIVE EXAMPLE | 76 | CC | 1012 | 889 | 27 | 10 | 750 | 670 | 8 | 27 | 25 |
| COMPARATIVE EXAMPLE | 77 | CC | 960 | 880 | 30 | 10 | 750 | 670 | 8 | 30 | 25 |
| COMPARATIVE EXAMPLE | 78 | CC | 1014 | 820 | 34 | 10 | 750 | 670 | 8 | 34 | 25 |
| COMPARATIVE EXAMPLE | 79 | CC | 1010 | 1015 | 26 | 10 | 750 | 670 | 8 | 26 | 25 |
| COMPARATIVE EXAMPLE | 80 | CC | 1015 | 880 | 25 | 10 | 750 | 670 | 8 | 17 | 25 |
| COMPARATIVE EXAMPLE | 81 | CC | 1015 | 880 | 30 | 10 | 750 | 670 | 8 | 30 | 400 |

TABLE 7

| | | | | PRODUCTION CONDITIONS | | | | | | | | |
|---|---|---|---|---|---|---|---|---|---|---|---|---|
| | | | Ar3 | USAGE OF REFINING DESULFURIZING | HEATING PROCESS | FIRST ROUGH ROLLING PROCESS | | | SECOND ROUGH ROLLING PROCESS | | |
| | | STEEL COMPOSITION | TRANSFORMATION TEMPERATURE (° C.) | AGENT IN SECONDARY REFINING | HEATING TEMPERATURE (° C.) | START TEMPERATURE (° C.) | FINISH TEMPERATURE (° C.) | REDUCTION (%) | START TEMPERATURE (° C.) | FINISH TEMPERATURE (° C.) | RE-DUCTION (%) |
| EXAMPLE | 82 | EEE | 749 | nonuse | 1200 | 1200 | 1151 | 65 | 1150 | 1072 | 21 |
| EXAMPLE | 83 | FFF | 758 | nonuse | 1200 | 1200 | 1151 | 65 | 1150 | 1072 | 21 |
| COMPARATIVE EXAMPLE | 84 | GGG | 848 | nonuse | 1200 | 1200 | 1151 | 65 | 1150 | 1072 | 21 |
| COMPARATIVE EXAMPLE | 85 | HHH | 793 | nonuse | 1200 | 1200 | 1151 | 65 | 1150 | 1072 | 21 |
| COMPARATIVE EXAMPLE | 86 | JJJ | 758 | nonuse | 1200 | 1200 | 1151 | 65 | 1150 | 1072 | 21 |
| EXAMPLE | 87 | A | 746 | nonuse | 1200 | 1200 | 1151 | 65 | 1150 | 1072 | 13 |
| EXAMPLE | 89 | A | 746 | nonuse | 1200 | 1200 | 1151 | 65 | 1150 | 1072 | 21 |
| EXAMPLE | 90 | KKK | 743 | nonuse | 1200 | 1200 | 1151 | 65 | 1150 | 1072 | 21 |
| COMPARATIVE EXAMPLE | 91 | A | 746 | nonuse | 1200 | 1200 | 1151 | 65 | 1150 | 1072 | 21 |
| COMPARATIVE EXAMPLE | 92 | A | 746 | nonuse | 1200 | 1200 | 1151 | 65 | 1150 | 1072 | 21 |
| COMPARATIVE EXAMPLE | 93 | A | 746 | nonuse | 1200 | 1200 | 1151 | 65 | 1150 | 1072 | 21 |
| COMPARATIVE EXAMPLE | 94 | LLL | 726 | nonuse | 1200 | 1200 | 1151 | 65 | 1150 | 1072 | 21 |
| COMPARATIVE EXAMPLE | 95 | MMM | 851 | nonuse | 1250 | 1250 | 1151 | 70 | 1150 | 1072 | 16 |
| COMPARATIVE EXAMPLE | 96 | NNN | 779 | nonuse | 1248 | 1248 | 1151 | 67 | 1150 | 1076 | 10 |
| COMPARATIVE EXAMPLE | 97 | OOO | 755 | nonuse | 1248 | 1248 | 1151 | 67 | 1150 | 1076 | 10 |
| COMPARATIVE EXAMPLE | 98 | PPP | 782 | nonuse | 1250 | 1250 | 1151 | 65 | 1150 | 1074 | 21 |
| COMPARATIVE EXAMPLE | 99 | QQQ | 782 | nonuse | 1250 | 1250 | 1151 | 65 | 1150 | 1074 | 21 |
| COMPARATIVE EXAMPLE | 100 | RRR | 747 | nonuse | 1250 | 1250 | 1151 | 65 | 1150 | 1072 | 21 |
| COMPARATIVE EXAMPLE | 101 | SSS | 798 | use | 1250 | 1250 | 1151 | 65 | 1150 | 1074 | 21 |

TABLE 7-continued

| | | | PRODUCTION CONDITIONS | | | | | | | | |
|---|---|---|---|---|---|---|---|---|---|---|---|
| | | | FINISH ROLLING PROCESS | | FIRST COOLING PROCESS | SECOND COOLING PROCESS | | | | THIRD COOLING PROCESS | |
| | | STEEL COMPOSITION | START TEMPERATURE (° C.) | FINISH TEMPERATURE (° C.) | COOLING RATE (° C./sec.) | COOLING RATE (° C./sec.) | COOLING START TEMPERATURE (° C.) | COOLING FINISH TEMPERATURE (° C.) | COOLING TIME (sec.) | COOLING RATE (° C./sec.) | COOLING FINISH TEMPERATURE (° C.) |
| EXAMPLE | 82 | EEE | 1012 | 887 | 29 | 10 | 750 | 670 | 8 | 29 | 25 |
| EXAMPLE | 83 | FFF | 1012 | 887 | 29 | 10 | 750 | 670 | 8 | 29 | 25 |
| COMPARATIVE EXAMPLE | 84 | GGG | 1012 | 910 | 29 | 10 | 750 | 670 | 8 | 29 | 25 |
| COMPARATIVE EXAMPLE | 85 | HHH | 1012 | 887 | 29 | 25 | 750 | 670 | 3.2 | 29 | 25 |
| COMPARATIVE EXAMPLE | 86 | JJJ | 1012 | 887 | 29 | 10 | 750 | 670 | 8 | 29 | 25 |
| EXAMPLE | 87 | A | 1012 | 911 | 25 | 10 | 750 | 670 | 8 | 29 | 25 |
| EXAMPLE | 89 | A | 1012 | 887 | 29 | 8 | 730 | 650 | 10 | 21 | 100 |
| EXAMPLE | 90 | KKK | 1012 | 927 | 29 | 10 | 750 | 670 | 8 | 29 | 25 |
| COMPARATIVE EXAMPLE | 91 | A | 1012 | 887 | 29 | 10 | 830 | 670 | 8 | 29 | 25 |
| COMPARATIVE EXAMPLE | 92 | A | 1012 | 887 | 29 | 6 | 750 | 751 | 15 | 29 | 25 |
| COMPARATIVE EXAMPLE | 93 | A | 1012 | 887 | 29 | 14 | 740 | 660 | 0.7 | 29 | 25 |
| COMPARATIVE EXAMPLE | 94 | LLL | 1012 | 887 | 29 | 10 | 750 | 730 | 8 | 29 | 25 |
| COMPARATIVE EXAMPLE | 95 | MMM | 1012 | 915 | 35 | 10 | 750 | 670 | 8 | 35 | 25 |
| COMPARATIVE EXAMPLE | 96 | NNN | 1016 | 886 | 27 | 10 | 750 | 670 | 8 | 27 | 25 |
| COMPARATIVE EXAMPLE | 97 | OOO | 1016 | 886 | 27 | 10 | 750 | 670 | 8 | 27 | 25 |
| COMPARATIVE EXAMPLE | 98 | PPP | 1014 | 892 | 26 | 10 | 750 | 670 | 8 | 26 | 25 |
| COMPARATIVE EXAMPLE | 99 | QQQ | 1014 | 892 | 26 | 10 | 750 | 670 | 8 | 26 | 25 |
| COMPARATIVE EXAMPLE | 100 | RRR | 1012 | 887 | 30 | 10 | 750 | 670 | 8 | 30 | 25 |
| COMPARATIVE EXAMPLE | 101 | SSS | 1014 | 889 | 30 | 10 | 750 | 670 | 8 | 30 | 25 |

| | | | | PRODUCTION CONDITIONS | | | | | | | |
|---|---|---|---|---|---|---|---|---|---|---|---|
| | | | | | | FIRST ROUGH ROLLING PROCESS | | | SECOND ROUGH ROLLING PROCESS | | |
| | | STEEL COMPOSITION | Ar3 TRANSFORMATION TEMPERATURE (° C.) | USAGE OF REFINING DESULFURIZING AGENT IN SECONDARY REFINING | HEATING PROCESS HEATING TEMPERATURE (° C.) | START TEMPERATURE (° C.) | FINISH TEMPERATURE (° C.) | REDUCTION (%) | START TEMPERATURE (° C.) | FINISH TEMPERATURE (° C.) | RE-DUCTION (%) |
| COMPARATIVE EXAMPLE | 102 | TTT | 734 | nonuse | 1250 | 1250 | 1151 | 65 | 1150 | 1071 | 21 |
| COMPARATIVE EXAMPLE | 103 | UUU | 749 | nonuse | 1200 | 1200 | 1151 | 65 | 1150 | 1072 | 21 |

TABLE 7-continued

| | | | | | | | | | | | |
|---|---|---|---|---|---|---|---|---|---|---|---|
| COMPARATIVE EXAMPLE | 104 | VVV | 758 | nonuse | 1200 | 1200 | 1151 | 65 | 1150 | 1072 | 21 |
| COMPARATIVE EXAMPLE | 105 | WWW | 778 | nonuse | 1250 | 1250 | 1151 | 65 | 1150 | 1071 | 21 |
| COMPARATIVE EXAMPLE | 106 | XXX | 749 | nonuse | 1200 | 1200 | 1151 | 65 | 1150 | 1072 | 21 |
| COMPARATIVE EXAMPLE | 107 | YYY | 758 | nonuse | 1200 | 1200 | 1151 | 65 | 1150 | 1072 | 21 |
| COMPARATIVE EXAMPLE | 108 | ZZZ | 746 | nonuse | 1200 | 1200 | 1151 | 65 | 1150 | 1072 | 21 |
| COMPARATIVE EXAMPLE | 109 | AAAA | 746 | nonuse | 1200 | 1200 | 1151 | 65 | 1150 | 1072 | 21 |
| COMPARATIVE EXAMPLE | 110 | BBBB | 723 | nonuse | 1200 | 1200 | 1151 | 65 | 1150 | 1072 | 21 |
| COMPARATIVE EXAMPLE | 111 | CCCC | 719 | nonuse | 1200 | 1200 | 1151 | 65 | 1150 | 1072 | 21 |
| COMPARATIVE EXAMPLE | 112 | DDDD | 779 | nonuse | 1200 | 1200 | 1151 | 65 | 1150 | 1072 | 21 |
| COMPARATIVE EXAMPLE | 113 | EEEE | 707 | nonuse | 1200 | 1200 | 1151 | 65 | 1150 | 1072 | 21 |
| COMPARATIVE EXAMPLE | 114 | FFFF | 746 | nonuse | 1200 | 1200 | 1151 | 65 | 1150 | 1072 | 21 |
| EXAMPLE | 115 | GGGG | 743 | nonuse | 1250 | 1250 | 1151 | 65 | 1150 | 1078 | 21 |
| EXAMPLE | 116 | HHHH | 740 | nonuse | 1250 | 1250 | 1151 | 65 | 1150 | 1080 | 21 |
| EXAMPLE | 117 | IIII | 742 | nonuse | 1250 | 1250 | 1151 | 65 | 1150 | 1070 | 21 |
| EXAMPLE | 118 | JJJJ | 748 | nonuse | 1250 | 1250 | 1151 | 65 | 1150 | 1073 | 21 |
| EXAMPLE | 119 | KKKK | 744 | nonuse | 1250 | 1250 | 1151 | 65 | 1150 | 1073 | 21 |
| EXAMPLE | 120 | LLLL | 741 | nonuse | 1250 | 1250 | 1151 | 65 | 1150 | 1070 | 21 |
| EXAMPLE | 121 | MMMM | 743 | nonuse | 1250 | 1250 | 1151 | 65 | 1150 | 1077 | 21 |

| | | | PRODUCTION CONDITIONS | | | | | | | | |
|---|---|---|---|---|---|---|---|---|---|---|---|
| | | | FINISH ROLLING PROCESS | | FIRST COOLING PROCESS | SECOND COOLING PROCESS | | | | THIRD COOLING PROCESS | |
| | | STEEL COMPOSITION | START TEMPERATURE (° C.) | FINISH TEMPERATURE (° C.) | COOLING RATE (° C./sec.) | COOLING RATE (° C./sec.) | COOLING START TEMPERATURE (° C.) | COOLING FINISH TEMPERATURE (° C.) | COOLING TIME (sec.) | COOLING RATE (° C./sec.) | COOLING FINISH TEMPERATURE (° C.) |
| COMPARATIVE EXAMPLE | 102 | TTT | 1011 | 895 | 33 | 10 | 720 | 650 | 7 | 33 | 25 |
| COMPARATIVE EXAMPLE | 103 | UUU | 1012 | 887 | 29 | 10 | 750 | 670 | 8 | 29 | 25 |

TABLE 7-continued

| | | | | | | | | | | | |
|---|---|---|---|---|---|---|---|---|---|---|---|
| COMPARATIVE EXAMPLE | 104 | VVV | 1012 | 887 | 29 | 10 | 750 | 670 | 8 | 29 | 25 |
| COMPARATIVE EXAMPLE | 105 | WWW | 1011 | 895 | 33 | 10 | 750 | 670 | 8 | 33 | 25 |
| COMPARATIVE EXAMPLE | 106 | XXX | 1012 | 887 | 29 | 10 | 750 | 670 | 8 | 29 | 25 |
| COMPARATIVE EXAMPLE | 107 | YYY | 1012 | 887 | 29 | 10 | 750 | 670 | 8 | 29 | 25 |
| COMPARATIVE EXAMPLE | 108 | ZZZ | 1012 | 887 | 29 | 10 | 750 | 670 | 8 | 29 | 25 |
| COMPARATIVE EXAMPLE | 109 | AAAA | 1012 | 887 | 29 | 10 | 750 | 670 | 8 | 29 | 25 |
| COMPARATIVE EXAMPLE | 110 | BBBB | 1012 | 887 | 29 | 10 | 750 | 670 | 8 | 29 | 25 |
| COMPARATIVE EXAMPLE | 111 | CCCC | 1012 | 887 | 29 | 10 | 750 | 670 | 8 | 29 | 25 |
| COMPARATIVE EXAMPLE | 112 | DDDD | 1012 | 887 | 29 | 10 | 750 | 670 | 8 | 29 | 25 |
| COMPARATIVE EXAMPLE | 113 | EEEE | 1012 | 887 | 29 | 10 | 750 | 670 | 8 | 29 | 25 |
| COMPARATIVE EXAMPLE | 114 | FFFF | 1012 | 887 | 29 | 10 | 750 | 670 | 8 | 29 | 25 |
| EXAMPLE | 115 | GGGG | 1018 | 892 | 27 | 10 | 750 | 670 | 8 | 27 | 25 |
| EXAMPLE | 116 | HHHH | 1020 | 892 | 30 | 10 | 750 | 670 | 8 | 30 | 25 |
| EXAMPLE | 117 | IIII | 1010 | 894 | 30 | 5 | 750 | 670 | 8 | 30 | 25 |
| EXAMPLE | 118 | JJJJ | 1013 | 892 | 31 | 5 | 700 | 670 | 6 | 31 | 25 |
| EXAMPLE | 119 | KKKK | 1013 | 892 | 31 | 10 | 700 | 670 | 6 | 31 | 25 |
| EXAMPLE | 120 | LLLL | 1010 | 894 | 30 | 10 | 750 | 670 | 8 | 30 | 25 |
| EXAMPLE | 121 | MMMM | 1017 | 892 | 32 | | 750 | 670 | 8 | 32 | 25 |

TABLE 8

| | | STEEL COMPOSITION | METALLOGRAPHIC STRUCTURE: CONSTITUENT METALLIC PHASE | PRIMARY PHASE FERRITE (F): AREA FRACTION F | PRIMARY PHASE FERRITE (F): AVERAGE GRAIN SIZE (μm) | SECONDARY PHASE MARTENSITE (M) AND RESIDUAL AUSTENITE (γ): AREA FRACTION M (%) | γ (%) | M + γ (%) | AVERAGE GRAIN SIZE (μm) | AREA FRACTION OF BAINITE (%) | AREA FRACTION OF PEARLITE (%) |
|---|---|---|---|---|---|---|---|---|---|---|---|
| EXAMPLE | 1 | A | ferrite, martensite, residual austenite | 93.1 | 4.22 | 5.9 | 1.0 | 6.9 | 3.4 | 0.00 | 0.00 |
| EXAMPLE | 2 | B | ferrite, martensite | 93.8 | 4.25 | 6.2 | 0.0 | 6.2 | 3.4 | 0.00 | 0.00 |
| EXAMPLE | 3 | C | ferrite, martensite, residual austenite | 92.8 | 4.22 | 5.7 | 1.5 | 7.2 | 3.4 | 0.00 | 0.00 |
| EXAMPLE | 4 | D | ferrite, martensite, residual austenite | 93.5 | 4.16 | 4.7 | 1.8 | 6.5 | 3.3 | 0.00 | 0.00 |
| EXAMPLE | 5 | E | ferrite, martensite, residual austenite | 92.4 | 4.19 | 6.1 | 1.5 | 7.6 | 3.4 | 0.00 | 0.00 |
| EXAMPLE | 6 | F | ferrite, martensite, residual austenite | 90.5 | 4.20 | 7.4 | 2.1 | 9.5 | 3.4 | 0.00 | 0.00 |
| EXAMPLE | 7 | G | ferrite, martensite, residual austenite | 93.0 | 4.19 | 5.5 | 1.5 | 7.0 | 3.4 | 0.00 | 0.00 |
| EXAMPLE | 8 | H | ferrite, martensite, residual austenite | 93.1 | 4.20 | 6.1 | 0.8 | 6.9 | 3.4 | 0.00 | 0.00 |
| EXAMPLE | 9 | I | ferrite, martensite, residual austenite | 93.4 | 3.60 | 5.4 | 1.2 | 6.6 | 2.9 | 0.00 | 0.00 |
| EXAMPLE | 10 | J | ferrite, martensite, residual austenite | 93.5 | 4.21 | 5.8 | 1.0 | 6.8 | 3.4 | 0.00 | 0.00 |
| COMPARATIVE EXAMPLE | 11 | K | ferrite, martensite, residual austenite | 97.3 | 10.04 | 1.9 | 0.8 | 2.7 | 7.1 | 0.00 | 0.00 |
| COMPARATIVE EXAMPLE | 12 | L | ferrite, martensite | 99.1 | 10.21 | 0.9 | 0.0 | 0.9 | 7.7 | 0.00 | 0.00 |
| EXAMPLE | 13 | M | ferrite, martensite, residual austenite | 92.4 | 3.90 | 7.1 | 0.5 | 7.6 | 3.1 | 0.00 | 0.00 |
| EXAMPLE | 14 | N | ferrite, martensite, residual austenite | 92.1 | 4.21 | 6.4 | 1.5 | 7.9 | 3.4 | 0.00 | 0.00 |
| EXAMPLE | 15 | O | ferrite, martensite, residual austenite | 93.1 | 4.17 | 5.5 | 1.4 | 6.9 | 3.3 | 0.00 | 0.00 |
| EXAMPLE | 16 | P | ferrite, martensite, residual austenite | 93.0 | 4.21 | 5.8 | 1.2 | 7.0 | 3.4 | 0.00 | 0.00 |
| EXAMPLE | 17 | Q | ferrite, martensite, residual austenite | 92.8 | 4.18 | 5.9 | 1.3 | 7.2 | 3.3 | 0.00 | 0.00 |
| EXAMPLE | 18 | R | ferrite, martensite, residual austenite | 93.8 | 4.20 | 4.8 | 1.4 | 6.2 | 3.4 | 0.00 | 0.00 |
| EXAMPLE | 19 | S | ferrite, martensite, residual austenite | 93.2 | 4.17 | 5.3 | 1.5 | 6.8 | 3.3 | 0.00 | 0.00 |
| EXAMPLE | 20 | T | ferrite, martensite, residual austenite | 93.1 | 4.25 | 6.0 | 0.9 | 6.9 | 3.4 | 0.00 | 0.00 |

| | | STEEL COMPOSITION | TEXTURE X-RAY RANDOM INTENSITY RATIO OF {211} PLANE | INCLUSIONS: AVERAGE OF MAXIMUM OF RATIO OF MAJOR AXIS TO MINOR AXIS | TOTAL LENGTH M IN ROLLING DIRECTION ($mm/mm^2$) | NUMBER PERCENTAGE OF MnS AND CaS (%) | ELONGATED INCLUSIONS OBSERVED MAINLY |
|---|---|---|---|---|---|---|---|
| EXAMPLE | 1 | A | 2.31 | 3.0 | 0.03 | 5.00 | calcium aluminate |
| EXAMPLE | 2 | B | 2.30 | 1.5 | 0.04 | 5.00 | calcium aluminate, residual desulfurizing agent |
| EXAMPLE | 3 | C | 2.25 | 1.0 | 0.00 | — | none |
| EXAMPLE | 4 | D | 2.32 | 1.5 | 0.02 | 10.00 | residual desulfurizing agent |
| EXAMPLE | 5 | E | 2.31 | 4.5 | 0.00 | — | none |
| EXAMPLE | 6 | F | 2.27 | 4.5 | 0.02 | 10.00 | residual desulfurizing agent |
| EXAMPLE | 7 | G | 2.00 | 1.0 | 0.00 | — | none |
| EXAMPLE | 8 | H | 2.05 | 1.0 | 0.00 | — | none |
| EXAMPLE | 9 | I | 2.27 | 2.8 | 0.14 | 5.00 | calcium aluminate |

TABLE 8-continued

| | | | | | | | |
|---|---|---|---|---|---|---|---|
| EXAMPLE | 10 | J | 2.32 | 2.9 | 0.18 | 5.00 | calcium aluminate |
| COMPARATIVE EXAMPLE | 11 | K | 2.27 | 3.0 | 0.12 | 4.00 | calcium aluminate |
| COMPARATIVE EXAMPLE | 12 | L | 2.10 | 3.0 | 0.11 | 4.00 | calcium aluminate |
| EXAMPLE | 13 | M | 2.27 | 3.0 | 0.12 | 7.00 | calcium aluminate |
| EXAMPLE | 14 | N | 2.27 | 1.0 | 0.00 | — | none |
| EXAMPLE | 15 | O | 2.28 | 8.0 | 0.13 | 25.00 | calcium aluminate, CaS |
| EXAMPLE | 16 | P | 2.29 | 8.0 | 0.19 | 25.00 | calcium aluminate, CaS |
| EXAMPLE | 17 | Q | 2.28 | 7.0 | 0.23 | 25.00 | calcium aluminate, CaS |
| EXAMPLE | 18 | R | 2.29 | 5.8 | 0.14 | 25.00 | calcium aluminate, CaS |
| EXAMPLE | 19 | S | 2.28 | 4.8 | 0.12 | 25.00 | calcium aluminate, CaS |
| EXAMPLE | 20 | T | 2.26 | 4.0 | 0.11 | 25.00 | calcium aluminate, CaS |

| | | STEEL | METALLOGRAPHIC STRUCTURE | | | | | | | | | |
|---|---|---|---|---|---|---|---|---|---|---|---|---|
| | | | | PRIMARY PHASE FERRITE (F) | | SECONDARY PHASE MARTENSITE (M) AND RESIDUAL AUSTENITE (γ) | | | | | | |
| | | | | | | AREA FRACTION | | | | | | |
| | | COMPOSITION | CONSTITUENT METALLIC PHASE | AREA FRACTION F | AVERAGE GRAIN SIZE (μm) | M (%) | γ (%) | M + γ (%) | AVERAGE GRAIN SIZE (μm) | AREA FRACTION OF BAINITE (%) | AREA FRACTION OF PEARLITE (%) |
| EXAMPLE | 21 | U | ferrite, martensite, residual austenite | 93.5 | 4.19 | 5.3 | 1.2 | 6.5 | 3.3 | 0.00 | 0.00 |
| EXAMPLE | 22 | V | ferrite, martensite, residual austenite | 93.2 | 4.22 | 5.9 | 0.9 | 6.8 | 3.4 | 0.00 | 0.00 |
| EXAMPLE | 23 | W | ferrite, martensite, residual austenite | 92.8 | 4.20 | 6.0 | 1.2 | 7.2 | 3.4 | 0.00 | 0.00 |
| EXAMPLE | 24 | X | ferrite, martensite, residual austenite | 93.0 | 4.20 | 6.4 | 0.6 | 7.0 | 3.4 | 0.00 | 0.00 |
| EXAMPLE | 25 | Y | ferrite, martensite, residual austenite | 93.1 | 4.20 | 6.2 | 0.7 | 6.9 | 3.4 | 0.00 | 0.00 |
| COMPARATIVE EXAMPLE | 26 | Z | ferrite, martensite, residual austenite | 93.0 | 4.20 | 5.8 | 1.2 | 7.0 | 3.4 | 0.00 | 0.00 |
| COMPARATIVE EXAMPLE | 27 | AA | ferrite, martensite, residual austenite | 93.8 | 4.15 | 5.6 | 0.6 | 6.2 | 3.3 | 0.00 | 0.00 |
| COMPARATIVE EXAMPLE | 28 | BB | ferrite, martensite, residual austenite | 83.7 | 4.15 | 12.8 | 3.5 | 16.3 | 3.3 | 0.00 | 0.00 |
| EXAMPLE | 29 | A | ferrite, martensite, residual austenite | 93.1 | 4.24 | 5.7 | 1.2 | 6.9 | 3.4 | 0.00 | 0.00 |
| COMPARATIVE EXAMPLE | 30 | A | ferrite, martensite, residual austenite | 93.1 | 4.20 | 6.1 | 0.8 | 6.9 | 3.4 | 0.00 | 0.00 |
| EXAMPLE | 31 | A | ferrite, martensite, residual austenite | 93.1 | 4.20 | 6.5 | 0.4 | 6.9 | 3.4 | 0.00 | 0.00 |
| COMPARATIVE EXAMPLE | 32 | A | ferrite, martensite, residual austenite | 93.1 | 3.90 | 5.1 | 1.8 | 6.9 | 3.1 | 0.00 | 0.00 |
| EXAMPLE | 33 | A | ferrite, martensite, residual austenite | 93.1 | 4.20 | 5.5 | 1.4 | 6.9 | 3.4 | 0.00 | 0.00 |
| EXAMPLE | 34 | A | ferrite, martensite, residual austenite | 93.1 | 6.00 | 6.1 | 0.8 | 6.9 | 4.8 | 0.00 | 0.00 |
| COMPARATIVE EXAMPLE | 35 | A | ferrite, martensite, residual austenite | 93.1 | 10.20 | 5.5 | 1.4 | 6.9 | 7.8 | 0.00 | 0.00 |
| COMPARATIVE EXAMPLE | 36 | A | ferrite, martensite, residual austenite | 93.1 | 3.70 | 5.7 | 1.2 | 6.9 | 3.0 | 0.00 | 0.00 |
| COMPARATIVE EXAMPLE | 37 | A | ferrite, martensite, residual austenite | 93.1 | 3.70 | 5.9 | 1.0 | 6.9 | 3.0 | 0.00 | 0.00 |
| COMPARATIVE EXAMPLE | 38 | A | ferrite, martensite, residual austenite | 93.1 | 10.05 | 5.8 | 1.1 | 6.9 | 7.7 | 0.00 | 0.00 |
| COMPARATIVE EXAMPLE | 39 | A | ferrite, martensite, residual austenite | 93.0 | 10.10 | 6.0 | 1.0 | 7.0 | 7.5 | 0.00 | 0.00 |
| COMPARATIVE EXAMPLE | 40 | A | ferrite, bainite | 95.5 | 4.90 | 0.0 | 0.0 | 0.0 | 3.9 | 4.50 | 0.00 |
| COMPARATIVE EXAMPLE | 41 | A | ferrite, pearlite, bainite | 94.5 | 5.50 | 0.0 | 0.0 | 0.0 | 4.4 | 3.50 | 2.00 |

TABLE 8-continued

| | | STEEL COMPOSITION | TEXTURE X-RAY RANDOM INTENSITY RATIO OF {211} PLANE | INCLUSIONS: AVERAGE OF MAXIMUM OF RATIO OF MAJOR AXIS TO MINOR AXIS | INCLUSIONS: TOTAL LENGTH M IN ROLLING DIRECTION ($mm/mm^2$) | INCLUSIONS: NUMBER PERCENTAGE OF MnS AND CaS (%) | INCLUSIONS: ELONGATED INCLUSIONS OBSERVED MAINLY |
|---|---|---|---|---|---|---|---|
| EXAMPLE | 21 | U | 2.26 | 2.8 | 0.21 | 20.00 | calcium aluminate |
| EXAMPLE | 22 | V | 2.27 | 2.0 | 0.20 | 20.00 | calcium aluminate |
| EXAMPLE | 23 | W | 2.31 | 1.0 | 0.10 | 7.00 | calcium aluminate |
| EXAMPLE | 24 | X | 2.30 | 1.0 | 0.00 | 5.00 | calcium aluminate |
| EXAMPLE | 25 | Y | 2.26 | 3.0 | 0.25 | 20.00 | calcium aluminate |
| COMPARATIVE EXAMPLE | 26 | Z | 2.32 | 4.0 | 0.40 | 50.00 | calcium aluminate, MnS |
| COMPARATIVE EXAMPLE | 27 | AA | 2.25 | 9.0 | 0.30 | 75.00 | MnS |
| COMPARATIVE EXAMPLE | 28 | BB | 2.32 | 1.3 | 0.24 | 10.00 | calcium aluminate |
| EXAMPLE | 29 | A | 2.30 | 3.0 | 0.06 | 5.00 | calcium aluminate |
| COMPARATIVE EXAMPLE | 30 | A | 2.30 | 9.0 | 0.48 | 5.00 | calcium aluminate |
| EXAMPLE | 31 | A | 2.30 | 8.0 | 0.25 | 5.00 | calcium aluminate |
| COMPARATIVE EXAMPLE | 32 | A | 2.50 | 3.0 | 0.25 | 5.00 | calcium aluminate |
| EXAMPLE | 33 | A | 2.40 | 2.9 | 0.24 | 5.00 | calcium aluminate |
| EXAMPLE | 34 | A | 2.30 | 5.0 | 0.15 | 5.00 | calcium aluminate |
| COMPARATIVE EXAMPLE | 35 | A | 2.25 | 7.0 | 0.20 | 5.00 | calcium aluminate |
| COMPARATIVE EXAMPLE | 36 | A | 2.60 | 3.0 | 0.06 | 5.00 | calcium aluminate |
| COMPARATIVE EXAMPLE | 37 | A | 3.46 | 3.0 | 0.06 | 5.00 | calcium aluminate |
| COMPARATIVE EXAMPLE | 38 | A | 1.84 | 3.0 | 0.06 | 5.00 | calcium aluminate |
| COMPARATIVE EXAMPLE | 39 | A | 2.38 | 3.0 | 0.06 | 5.00 | calcium aluminate |
| COMPARATIVE EXAMPLE | 40 | A | 2.38 | 3.0 | 0.06 | 5.00 | calcium aluminate |
| COMPARATIVE EXAMPLE | 41 | A | 2.38 | 3.0 | 0.06 | 5.00 | calcium aluminate |

The underlined value in the table indicates out of the range of the present invention.

TABLE 9

| | | STEEL COMPOSITION | CONSTITUENT METALLIC PHASE | METALLOGRAPHIC STRUCTURE: PRIMARY PHASE FERRITE (F) AREA FRACTION F | PRIMARY PHASE FERRITE (F) AVERAGE GRAIN SIZE (μm) | SECONDARY PHASE MARTENSITE (M) AND RESIDUAL AUSTENITE (γ) AREA FRACTION M (%) | γ (%) | M + γ (%) | SECONDARY PHASE AVERAGE GRAIN SIZE (μm) | AREA FRACTION OF BAINITE (%) | AREA FRACTION OF PEARLITE (%) |
|---|---|---|---|---|---|---|---|---|---|---|---|
| EXAMPLE | 42 | CC | ferrite, martensite, residual austenite | 95.7 | 5.22 | 3.2 | 1.1 | 4.3 | 4.2 | 0.00 | 0.00 |
| EXAMPLE | 43 | DD | ferrite, martensite, residual austenite | 93.8 | 4.25 | 4.7 | 1.6 | 6.2 | 3.4 | 0.00 | 0.00 |
| EXAMPLE | 44 | EE | ferrite, martensite, residual austenite | 92.8 | 4.22 | 5.4 | 1.8 | 7.2 | 3.4 | 0.00 | 0.00 |
| EXAMPLE | 45 | FF | ferrite, martensite, residual austenite | 93.5 | 4.16 | 4.9 | 1.6 | 6.5 | 3.3 | 0.00 | 0.00 |
| EXAMPLE | 46 | GG | ferrite, martensite, residual austenite | 92.4 | 4.19 | 5.7 | 1.9 | 7.6 | 3.4 | 0.00 | 0.00 |
| EXAMPLE | 47 | HH | ferrite, martensite, residual austenite | 90.5 | 4.20 | 7.1 | 2.4 | 9.5 | 3.4 | 0.00 | 0.00 |
| EXAMPLE | 48 | II | ferrite, martensite, residual austenite | 93.0 | 4.19 | 5.3 | 1.8 | 7.0 | 3.4 | 0.00 | 0.00 |
| EXAMPLE | 49 | JJ | ferrite, martensite, residual austenite | 93.1 | 4.20 | 5.2 | 1.7 | 6.9 | 3.4 | 0.00 | 0.00 |
| EXAMPLE | 50 | KK | ferrite, martensite, residual austenite | 93.5 | 5.40 | 4.9 | 1.6 | 6.5 | 4.3 | 0.00 | 0.00 |
| COMPARATIVE EXAMPLE | 51 | LL | ferrite, martensite, residual austenite | 99.1 | 10.09 | 0.7 | 0.2 | 0.9 | 7.7 | 0.00 | 0.00 |
| EXAMPLE | 52 | MM | ferrite, martensite, residual austenite | 93.4 | 4.30 | 5.0 | 1.7 | 6.6 | 3.4 | 0.00 | 0.00 |
| EXAMPLE | 53 | NN | ferrite, martensite, residual austenite | 96.9 | 5.90 | 2.3 | 0.8 | 3.1 | 4.7 | 0.00 | 0.00 |
| EXAMPLE | 54 | OO | ferrite, martensite, residual austenite | 92.4 | 4.22 | 5.7 | 1.9 | 7.6 | 3.4 | 0.00 | 0.00 |
| EXAMPLE | 55 | PP | ferrite, martensite, residual austenite | 92.1 | 4.21 | 6.0 | 2.0 | 7.9 | 3.4 | 0.00 | 0.00 |
| EXAMPLE | 56 | QQ | ferrite, martensite, residual austenite | 93.1 | 4.17 | 5.2 | 1.7 | 6.9 | 3.3 | 0.00 | 0.00 |
| EXAMPLE | 57 | RR | ferrite, martensite, residual austenite | 93.0 | 4.21 | 5.3 | 1.8 | 7.0 | 3.4 | 0.00 | 0.00 |
| EXAMPLE | 58 | SS | ferrite, martensite, residual austenite | 92.8 | 4.18 | 5.4 | 1.8 | 7.2 | 3.3 | 0.00 | 0.00 |
| EXAMPLE | 59 | TT | ferrite, martensite, residual austenite | 93.8 | 4.20 | 4.7 | 1.6 | 6.2 | 3.4 | 0.00 | 0.00 |
| EXAMPLE | 60 | UU | ferrite, martensite, residual austenite | 93.2 | 4.17 | 5.1 | 1.7 | 6.8 | 3.3 | 0.00 | 0.00 |
| EXAMPLE | 61 | VV | ferrite, martensite, residual austenite | 93.1 | 4.25 | 5.2 | 1.7 | 6.9 | 3.4 | 0.00 | 0.00 |

| | | STEEL COMPOSITION | TEXTURE X-RAY RANDOM INTENSITY RATIO OF {211} PLANE | INCLUSIONS: AVERAGE OF MAXIMUM OF RATIO OF MAJOR AXIS TO MINOR AXIS | TOTAL LENGTH M IN ROLLING DIRECTION ($mm/mm^2$) | NUMBER PERCENTAGE OF MnS AND CaS (%) | ELONGATED INCLUSIONS OBSERVED MAINLY |
|---|---|---|---|---|---|---|---|
| EXAMPLE | 42 | CC | 2.31 | 3.0 | 0.03 | 5.00 | calcium aluminate |
| EXAMPLE | 43 | DD | 2.30 | 1.5 | 0.04 | 5.00 | calcium aluminate, residual desulfurizing agent |
| EXAMPLE | 44 | EE | 2.25 | 1.0 | 0.22 | — | none |
| EXAMPLE | 45 | FF | 2.32 | 1.5 | 0.02 | 5.00 | residual desulfurizing agent |
| EXAMPLE | 46 | GG | 2.31 | 4.5 | 0.24 | — | none |
| EXAMPLE | 47 | HH | 2.27 | 4.5 | 0.02 | 5.00 | residual desulfurizing agent |
| EXAMPLE | 48 | II | 2.00 | 1.0 | 0.17 | — | none |
| EXAMPLE | 49 | JJ | 2.05 | 1.0 | 0.18 | — | none |
| EXAMPLE | 50 | KK | 2.30 | 2.0 | 0.05 | 17.50 | residual desulfurizing agent, CaS |

TABLE 9-continued

| | | | | | | | |
|---|---|---|---|---|---|---|---|
| COMPARATIVE EXAMPLE | 51 | LL | 2.30 | 2.0 | 0.10 | 20.00 | calcium aluminate, CaS |
| EXAMPLE | 52 | MM | 2.27 | 2.8 | 0.14 | 22.50 | calcium aluminate, REM oxide, CaS |
| EXAMPLE | 53 | NN | 2.27 | 3.0 | 0.12 | 20.00 | calcium aluminate, REM oxide, CaS |
| EXAMPLE | 54 | OO | 2.27 | 3.0 | 0.12 | 20.00 | calcium aluminate, REM oxide, CaS |
| EXAMPLE | 55 | PP | 2.27 | 1.0 | 0.18 | — | none |
| EXAMPLE | 56 | QQ | 2.28 | 8.0 | 0.13 | 20.00 | calcium aluminate, CaS |
| EXAMPLE | 57 | RR | 2.29 | 8.0 | 0.19 | 20.00 | calcium aluminate, CaS |
| EXAMPLE | 58 | SS | 2.28 | 7.0 | 0.23 | 20.00 | calcium aluminate, CaS |
| EXAMPLE | 59 | TT | 2.29 | 5.8 | 0.14 | 20.00 | calcium aluminate, CaS |
| EXAMPLE | 60 | UU | 2.28 | 4.8 | 0.12 | 20.00 | calcium aluminate, CaS |
| EXAMPLE | 61 | VV | 2.26 | 4.0 | 0.11 | 20.00 | calcium aluminate, CaS |

| | | STEEL | METALLOGRAPHIC STRUCTURE | | | | | | | | | |
|---|---|---|---|---|---|---|---|---|---|---|---|---|
| | | | | PRIMARY PHASE FERRITE (F) | | SECONDARY PHASE MARTENSITE (M) AND RESIDUAL AUSTENITE (γ) | | | | | | |
| | | | | | | AREA FRACTION | | | | | | |
| | | COMPOSITION | CONSTITUENT METALLIC PHASE | AREA FRACTION F | AVERAGE GRAIN SIZE (μm) | M (%) | γ (%) | M + γ (%) | AVERAGE GRAIN SIZE (μm) | AREA FRACTION OF BAINITE (%) | AREA FRACTION OF PEARLITE (%) |
| EXAMPLE | 62 | WW | ferrite, martensite, residual austenite | 93.5 | 4.19 | 4.9 | 1.6 | 6.5 | 3.3 | 0.00 | 0.00 |
| EXAMPLE | 63 | XX | ferrite, martensite, residual austenite | 93.2 | 4.22 | 5.1 | 1.7 | 6.8 | 3.4 | 0.00 | 0.00 |
| EXAMPLE | 64 | YY | ferrite, martensite, residual austenite | 92.8 | 4.20 | 5.4 | 1.8 | 7.2 | 3.4 | 0.00 | 0.00 |
| EXAMPLE | 65 | ZZ | ferrite, martensite, residual austenite | 93.0 | 4.20 | 5.3 | 1.8 | 7.0 | 3.4 | 0.00 | 0.00 |
| EXAMPLE | 66 | AAA | ferrite, martensite, residual austenite | 93.1 | 4.20 | 5.2 | 1.7 | 6.9 | 3.4 | 0.00 | 0.00 |
| COMPARATIVE EXAMPLE | 67 | BBB | ferrite, martensite, residual austenite | 93.0 | 4.20 | 5.3 | 1.8 | 7.0 | 3.4 | 0.00 | 0.00 |
| COMPARATIVE EXAMPLE | 68 | CCC | ferrite, martensite, residual austenite | 93.8 | 4.15 | 4.7 | 1.6 | 6.2 | 3.3 | 0.00 | 0.00 |
| COMPARATIVE EXAMPLE | 69 | DDD | ferrite, martensite, residual austenite | 83.7 | 4.15 | 12.2 | 4.1 | 16.3 | 3.3 | 0.00 | 0.00 |
| COMPARATIVE EXAMPLE | 70 | CC | ferrite, martensite, residual austenite | 95.7 | 4.24 | 3.2 | 1.1 | 4.3 | 3.4 | 0.00 | 0.00 |
| COMPARATIVE EXAMPLE | 71 | CC | ferrite, martensite, residual austenite | 93.1 | 4.20 | 5.2 | 1.7 | 6.9 | 3.4 | 0.00 | 0.00 |
| EXAMPLE | 72 | CC | ferrite, martensite, residual austenite | 93.1 | 4.20 | 5.2 | 1.7 | 6.9 | 3.4 | 0.00 | 0.00 |
| COMPARATIVE EXAMPLE | 73 | CC | ferrite, martensite, residual austenite | 93.1 | 3.90 | 5.2 | 1.7 | 6.9 | 3.1 | 0.00 | 0.00 |
| EXAMPLE | 74 | CC | ferrite, martensite, residual austenite | 93.1 | 4.20 | 5.2 | 1.7 | 6.9 | 3.4 | 0.00 | 0.00 |
| EXAMPLE | 75 | CC | ferrite, martensite, residual austenite | 93.1 | 6.00 | 5.2 | 1.7 | 6.9 | 4.8 | 0.00 | 0.00 |
| COMPARATIVE EXAMPLE | 76 | CC | ferrite, martensite, residual austenite | 93.1 | 10.10 | 5.2 | 1.7 | 6.9 | 7.8 | 0.00 | 0.00 |
| COMPARATIVE EXAMPLE | 77 | CC | ferrite, martensite, residual austenite | 93.1 | 3.70 | 5.2 | 1.7 | 6.9 | 3.0 | 0.00 | 0.00 |
| COMPARATIVE EXAMPLE | 78 | CC | ferrite, martensite, residual austenite | 93.1 | 3.70 | 5.2 | 1.7 | 6.9 | 3.0 | 0.00 | 0.00 |
| COMPARATIVE EXAMPLE | 79 | CC | ferrite, martensite, residual austenite | 93.1 | 10.08 | 5.2 | 1.7 | 6.9 | 7.6 | 0.00 | 0.00 |
| COMPARATIVE EXAMPLE | 80 | CC | ferrite, pearlite, bainite | 93.9 | 10.10 | 0.0 | 0.0 | 0.0 | 7.7 | 5.10 | 1.00 |
| COMPARATIVE EXAMPLE | 81 | CC | ferrite, bainite | 95.2 | 4.90 | 0.0 | 0.0 | 0.0 | 3.9 | 4.80 | 0.00 |

TABLE 9-continued

| | | STEEL COMPOSITION | TEXTURE X-RAY RANDOM INTENSITY RATIO OF {211} PLANE | INCLUSIONS | | | |
|---|---|---|---|---|---|---|---|
| | | | | AVERAGE OF MAXIMUM OF RATIO OF MAJOR AXIS TO MINOR AXIS | TOTAL LENGTH M IN ROLLING DIRECTION ($mm/mm^2$) | NUMBER PERCENTAGE OF MnS AND CaS (%) | ELONGATED INCLUSIONS OBSERVED MAINLY |
| EXAMPLE | 62 | WW | 2.26 | 2.8 | 0.21 | 19.00 | calcium aluminate, REM oxide, CaS |
| EXAMPLE | 63 | XX | 2.27 | 2.0 | 0.20 | 10.00 | calcium aluminate |
| EXAMPLE | 64 | YY | 2.31 | 1.0 | 0.10 | 10.00 | calcium aluminate |
| EXAMPLE | 65 | ZZ | 2.30 | 1.0 | 0.00 | 17.50 | calcium aluminate, REM oxide, CaS |
| EXAMPLE | 66 | AAA | 2.26 | 3.0 | 0.25 | 21.50 | calcium aluminate, REM oxide, CaS |
| COMPARATIVE EXAMPLE | 67 | BBB | 2.32 | 4.0 | 0.40 | 40.00 | calcium aluminate, MnS |
| COMPARATIVE EXAMPLE | 68 | CCC | 2.25 | 9.0 | 0.45 | 75.00 | MnS |
| COMPARATIVE EXAMPLE | 69 | DDD | 2.32 | 1.3 | 0.24 | 10.00 | calcium aluminate |
| COMPARATIVE EXAMPLE | 70 | CC | 2.30 | 3.0 | 0.06 | 5.00 | calcium aluminate |
| COMPARATIVE EXAMPLE | 71 | CC | 2.30 | 9.0 | 0.48 | 5.00 | calcium aluminate |
| EXAMPLE | 72 | CC | 2.30 | 8.0 | 0.25 | 5.00 | calcium aluminate |
| COMPARATIVE EXAMPLE | 73 | CC | 2.50 | 3.0 | 0.25 | 5.00 | calcium aluminate |
| EXAMPLE | 74 | CC | 2.40 | 2.9 | 0.24 | 5.00 | calcium aluminate |
| EXAMPLE | 75 | CC | 2.30 | 5.0 | 0.15 | 5.00 | calcium aluminate |
| COMPARATIVE EXAMPLE | 76 | CC | 2.25 | 7.0 | 0.20 | 5.00 | calcium aluminate |
| COMPARATIVE EXAMPLE | 77 | CC | 2.60 | 3.0 | 0.06 | 5.00 | calcium aluminate |
| COMPARATIVE EXAMPLE | 78 | CC | 3.46 | 3.0 | 0.06 | 5.00 | calcium aluminate |
| COMPARATIVE EXAMPLE | 79 | CC | 1.84 | 3.0 | 0.06 | 5.00 | calcium aluminate |
| COMPARATIVE EXAMPLE | 80 | CC | 2.38 | 3.0 | 0.06 | 5.00 | calcium aluminate |
| COMPARATIVE EXAMPLE | 81 | CC | 2.38 | 3.0 | 0.06 | 5.00 | calcium aluminate |

The underlined value in the table indicates out of the range of the present invention.

TABLE 10

| | | | METALLOGRAPHIC STRUCTURE | | | | | | | | | |
|---|---|---|---|---|---|---|---|---|---|---|---|---|
| | | | | PRIMARY PHASE FERRITE (F) | | SECONDARY PHASE MARTENSITE (M) AND RESIDUAL AUSTENITE (γ) | | | | | | AREA |
| | | | | | | AREA FRACTION | | | | | | |
| | | STEEL COMPOSITION | CONSTITUENT METALLIC PHASE | AREA FRACTION F | AVERAGE GRAIN SIZE (μm) | M (%) | γ (%) | M + γ (%) | AVERAGE GRAIN SIZE (μm) | AREA FRACTION OF BAINITE (%) | FRACTION OF PEARLITE (%) |
| EXAMPLE | 82 | EEE | ferrite, martensite, residual austenite | 93.1 | 4.60 | 5.8 | 1.1 | 6.9 | 3.7 | 0.00 | 0.00 |
| EXAMPLE | 83 | FFF | ferrite, martensite, residual austenite | 93.9 | 5.10 | 5.6 | 0.5 | 6.1 | 4.1 | 0.00 | 0.00 |
| COMPARATIVE EXAMPLE | 84 | GGG | ferrite, martensite | 93.9 | 5.20 | 6.1 | 0.0 | 6.1 | 4.2 | 0.00 | 0.00 |
| COMPARATIVE EXAMPLE | 85 | HHH | ferrite, martensite, residual austenite | 88.5 | 4.20 | 9.0 | 2.5 | 11.5 | 3.4 | 0.00 | 0.00 |
| COMPARATIVE EXAMPLE | 86 | JJJ | ferrite, martensite, residual austenite | 94.1 | 4.50 | 5.4 | 0.5 | 5.9 | 3.6 | 0.00 | 0.00 |
| EXAMPLE | 87 | A | ferrite, martensite, residual austenite | 92.6 | 9.80 | 6.4 | 1.0 | 7.4 | 7.8 | 0.00 | 0.00 |
| EXAMPLE | 89 | A | ferrite, martensite, pearlite, bainite | 91.0 | 4.50 | 4.5 | 0.0 | 4.5 | 3.6 | 2.00 | 2.50 |
| EXAMPLE | 90 | KKK | ferrite, martensite, residual austenite | 95.5 | 9.40 | 4.0 | 0.5 | 4.5 | 7.8 | 0.00 | 0.00 |
| COMPARATIVE EXAMPLE | 91 | A | ferrite, martensite, residual austenite | 89.0 | 4.90 | 9.0 | 2.0 | 11.0 | 3.9 | 0.00 | 0.00 |
| COMPARATIVE EXAMPLE | 92 | A | ferrite, martensite, residual austenite, pearlite, bainite | 89.0 | 5.20 | 2.0 | 1.0 | 3.0 | 4.2 | 2.00 | 6.00 |
| COMPARATIVE EXAMPLE | 93 | A | ferrite, martensite, residual austenite | 89.0 | 4.00 | 8.0 | 3.0 | 11.0 | 3.2 | 0.00 | 0.00 |
| COMPARATIVE EXAMPLE | 94 | LLL | ferrite, martensite, residual austenite | 93.1 | 4.22 | 5.9 | 1.0 | 6.9 | 3.4 | 0.00 | 0.00 |
| COMPARATIVE EXAMPLE | 95 | MMM | ferrite, martensite, residual austenite | 93.1 | 4.20 | 5.2 | 1.7 | 6.9 | 3.4 | 0.00 | 0.00 |
| COMPARATIVE EXAMPLE | 96 | NNN | ferrite, martensite, residual austenite | 93.1 | 6.00 | 6.1 | 0.8 | 6.9 | 4.8 | 0.00 | 0.00 |
| COMPARATIVE EXAMPLE | 97 | OOO | ferrite, martensite, residual austenite | 93.1 | 6.00 | 6.1 | 0.8 | 6.9 | 4.8 | 0.00 | 0.00 |
| COMPARATIVE EXAMPLE | 98 | PPP | ferrite, martensite, residual austenite | 88.7 | 5.90 | 8.9 | 2.4 | 11.3 | 4.7 | 0.00 | 0.00 |
| COMPARATIVE EXAMPLE | 99 | QQQ | ferrite, martensite, residual austenite | 87.6 | 5.90 | 9.5 | 2.9 | 12.4 | 4.7 | 0.00 | 0.00 |
| COMPARATIVE EXAMPLE | 100 | RRR | ferrite, martensite, residual austenite | 93.2 | 4.21 | 5.8 | 1.0 | 6.8 | 3.4 | 0.00 | 0.00 |
| COMPARATIVE EXAMPLE | 101 | SSS | ferrite, martensite, residual austenite | 93.8 | 4.25 | 4.7 | 1.6 | 6.2 | 3.4 | 0.00 | 0.00 |

| | | | | INCLUSIONS | | | |
|---|---|---|---|---|---|---|---|
| | | STEEL COMPOSITION | TEXTURE X-RAY RANDOM INTENSITY RATIO OF {211} PLANE | AVERAGE OF MAXIMUM OF RATIO OF MAJOR AXIS TO MINOR AXIS | TOTAL LENGTH M IN ROLLING DIRECTION ($mm/mm^2$) | NUMBER PERCENTAGE OF MnS AND CaS (%) | ELONGATED INCLUSIONS OBSERVED MAINLY |
| EXAMPLE | 82 | EEE | 2.15 | 1.0 | 0.21 | 5.00 | MnS |
| EXAMPLE | 83 | FFF | 2.00 | 8.0 | 0.20 | 5.00 | calcium aluminate |
| COMPARATIVE EXAMPLE | 84 | GGG | 2.20 | 12.0 | 0.60 | 80.00 | MnS |
| COMPARATIVE EXAMPLE | 85 | HHH | 2.30 | 2.9 | 0.03 | 5.00 | calcium aluminate |
| COMPARATIVE EXAMPLE | 86 | JJJ | 2.20 | 6.0 | 0.45 | 65.00 | MnS |
| EXAMPLE | 87 | A | 2.30 | 3.0 | 0.03 | 5.00 | calcium aluminate |
| EXAMPLE | 89 | A | 2.30 | 3.0 | 0.03 | 5.00 | calcium aluminate |
| EXAMPLE | 90 | KKK | 2.00 | 4.0 | 0.25 | 50.00 | CaS, MnS |
| COMPARATIVE EXAMPLE | 91 | A | 2.30 | 3.0 | 0.25 | 5.00 | calcium aluminate |
| COMPARATIVE EXAMPLE | 92 | A | 2.30 | 3.0 | 0.03 | 5.00 | calcium aluminate |

TABLE 10-continued

| | | | | | | | |
|---|---|---|---|---|---|---|---|
| COMPARATIVE EXAMPLE | 93 | A | 2.30 | 3.0 | 0.03 | 5.00 | calcium aluminate |
| COMPARATIVE EXAMPLE | 94 | LLL | 2.31 | 3.0 | 0.03 | 5.00 | calcium aluminate |
| COMPARATIVE EXAMPLE | 95 | MMM | 2.30 | 8.0 | 0.25 | 5.00 | calcium aluminate |
| COMPARATIVE EXAMPLE | 96 | NNN | 2.30 | 5.0 | 0.15 | 5.00 | calcium aluminate |
| COMPARATIVE EXAMPLE | 97 | OOO | 2.30 | 5.0 | 0.15 | 5.00 | calcium aluminate |
| COMPARATIVE EXAMPLE | 98 | PPP | 2.27 | 3.0 | 0.12 | 20.00 | calcium aluminate, REM oxide, CaS |
| COMPARATIVE EXAMPLE | 99 | QQQ | 2.27 | 3.0 | 0.12 | 20.00 | calcium aluminate, REM oxide, CaS |
| COMPARATIVE EXAMPLE | 100 | RRR | 2.32 | 2.9 | 0.18 | 5.00 | calcium aluminate |
| COMPARATIVE EXAMPLE | 101 | SSS | 2.30 | 1.5 | 0.04 | 5.00 | calcium aluminate, residual desulfurizing agent |

| | | | METALLOGRAPHIC STRUCTURE | | | | | | | | | |
|---|---|---|---|---|---|---|---|---|---|---|---|---|
| | | | | PRIMARY PHASE FERRITE (F) | | SECONDARY PHASE MARTENSITE (M) AND RESIDUAL AUSTENITE (γ) | | | | | | |
| | | | | | | AREA FRACTION | | | | | | |
| | | STEEL COMPOSITION | CONSTITUENT METALLIC PHASE | AREA FRACTION F | AVERAGE GRAIN SIZE (μm) | M (%) | γ (%) | M + γ (%) | AVERAGE GRAIN SIZE (μm) | AREA FRACTION OF BAINITE (%) | AREA FRACTION OF PEARLITE (%) |
| COMPARATIVE EXAMPLE | 102 | TTT | ferrite, martensite, residual austenite | 92.8 | 4.22 | 5.7 | 1.5 | 7.2 | 3.4 | 0.00 | 0.00 |
| COMPARATIVE EXAMPLE | 103 | UUU | ferrite, martensite, residual austenite | 93.1 | 4.60 | 5.8 | 1.1 | 6.9 | 3.7 | 0.00 | 0.00 |
| COMPARATIVE EXAMPLE | 104 | VVV | ferrite, martensite, residual austenite | 93.9 | 5.10 | 5.6 | 0.5 | 6.1 | 4.1 | 0.00 | 0.00 |
| COMPARATIVE EXAMPLE | 105 | WWW | ferrite, martensite, residual austenite | 92.8 | 4.22 | 5.4 | 1.8 | 7.2 | 3.4 | 0.00 | 0.00 |
| COMPARATIVE EXAMPLE | 106 | XXX | ferrite, martensite, residual austenite | 93.1 | 4.60 | 5.8 | 1.1 | 6.9 | 3.7 | 0.00 | 0.00 |
| COMPARATIVE EXAMPLE | 107 | YYY | ferrite, martensite, residual austenite | 93.9 | 5.10 | 5.6 | 0.5 | 6.1 | 4.1 | 0.00 | 0.00 |
| COMPARATIVE EXAMPLE | 108 | ZZZ | ferrite, martensite, residual austenite | 93.1 | 4.22 | 5.9 | 1.0 | 6.9 | 3.4 | 0.00 | 0.00 |
| COMPARATIVE EXAMPLE | 109 | AAAA | ferrite, martensite, residual austenite | 93.1 | 4.22 | 5.9 | 1.0 | 6.9 | 3.4 | 0.00 | 0.00 |
| COMPARATIVE EXAMPLE | 110 | BBBB | ferrite, martensite, residual austenite | 93.1 | 4.22 | 5.9 | 1.0 | 6.9 | 3.4 | 0.00 | 0.00 |
| COMPARATIVE EXAMPLE | 111 | CCCC | ferrite, martensite, residual austenite | 93.1 | 4.22 | 5.9 | 1.0 | 6.9 | 3.4 | 0.00 | 0.00 |
| COMPARATIVE EXAMPLE | 112 | DDDD | ferrite, martensite, residual austenite | 93.1 | 4.22 | 5.9 | 1.0 | 6.9 | 3.4 | 0.00 | 0.00 |
| COMPARATIVE EXAMPLE | 113 | EEEE | ferrite, martensite, residual austenite | 93.1 | 4.22 | 5.9 | 1.0 | 6.0 | 3.4 | 0.00 | 0.00 |
| COMPARATIVE EXAMPLE | 114 | FFFF | ferrite, martensite, residual austenite | 93.1 | 4.22 | 5.9 | 1.0 | 6.9 | 3.4 | 0.00 | 0.00 |
| EXAMPLE | 115 | GGGG | ferrite, martensite, residual austenite | 93.4 | 3.91 | 5.4 | 1.2 | 6.6 | 3.1 | 0.00 | 0.00 |
| EXAMPLE | 116 | HHHH | ferrite, martensite, residual austenite | 92.4 | 4.23 | 7.1 | 0.5 | 7.6 | 3.4 | 0.00 | 0.00 |
| EXAMPLE | 117 | IIII | ferrite, martensite, residual austenite | 93.5 | 4.19 | 5.3 | 1.2 | 6.5 | 3.3 | 0.00 | 0.00 |
| EXAMPLE | 118 | JJJJ | ferrite, martensite, residual austenite | 92.1 | 4.21 | 6.4 | 1.5 | 7.9 | 3.4 | 0.00 | 0.00 |
| EXAMPLE | 119 | KKKK | ferrite, martensite, residual austenite | 92.1 | 4.21 | 6.4 | 1.5 | 7.9 | 3.4 | 0.00 | 0.00 |
| EXAMPLE | 120 | LLLL | ferrite, martensite, residual austenite | 93.5 | 4.19 | 5.3 | 1.2 | 6.5 | 3.3 | 0.00 | 0.00 |
| EXAMPLE | 121 | MMMM | ferrite, martensite, residual austenite | 93.2 | 4.22 | 5.9 | 0.9 | 6.8 | 3.4 | 0.00 | 0.00 |

TABLE 10-continued

| | | STEEL COMPOSITION | TEXTURE X-RAY RANDOM INTENSITY RATIO OF {211} PLANE | INCLUSIONS | | | |
|---|---|---|---|---|---|---|---|
| | | | | AVERAGE OF MAXIMUM OF RATIO OF MAJOR AXIS TO MINOR AXIS | TOTAL LENGTH M IN ROLLING DIRECTION ($mm/mm^2$) | NUMBER PERCENTAGE OF MnS AND CaS (%) | ELONGATED INCLUSIONS OBSERVED MAINLY |
| COMPARATIVE EXAMPLE | 102 | TTT | 2.25 | 1.0 | 0.00 | — | none |
| COMPARATIVE EXAMPLE | 103 | UUU | 2.15 | 1.0 | 0.21 | 5.00 | MnS |
| COMPARATIVE EXAMPLE | 104 | VVV | 2.00 | 11.0 | 0.51 | 5.00 | calcium aluminate |
| COMPARATIVE EXAMPLE | 105 | WWW | 2.25 | 10.1 | 0.48 | 5.00 | MnS |
| COMPARATIVE EXAMPLE | 106 | XXX | 2.15 | 10.5 | 0.53 | 5.00 | MnS |
| COMPARATIVE EXAMPLE | 107 | YYY | 2.00 | 11.2 | 0.49 | 5.00 | calcium aluminate |
| COMPARATIVE EXAMPLE | 108 | ZZZ | 2.58 | 3.0 | 0.03 | 5.00 | calcium aluminate |
| COMPARATIVE EXAMPLE | 109 | AAAA | 2.61 | 3.0 | 0.03 | 5.00 | calcium aluminate |
| COMPARATIVE EXAMPLE | 110 | BBBB | 2.31 | 3.0 | 0.03 | 5.00 | calcium aluminate |
| COMPARATIVE EXAMPLE | 111 | CCCC | 2.31 | 3.0 | 0.03 | 5.00 | calcium aluminate |
| COMPARATIVE EXAMPLE | 112 | DDDD | 2.31 | 3.0 | 0.03 | 5.00 | calcium aluminate |
| COMPARATIVE EXAMPLE | 113 | EEEE | 2.31 | 3.0 | 0.03 | 5.00 | calcium aluminate |
| COMPARATIVE EXAMPLE | 114 | FFFF | 2.31 | 3.0 | 0.03 | 5.00 | calcium aluminate |
| EXAMPLE | 115 | GGGG | 2.27 | 2.8 | 0.14 | 5.00 | calcium aluminate |
| EXAMPLE | 116 | HHHH | 2.27 | 3.0 | 0.12 | 7.00 | calcium aluminate |
| EXAMPLE | 117 | IIII | 2.26 | 2.8 | 0.21 | 20.00 | calcium aluminate |
| EXAMPLE | 118 | JJJJ | 2.27 | 1.0 | 0.00 | — | none |
| EXAMPLE | 119 | KKKK | 2.27 | 1.0 | 0.00 | — | none |
| EXAMPLE | 120 | LLLL | 2.26 | 2.8 | 0.21 | 20.00 | calcium aluminate |
| EXAMPLE | 121 | MMMM | 2.27 | 2.0 | 0.20 | 20.00 | calcium aluminate |

The underlined value in the table indicates out of the range of the present invention.

TABLE 11

| | | | MECHANICAL PROPERTIES | | | | | | | | |
|---|---|---|---|---|---|---|---|---|---|---|---|
| | | | | | | | FRACTURE PROPERTIES | | | | |
| | | | | | | | THREE POINT BENDING TEST | | CHARPY TEST FRACTURE | | |
| | | | TENSILE PROPERTIES | | FORMABILITY HOLE EXPANSION TEST | | RESISTANCE OF CRACK | RESISTANCE OF CRACK | APPEARANCE TRANSITION | | FATIGUE PROPERTIES |
| | | STEEL COMPOSITION | TENSILE STRENGTH TS (MPa) | n VALUE | AVERAGE λ ave (%) | STANDARD DEVIATION σ (λ) | INITIATION Jc ($MJ/m^3$) | PROPAGATION T.M. ($MJ/m^3$) | TEMPERATURE vTrs (° C.) | ABSORBED ENERGY E(J) | FATIGUE LIFE (times) |
| EXAMPLE | 1 | A | 820 | 0.13 | 68 | 10 | 0.60 | 893 | −62 | 23.4 | 676000 |
| EXAMPLE | 2 | B | 800 | 0.13 | 75 | 9 | 0.69 | 880 | −61 | 27.4 | 668000 |
| EXAMPLE | 3 | C | 815 | 0.13 | 75 | 7 | 0.69 | 933 | −62 | 27.4 | 700000 |
| EXAMPLE | 4 | D | 790 | 0.13 | 75 | 8 | 0.69 | 906 | −64 | 27.4 | 684000 |
| EXAMPLE | 5 | E | 790 | 0.13 | 64 | 13 | 0.55 | 933 | −63 | 21.2 | 700000 |
| EXAMPLE | 6 | F | 790 | 0.13 | 64 | 11 | 0.55 | 906 | −63 | 21.2 | 684000 |
| EXAMPLE | 7 | G | 824 | 0.13 | 90 | 7 | 0.88 | 933 | −63 | 36.0 | 700000 |
| EXAMPLE | 8 | H | 825 | 0.13 | 90 | 7 | 0.88 | 933 | −63 | 36.0 | 700000 |
| EXAMPLE | 9 | I | 824 | 0.14 | 65 | 9 | 0.56 | 746 | −79 | 21.7 | 588000 |
| EXAMPLE | 10 | J | 704 | 0.15 | 75 | 10 | 0.69 | 693 | −63 | 27.4 | 556000 |
| COMPARATIVE EXAMPLE | 11 | K | 772 | 0.14 | 61 | 10 | 0.51 | 773 | 0 | 19.5 | 604000 |
| COMPARATIVE EXAMPLE | 12 | L | 765 | 0.12 | 62 | 9 | 0.52 | 786 | 6 | 20.0 | 480000 |
| EXAMPLE | 13 | M | 815 | 0.13 | 65 | 10 | 0.56 | 773 | −71 | 21.7 | 604000 |
| EXAMPLE | 14 | N | 790 | 0.13 | 83 | 8 | 0.79 | 933 | −63 | 32.0 | 700000 |
| EXAMPLE | 15 | O | 790 | 0.13 | 63 | 15 | 0.54 | 760 | −64 | 20.6 | 596000 |
| EXAMPLE | 16 | P | 790 | 0.13 | 62 | 15 | 0.52 | 680 | −63 | 20.0 | 548000 |
| EXAMPLE | 17 | Q | 790 | 0.13 | 61 | 15 | 0.51 | 626 | −63 | 19.5 | 516000 |
| EXAMPLE | 18 | R | 790 | 0.13 | 60 | 13 | 0.50 | 746 | −63 | 18.9 | 588000 |
| EXAMPLE | 19 | S | 790 | 0.13 | 61 | 10 | 0.51 | 773 | −64 | 19.5 | 604000 |
| EXAMPLE | 20 | T | 790 | 0.13 | 62 | 11 | 0.52 | 786 | −62 | 20.0 | 612000 |
| EXAMPLE | 21 | U | 790 | 0.13 | 65 | 9 | 0.56 | 653 | −63 | 21.7 | 532000 |
| EXAMPLE | 22 | V | 790 | 0.13 | 68 | 8 | 0.60 | 666 | −62 | 23.4 | 540000 |
| EXAMPLE | 23 | W | 790 | 0.13 | 80 | 7 | 0.75 | 800 | −63 | 30.3 | 620000 |
| EXAMPLE | 24 | X | 790 | 0.13 | 67 | 8 | 0.59 | 933 | −63 | 22.9 | 700000 |
| EXAMPLE | 25 | Y | 790 | 0.13 | 65 | 10 | 0.56 | 602 | −63 | 21.7 | 501600 |
| COMPARATIVE EXAMPLE | 26 | Z | 790 | 0.13 | 50 | 18 | 0.37 | 400 | −63 | 13.2 | 380000 |
| COMPARATIVE EXAMPLE | 27 | AA | 794 | 0.13 | 40 | 20 | 0.25 | 533 | −64 | 7.5 | 460000 |

TABLE 11-continued

| | | | MECHANICAL PROPERTIES | | | | | | | | |
|---|---|---|---|---|---|---|---|---|---|---|---|
| | | | | | | | FRACTURE PROPERTIES | | | | |
| | | | | | | | THREE POINT BENDING TEST | | CHARPY TEST FRACTURE | | |
| | | | TENSILE PROPERTIES | | FORMABILITY HOLE EXPANSION TEST | | RESISTANCE OF CRACK | RESISTANCE OF CRACK | APPEARANCE TRANSITION | | FATIGUE PROPERTIES |
| | | STEEL COMPOSITION | TENSILE STRENGTH TS (MPa) | n VALUE | AVERAGE λ ave (%) | STANDARD DEVIATION σ (λ) | INITIATION Jc ($MJ/m^3$) | PROPAGATION T.M. ($MJ/m^3$) | TEMPERATURE vTrs (° C.) | ABSORBED ENERGY E(J) | FATIGUE LIFE (times) |
| COMPARATIVE EXAMPLE | 28 | BB | 820 | 0.13 | 45 | 8 | 0.31 | 613 | −64 | 10.3 | 508000 |
| EXAMPLE | 29 | A | 774 | 0.14 | 66 | 10 | 0.57 | 853 | −62 | 22.3 | 652000 |
| COMPARATIVE EXAMPLE | 30 | A | 785 | 0.14 | 40 | 18 | 0.25 | 293 | −63 | 7.5 | 316000 |
| EXAMPLE | 31 | A | 790 | 0.13 | 60 | 10 | 0.50 | 600 | −63 | 18.9 | 500000 |
| COMPARATIVE EXAMPLE | 32 | A | 790 | 0.13 | 52 | 10 | 0.40 | 600 | −71 | 14.3 | 500000 |
| EXAMPLE | 33 | A | 790 | 0.13 | 65 | 9 | 0.56 | 613 | −63 | 21.7 | 508000 |
| EXAMPLE | 34 | A | 790 | 0.13 | 65 | 9 | 0.56 | 733 | −14 | 21.7 | 580000 |
| COMPARATIVE EXAMPLE | 35 | A | 790 | 0.13 | 62 | 10 | 0.52 | 666 | −8 | 20.0 | 540000 |
| COMPARATIVE EXAMPLE | 36 | A | 802 | 0.13 | 53 | 10 | 0.41 | 853 | −77 | 14.9 | 652000 |
| COMPARATIVE EXAMPLE | 37 | A | 810 | 0.13 | 45 | 10 | 0.31 | 853 | −77 | 10.3 | 652000 |
| COMPARATIVE EXAMPLE | 38 | A | 785 | 0.13 | 60 | 10 | 0.50 | 853 | −11 | 18.9 | 652000 |
| COMPARATIVE EXAMPLE | 39 | A | 790 | 0.13 | 60 | 10 | 0.50 | 853 | −11 | 18.9 | 652000 |
| COMPARATIVE EXAMPLE | 40 | A | 775 | 0.11 | 60 | 9 | 0.50 | 853 | −44 | 18.9 | 360000 |
| COMPARATIVE EXAMPLE | 41 | A | 774 | 0.11 | 60 | 10 | 0.50 | 853 | −27 | 18.9 | 350000 |

The underlined value in the table indicates out of the range of the present invention.

TABLE 12

| | | | MECHANICAL PROPERTIES | | | | | | | | |
|---|---|---|---|---|---|---|---|---|---|---|---|
| | | | | | | | FRACTURE PROPERTIES | | | | |
| | | | | | FORMABILITY HOLE EXPANSION TEST | | THREE POINT BENDING TEST | | | | |
| | | | TENSILE PROPERTIES | | | | RESISTANCE OF CRACK | RESISTANCE OF CRACK | CHARPY TEST | | |
| | | STEEL COMPOSITION | TENSILE STRENGTH TS (MPa) | n VALUE | AVERAGE λ ave (%) | STANDARD DEVIATION σ (λ) | INITIATION Jc (MJ/m³) | PROPAGATION T.M. (MJ/m³) | FRACTURE APPEARANCE TRANSITION TEMPERATURE vTrs (° C.) | ABSORBED ENERGY E(J) | FATIGUE PROPERTIES FATIGUE LIFE (times) |
| EXAMPLE | 42 | CC | 600 | 0.15 | 98 | 10 | 1.00 | 893 | −35 | 41.4 | 576000 |
| EXAMPLE | 43 | DD | 610 | 0.15 | 105 | 9 | 1.09 | 880 | −61 | 45.4 | 568000 |
| EXAMPLE | 44 | EE | 815 | 0.16 | 105 | 7 | 1.09 | 640 | −82 | 45.4 | 424000 |
| EXAMPLE | 45 | FF | 600 | 0.15 | 105 | 8 | 1.09 | 906 | −64 | 45.4 | 584000 |
| EXAMPLE | 46 | GG | 600 | 0.15 | 94 | 13 | 0.95 | 613 | −63 | 39.2 | 408000 |
| EXAMPLE | 47 | HH | 600 | 0.15 | 94 | 11 | 0.95 | 906 | −63 | 39.2 | 584000 |
| EXAMPLE | 48 | II | 610 | 0.15 | 120 | 7 | 1.27 | 706 | −63 | 54.0 | 464000 |
| EXAMPLE | 49 | JJ | 621 | 0.15 | 120 | 7 | 1.27 | 693 | −63 | 54.0 | 456000 |
| EXAMPLE | 50 | KK | 600 | 0.15 | 100 | 8 | 1.02 | 866 | −30 | 42.6 | 560000 |
| COMPARATIVE EXAMPLE | 51 | LL | 575 | 0.12 | 100 | 8 | 1.02 | 800 | 3 | 42.6 | 310000 |
| EXAMPLE | 52 | MM | 609 | 0.16 | 95 | 9 | 0.96 | 746 | −60 | 39.7 | 488000 |
| EXAMPLE | 53 | NN | 595 | 0.16 | 95 | 10 | 0.96 | 773 | −16 | 39.7 | 504000 |
| EXAMPLE | 54 | OO | 600 | 0.15 | 95 | 10 | 0.96 | 773 | −62 | 39.7 | 504000 |
| EXAMPLE | 55 | PP | 608 | 0.15 | 113 | 8 | 1.19 | 693 | −63 | 50.0 | 456000 |
| EXAMPLE | 56 | QQ | 600 | 0.15 | 93 | 15 | 0.93 | 760 | −64 | 38.6 | 496000 |
| EXAMPLE | 57 | RR | 600 | 0.15 | 92 | 15 | 0.92 | 680 | −63 | 38.0 | 448000 |
| EXAMPLE | 58 | SS | 600 | 0.15 | 91 | 15 | 0.91 | 626 | −63 | 37.5 | 416000 |
| EXAMPLE | 59 | TT | 600 | 0.15 | 90 | 13 | 0.90 | 746 | −63 | 36.9 | 488000 |
| EXAMPLE | 60 | UU | 600 | 0.15 | 91 | 10 | 0.91 | 773 | −64 | 37.5 | 504000 |
| EXAMPLE | 61 | VV | 600 | 0.15 | 92 | 11 | 0.92 | 786 | −62 | 38.0 | 512000 |
| EXAMPLE | 62 | WW | 610 | 0.15 | 95 | 9 | 0.96 | 653 | −63 | 39.7 | 432000 |
| EXAMPLE | 63 | XX | 608 | 0.15 | 98 | 8 | 1.00 | 666 | −62 | 41.4 | 440000 |
| EXAMPLE | 64 | YY | 600 | 0.15 | 110 | 7 | 1.15 | 800 | −63 | 48.3 | 520000 |
| EXAMPLE | 65 | ZZ | 600 | 0.15 | 97 | 8 | 0.98 | 933 | −63 | 40.9 | 600000 |
| EXAMPLE | 66 | AAA | 600 | 0.15 | 95 | 10 | 0.69 | 602 | −63 | 39.7 | 401600 |
| COMPARATIVE EXAMPLE | 67 | BBB | 600 | 0.15 | 80 | 18 | 0.77 | 400 | −63 | 31.2 | 280000 |
| COMPARATIVE EXAMPLE | 68 | CCC | 604 | 0.15 | 70 | 20 | 0.64 | 333 | −64 | 25.5 | 240000 |
| COMPARATIVE EXAMPLE | 69 | DDD | 630 | 0.15 | 58 | 8 | 0.48 | 613 | −64 | 15.6 | 408000 |
| COMPARATIVE EXAMPLE | 70 | CC | 584 | 0.16 | 96 | 10 | 0.97 | 853 | −62 | 40.3 | 552000 |
| COMPARATIVE EXAMPLE | 71 | CC | 595 | 0.16 | 70 | 18 | 0.64 | 293 | −63 | 25.5 | 216000 |
| EXAMPLE | 72 | CC | 600 | 0.15 | 90 | 10 | 0.90 | 600 | −63 | 36.9 | 400000 |
| COMPARATIVE EXAMPLE | 73 | CC | 600 | 0.15 | 57 | 10 | 0.49 | 600 | −71 | 15.8 | 400000 |
| EXAMPLE | 74 | CC | 600 | 0.15 | 95 | 9 | 0.96 | 613 | −63 | 39.7 | 408000 |
| EXAMPLE | 75 | CC | 600 | 0.15 | 95 | 9 | 0.96 | 733 | −14 | 39.7 | 480000 |
| COMPARATIVE EXAMPLE | 76 | CC | 600 | 0.15 | 92 | 10 | 0.92 | 666 | −11 | 38.0 | 440000 |
| COMPARATIVE EXAMPLE | 77 | CC | 612 | 0.15 | 56 | 10 | 0.47 | 853 | −77 | 15.7 | 552000 |
| COMPARATIVE EXAMPLE | 78 | CC | 620 | 0.14 | 58 | 10 | 0.49 | 853 | −77 | 15.9 | 552000 |
| COMPARATIVE EXAMPLE | 79 | CC | 595 | 0.15 | 90 | 10 | 0.90 | 853 | −11 | 36.9 | 552000 |
| COMPARATIVE EXAMPLE | 80 | CC | 585 | 0.12 | 91 | 8 | 0.91 | 853 | −11 | 37.5 | 340000 |
| COMPARATIVE EXAMPLE | 81 | CC | 585 | 0.11 | 90 | 8 | 0.90 | 853 | −44 | 36.9 | 330000 |

The underlined value in the table indicates out of the range of the present invention.

TABLE 13

| | | | MECHANICAL PROPERTIES | | | | | | | | |
|---|---|---|---|---|---|---|---|---|---|---|---|
| | | | | | | | FRACTURE PROPERTIES | | | | |
| | | | | | FORMABILITY HOLE EXPANSION TEST | | THREE POINT BENDING TEST | | CHARPY TEST | | |
| | | | TENSILE PROPERTIES | | | | | | | | |
| | | STEEL COMPOSITION | TENSILE STRENGTH TS (MPa) | n VALUE | AVERAGE λ ave (%) | STANDARD DEVIATION σ (λ) | RESISTANCE OF CRACK INITIATION Jc (MJ/m$^3$) | RESISTANCE OF CRACK PROPAGATION T.M. (MJ/m$^3$) | FRACTURE APPEARANCE TRANSITION TEMPERATURE vTrs (° C.) | ABSORBED ENERGY E(J) | FATIGUE PROPERTIES FATIGUE LIFE (times) |
| EXAMPLE | 82 | EEE | 590 | 0.13 | 69 | 8 | 0.61 | 653 | −77 | 24.0 | 532000 |
| EXAMPLE | 83 | FFF | 600 | 0.13 | 63 | 15 | 0.54 | 666 | −66 | 20.6 | 540000 |
| COMPARATIVE | 84 | GGG | 595 | 0.13 | 45 | 22 | 0.31 | 133 | −64 | 10.3 | 220000 |
| COMPARATIVE | 85 | HHH | 850 | 0.13 | 55 | 13 | 0.44 | 893 | −86 | 15.4 | 676000 |
| COMPARATIVE | 86 | JJJ | 600 | 0.13 | 50 | 18 | 0.37 | 333 | −79 | 13.2 | 340000 |
| EXAMPLE | 87 | A | 810 | 0.13 | 64 | 12 | 0.55 | 893 | −14 | 21.2 | 676000 |
| EXAMPLE | 89 | A | 815 | 0.13 | 65 | 10 | 0.56 | 893 | −79 | 17.2 | 400000 |
| EXAMPLE | 90 | KKK | 820 | 0.13 | 63 | 12 | 0.54 | 600 | −14 | 20.6 | 500000 |
| COMPARATIVE EXAMPLE | 91 | A | 855 | 0.13 | 56 | 13 | 0.45 | 600 | −70 | 15.7 | 500000 |
| COMPARATIVE EXAMPLE | 92 | A | 585 | 0.12 | 65 | 13 | 0.56 | 893 | −64 | 21.7 | 376000 |
| COMPARATIVE EXAMPLE | 93 | A | 830 | 0.13 | 58 | 13 | 0.47 | 893 | −90 | 15.8 | 676000 |
| COMPARATIVE EXAMPLE | 94 | LLL | 820 | 0.13 | 58 | 10 | 0.46 | 893 | −62 | 15.6 | 676000 |
| COMPARATIVE EXAMPLE | 95 | MMM | 572 | 0.15 | 90 | 10 | 0.90 | 600 | −63 | 36.9 | 400000 |
| COMPARATIVE EXAMPLE | 96 | NNN | 981 | 0.13 | 57 | 15 | 0.56 | 733 | −14 | 21.7 | 580000 |
| COMPARATIVE EXAMPLE | 97 | OOO | 983 | 0.13 | 55 | 15 | 0.56 | 733 | −14 | 21.7 | 580000 |
| COMPARATIVE EXAMPLE | 98 | PPP | 584 | 0.12 | 95 | 10 | 0.96 | 773 | −16 | 39.7 | 384000 |
| COMPARATIVE EXAMPLE | 99 | QQQ | 572 | 0.12 | 95 | 10 | 0.96 | 773 | −16 | 39.7 | 391000 |
| COMPARATIVE EXAMPLE | 100 | RRR | 704 | 0.15 | 56 | 10 | 0.44 | 693 | −63 | 15.3 | 556000 |
| COMPARATIVE EXAMPLE | 101 | SSS | 578 | 0.15 | 105 | 9 | 1.09 | 880 | −61 | 45.4 | 568000 |
| COMPARATIVE EXAMPLE | 102 | TTT | 982 | 0.13 | 59 | 7 | 0.48 | 933 | −62 | 15.7 | 700000 |
| COMPARATIVE EXAMPLE | 103 | UUU | 595 | 0.13 | 56 | 8 | 0.46 | 653 | −77 | 15.5 | 532000 |
| COMPARATIVE EXAMPLE | 104 | VVV | 600 | 0.13 | 57 | 19 | 0.44 | 297 | −66 | 14.8 | 213000 |
| COMPARATIVE EXAMPLE | 105 | WWW | 600 | 0.15 | 65 | 18 | 0.51 | 302 | −62 | 16.3 | 230000 |
| COMPARATIVE EXAMPLE | 106 | XXX | 590 | 0.13 | 55 | 20 | 0.49 | 288 | −77 | 15.8 | 222000 |
| COMPARATIVE EXAMPLE | 107 | YYY | 595 | 0.13 | 57 | 19 | 0.48 | 300 | −66 | 15.2 | 232000 |
| COMPARATIVE EXAMPLE | 108 | ZZZ | 820 | 0.13 | 56 | 10 | 0.44 | 893 | −62 | 15.1 | 676000 |
| COMPARATIVE EXAMPLE | 109 | AAAA | 820 | 0.13 | 58 | 10 | 0.42 | 893 | −62 | 14.9 | 676000 |
| COMPARATIVE EXAMPLE | 110 | BBBB | 981 | 0.13 | 54 | 10 | 0.60 | 893 | −62 | 23.4 | 676000 |
| COMPARATIVE EXAMPLE | 111 | CCCC | 983 | 0.13 | 53 | 10 | 0.60 | 893 | −62 | 23.4 | 676000 |
| COMPARATIVE EXAMPLE | 112 | DDDD | 982 | 0.13 | 54 | 10 | 0.60 | 893 | −62 | 23.4 | 676000 |
| COMPARATIVE EXAMPLE | 113 | EEEE | 981 | 0.13 | 52 | 10 | 0.60 | 893 | −62 | 23.4 | 676000 |
| COMPARATIVE EXAMPLE | 114 | FFFF | 982 | 0.13 | 55 | 10 | 0.60 | 893 | −62 | 23.4 | 676000 |
| EXAMPLE | 115 | GGGG | 791 | 0.13 | 65 | 9 | 0.56 | 746 | −79 | 21.7 | 588000 |
| EXAMPLE | 116 | HHHH | 785 | 0.13 | 65 | 10 | 0.56 | 773 | −71 | 21.7 | 604000 |
| EXAMPLE | 117 | IIII | 781 | 0.13 | 65 | 9 | 0.56 | 653 | −63 | 21.7 | 532000 |
| EXAMPLE | 118 | JJJJ | 782 | 0.13 | 83 | 8 | 0.79 | 933 | −63 | 32.0 | 700000 |
| EXAMPLE | 119 | KKKK | 780 | 0.13 | 83 | 8 | 0.79 | 933 | −63 | 32.0 | 700000 |

TABLE 13-continued

| | | | MECHANICAL PROPERTIES | | | | | | | | |
|---|---|---|---|---|---|---|---|---|---|---|---|
| | | | | | | | FRACTURE PROPERTIES | | | | |
| | | | | | FORMABILITY HOLE EXPANSION TEST | | THREE POINT BENDING TEST | | | | |
| | | | TENSILE PROPERTIES | | | STANDARD | RESISTANCE OF CRACK | RESISTANCE OF CRACK | CHARPY TEST | | |
| | | STEEL COMPOSITION | TENSILE STRENGTH TS (MPa) | n VALUE | AVERAGE λ ave (%) | DEVIATION σ (λ) | INITIATION Jc (MJ/m$^3$) | PROPAGATION T.M. (MJ/m$^3$) | FRACTURE APPEARANCE TRANSITION TEMPERATURE vTrs (° C.) | ABSORBED ENERGY E(J) | FATIGUE PROPERTIES FATIGUE LIFE (times) |
| EXAMPLE | 120 | LLLL | 782 | 0.13 | 65 | 9 | 0.56 | 653 | −63 | 21.7 | 532000 |
| EXAMPLE | 121 | MMMM | 781 | 0.13 | 68 | 8 | 0.60 | 666 | −62 | 23.4 | 540000 |

The underlined value in the table indicates out of the range of the present invention.

The invention claimed is:

1. A hot rolled steel sheet comprising, as a chemical composition, by mass %, 0.03% to 0.1% of C, 0.5% to 3.0% of Mn, at least one of Si and Al so as to satisfy a condition of 0.5% Si+Al 4.0%, limited to 0.1% or less of P, limited to 0.01% or less of S, limited to 0.02% or less of N, at least one selected from 0.001% to 0.3% of Ti, 0.0001% to 0.02% of Rare Earth Metal, and 0.0001% to 0.01% of Ca, and a balance comprising Fe and unavoidable impurities, and as a metallographic structure, a ferrite as a primary phase, at least one of a martensite and a residual austenite as a secondary phase, and plural inclusions, wherein: amounts expressed in mass % of each element in the chemical composition satisfy a following Expression 1;

an average grain size of the ferrite which is the primary phase is 2 μm to 10 μm;

an area fraction of the ferrite which is the primary phase is 90% to 99%;

an area fraction of the martensite and the residual austenite which are the secondary phase is 1% to 10% in total;

an average of a maximum of a ratio of a major axis to a minor axis of each of the inclusions observed in each of 30 visual fields being 0.0025 mm$^2$ in area in a cross section, whose normal direction corresponds to a transverse direction of the steel sheet, is 1.0 to 8.0;

a group of inclusions in which a major axis of each of the inclusions is 3 μm or more and an interval in a rolling direction between the inclusions is 50 μm or less are defined as inclusion-cluster, an inclusion in which the interval is more than 50 μm are defined as an independent-inclusion, a total length in the rolling direction of both the inclusion-cluster whose length in the rolling direction is 30 μm or more and the independent-inclusion whose length in the rolling direction is 30 μm or more is 0 mm to 0.25 mm per 1 mm$^2$ of the cross section;

a texture satisfies that an X-ray random intensity ratio of a {211} plane which is parallel to a rolling surface is 1.0 to 2.4; and a tensile strength is 590 MPa to 980 MPa, $$12.0 \leq (Ti/48)/(S/32)+\{(Ca/40)/(S/32)+(\text{Rare Earth Metal}/140)/(S/32)\}\times 15 \leq 150 \quad \text{(Expression 1).}$$

2. The hot rolled steel sheet according to claim 1, further comprising, as the chemical composition, by mass %, at least one of 0.001% to 0.1% of Nb, 0.0001% to 0.0040% of B, 0.001% to 1.0% of Cu, 0.001% to 1.0% of Cr, 0.001% to 1.0% of Mo, 0.001% to 1.0% of Ni, and 0.001% to 0.2% of V.

3. The hot rolled steel sheet according to claim 1, wherein, when the hot rolled steel sheet includes, as the chemical composition, by mass %, at least one of 0.0001% to 0.02% of Rare Earth Metal and 0.0001% to 0.01% of Ca, the Ti content is 0.001% to less than 0.08%.

4. The hot rolled steel sheet according to claim 1, wherein: amounts expressed in mass % of each element in the chemical composition satisfy a following Expression 2; and the average of the maximum in the ratio of the major axis to the minor axis of each of the inclusions in each of the visual fields is 1.0 to 3.0, $$0.3 \leq (\text{Rare Earth Metal}/140)/(Ca/40) \quad \text{(Expression 2).}$$

5. The hot rolled steel sheet according to claim 1, wherein an area fraction of a bainite and a pearlite in the metallographic structure is 0% to less than 5.0% in total.

6. The hot rolled steel sheet according to claim 1, wherein a total number of MnS precipitates and CaS precipitates having a major axis of 3 μm or more is 0% to less than 70% as compared with a total number of the inclusions having the major axis of 3 μm or more.

7. The hot rolled steel sheet according to claim 1, wherein an average grain size of the secondary phase is 0.5 μm to 8.0 μm.

8. The hot rolled steel sheet according to claim 2, wherein, when the hot rolled steel sheet includes, as the chemical composition, by mass %, at least one of 0.0001% to 0.02% of Rare Earth Metal and 0.0001% to 0.01% of Ca, the Ti content is 0.001% to less than 0.08%.

9. The hot rolled steel sheet according to claim 2, wherein: amounts expressed in mass % of each element in the chemical composition satisfy a following Expression 2; and the average of the maximum in the ratio of the major axis to the minor axis of each of the inclusions in each of the visual fields is 1.0 to 3.0, $$0.3 \leq (\text{Rare Earth Metal}/140)/(\text{Ca}/40) \quad \text{(Expression 2).}$$

10. The hot rolled steel sheet according to claim 2, wherein an area fraction of a bainite and a pearlite in the metallographic structure is 0% to less than 5.0% in total.

11. The hot rolled steel sheet according to claim 2, wherein a total number of MnS precipitates and CaS precipitates having a major axis of 3 μm or more is 0% to less than 70% as compared with a total number of the inclusions having the major axis of 3 μm or more.

12. The hot rolled steel sheet according to claim 2, wherein an average grain size of the secondary phase is 0.5 μm to 8.0 μm.

13. The hot rolled steel sheet according to claim 1, comprising, as the chemical composition, by mass %, 0 to 0.005% of V.

* * * * *